US008134532B2

(12) United States Patent
Baba et al.

(10) Patent No.: US 8,134,532 B2
(45) **Date of Patent: *Mar. 13, 2012**

(54) IMAGE DISPLAY APPARATUS AND IMAGE DISPLAY METHOD

(75) Inventors: Masahiro Baba, Yokohama (JP); Goh Itoh, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 730 days.

This patent is subject to a terminal disclaimer.

(21) Appl. No.: 12/261,945

(22) Filed: Oct. 30, 2008

(65) Prior Publication Data

US 2009/0115907 A1 May 7, 2009

(30) Foreign Application Priority Data

Oct. 31, 2007 (JP) ..... 2007-284141

(51) Int. Cl.
*G09G 3/36* (2006.01)

(52) U.S. Cl. ..... 345/102; 345/690; 345/691; 345/692; 345/693; 345/87; 345/90; 345/94; 345/98; 345/204; 348/671; 348/672; 348/673

(58) Field of Classification Search ..... 345/690, 345/87–102, 204–211; 348/671–673
See application file for complete search history.

(56) References Cited

U.S. PATENT DOCUMENTS 5,406,305 A * 4/1995 Shimomura et al. ..... 345/102
6,873,729 B2 * 3/2005 Matsushima ..... 382/167
6,894,666 B2 * 5/2005 Otawara et al. ..... 345/77
6,967,698 B2 11/2005 Tanoue et al.
6,979,095 B2 12/2005 Min et al.
7,072,116 B2 7/2006 Okuwaki et al.
7,199,776 B2 * 4/2007 Ikeda et al. ..... 345/89
7,452,119 B2 11/2008 Onishi et al.
7,643,004 B2 * 1/2010 Park et al. ..... 345/102
7,659,880 B2 * 2/2010 Miyazawa ..... 345/102
7,893,917 B2 * 2/2011 Baba et al. ..... 345/102
2002/0003522 A1 * 1/2002 Baba et al. ..... 345/89

(Continued)

FOREIGN PATENT DOCUMENTS

CN 1567050 A 1/2005

(Continued)

OTHER PUBLICATIONS

Taiwanese Office Action dated Mar. 1, 2011 (and English translation thereof) in counterpart Taiwanese Application No. 095147779.

(Continued)

*Primary Examiner* — Grant Sitta
(74) *Attorney, Agent, or Firm* — Finnegan, Henderson, Farabow, Garrett & Dunner, L.L.P.

(57) ABSTRACT

An image display apparatus includes an image displaying unit that includes a light source unit and a light modulation device, a histogram generating unit, a light source luminance calculator, a function storing unit, a first evaluation value calculator, a second evaluation value calculator, a third evaluation value calculator, a function acquiring unit and a control unit. The function acquiring unit acquires a plurality of the third evaluation values by repeating processing by the first to third evaluation value calculators with modification to a level conversion function and acquires a level conversion function that has a smallest third evaluation. The control unit supplies a signal of a converted video resulting from conversion of the image with the acquired level conversion function to the light modulation device.

14 Claims, 34 Drawing Sheets

U.S. PATENT DOCUMENTS

| | | | | |
|---|---|---|---|---|
| 2002/0044436 | A1 | 4/2002 | Ohkawa | |
| 2004/0201562 | A1* | 10/2004 | Funamoto et al. | 345/89 |
| 2004/0257318 | A1* | 12/2004 | Itoh | 345/87 |
| 2004/0257329 | A1* | 12/2004 | Park et al. | 345/102 |
| 2005/0253980 | A1 | 11/2005 | Saito et al. | |
| 2005/0259440 | A1 | 11/2005 | Onishi et al. | |
| 2006/0082884 | A1 | 4/2006 | Feng et al. | |
| 2006/0221046 | A1* | 10/2006 | Sato et al. | 345/102 |
| 2006/0232995 | A1 | 10/2006 | Wu et al. | |
| 2007/0001997 | A1* | 1/2007 | Kim et al. | 345/102 |
| 2007/0268242 | A1 | 11/2007 | Baba et al. | |
| 2007/0285379 | A1* | 12/2007 | Jung et al. | 345/102 |
| 2008/0074372 | A1 | 3/2008 | Baba et al. | |
| 2009/0002285 | A1* | 1/2009 | Baba et al. | 345/77 |
| 2009/0015601 | A1* | 1/2009 | Kim | 345/690 |

FOREIGN PATENT DOCUMENTS

| | | | |
|---|---|---|---|
| CN | 1680853 | A | 10/2005 |
| CN | 1700072 | A | 11/2005 |
| EP | 1 544 537 | A1 | 6/2005 |
| JP | 05-142540 | A | 6/1993 |
| JP | 2000-113706 | A | 4/2000 |
| JP | 3215388 | | 7/2001 |
| JP | 2003-207610 | A | 7/2003 |
| JP | 2003-249111 | A | 9/2003 |
| JP | 2004-111383 | A | 4/2004 |
| JP | 2004-133334 | A | 4/2004 |
| JP | 3583124 | | 8/2004 |
| JP | 2005-148710 | | 6/2005 |
| JP | 2005-174706 | A | 6/2005 |
| JP | 2005-331565 | A | 12/2005 |
| TW | 200532328 | A | 10/2005 |

OTHER PUBLICATIONS

"Color Liquid Crystal Display": Chin Shun Rei. Kenko Publisher: Nov. 2011: p. 127, Figs. 6 to 16 (a)-(b), Figs. 6-17.

Japanese Office Action dated May 11, 2010 and English translation thereof, issued in counterpart Japanese Application No. 2005-368290.

Chinese Office Action (and English translation thereof) dated May 23, 2008, issued in a counterpart Chinese Application.

Nonaka et al., U.S. Appl. No. 12/326,338, filed Dec. 2, 2008, entitled "Image Display Apparauts and Image Display Method".

Nonaka et al., U.S. Appl. No. 12/332,097, filed Dec. 10, 2008, entitled "Liquid Crystal Display Apparatus".

* cited by examiner

| GRAY-SCALE LEVEL x | BRIGHTNESS G(x) |
|---|---|
| 0 | 0.000000 |
| 1 | 0.000005 |
| 2 | 0.000023 |
| 3 | 0.000057 |
| | |
| 252 | 0.974300 |
| 253 | 0.982826 |
| 254 | 0.991393 |
| 255 | 1.000000 |

FIG. 6

| GRAY-SCALE LEVEL x | BRIGHTNESS GRADIENT G'(x) |
|---|---|
| 0 | 0.000000 |
| 1 | 0.000011 |
| 2 | 0.000026 |
| 3 | 0.000042 |
| | |
| 252 | 0.008506 |
| 253 | 0.008546 |
| 254 | 0.008587 |
| 255 | 0.008627 |

FIG. 7

| GRAY-SCALE LEVEL x | BRIGHTNESS g(x, 0.1) | BRIGHTNESS g(x, 0.2) | BRIGHTNESS g(x, 0.3) | | BRIGHTNESS g(x, 0.9) | BRIGHTNESS g(x, 1.0) |
|---|---|---|---|---|---|---|
| 0 | 0.000400 | 0.000800 | 0.001200 | | 0.003600 | 0.004000 |
| 1 | 0.000401 | 0.000801 | 0.001202 | | 0.003605 | 0.004005 |
| 2 | 0.000402 | 0.000805 | 0.001207 | | 0.003621 | 0.004023 |
| 3 | 0.000406 | 0.000811 | 0.001217 | | 0.003651 | 0.004057 |
| | | | | | | |
| 252 | 0.097440 | 0.194881 | 0.292321 | | 0.876963 | 0.974403 |
| 253 | 0.098289 | 0.196579 | 0.294868 | | 0.884605 | 0.982895 |
| 254 | 0.099143 | 0.198285 | 0.297428 | | 0.892285 | 0.991427 |
| 255 | 0.100000 | 0.200000 | 0.300000 | | 0.900000 | 1.000000 |

FIG. 9

| GRAY-SCALE LEVEL x | BRIGHTNESS GRADIENT g' (x, 0.1) | BRIGHTNESS GRADIENT g' (x, 0.2) | BRIGHTNESS GRADIENT g' (x, 0.3) | | BRIGHTNESS GRADIENT g' (x, 0.9) | BRIGHTNESS GRADIENT g' (x, 1.0) |
|---|---|---|---|---|---|---|
| 0 | 0.000000 | 0.000000 | 0.000000 | | 0.000000 | 0.000000 |
| 1 | 0.000001 | 0.000002 | 0.000003 | | 0.000010 | 0.000011 |
| 2 | 0.000003 | 0.000005 | 0.000008 | | 0.000023 | 0.000026 |
| 3 | 0.000004 | 0.000008 | 0.000013 | | 0.000037 | 0.000042 |
| | | | | | | |
| 252 | 0.000847 | 0.001694 | 0.002542 | | 0.007625 | 0.008472 |
| 253 | 0.000851 | 0.001702 | 0.002554 | | 0.007661 | 0.008512 |
| 254 | 0.000855 | 0.001711 | 0.002566 | | 0.007697 | 0.008553 |
| 255 | 0.000859 | 0.001719 | 0.002578 | | 0.007734 | 0.008593 |

FIG. 10

| GRAY-SCALE LEVEL x | BRIGHTNESS g (x, 1.0) |
|---|---|
| 0 | 0.004000 |
| 1 | 0.004005 |
| 2 | 0.004023 |
| 3 | 0.004057 |
| | |
| 252 | 0.974403 |
| 253 | 0.982895 |
| 254 | 0.991427 |
| 255 | 1.000000 |

FIG. 12

| GRAY-SCALE LEVEL x | BRIGHTNESS GRADIENT g' (x, 1.0) |
|---|---|
| 0 | 0.000000 |
| 1 | 0.000011 |
| 2 | 0.000026 |
| 3 | 0.000042 |
| | |
| 252 | 0.008472 |
| 253 | 0.008512 |
| 254 | 0.008553 |
| 255 | 0.008593 |

FIG. 13

| INPUT GRAY-SCALE LEVEL x | OUTPUT GRAY-SCALE $f_0(x)$ | OUTPUT GRAY-SCALE $f_1(x)$ | OUTPUT GRAY-SCALE $f_2(x)$ | | OUTPUT GRAY-SCALE $f_8(x)$ | OUTPUT GRAY-SCALE $f_9(x)$ |
|---|---|---|---|---|---|---|
| 0 | 0 | 0 | 0 | | 0 | 0 |
| 1 | 2 | 2 | 2 | | 1 | 1 |
| 2 | 4 | 4 | 3 | | 2 | 2 |
| 3 | 6 | 5 | 5 | | 3 | 3 |
| | | | | | | |
| 252 | 255 | 255 | 254 | | 252 | 252 |
| 253 | 255 | 255 | 254 | | 253 | 253 |
| 254 | 255 | 255 | 255 | | 254 | 254 |
| 255 | 255 | 255 | 255 | | 255 | 255 |

FIG. 15

IMAGE DISPLAY APPARATUS AND IMAGE DISPLAY METHOD

CROSS REFERENCE TO RELATED APPLICATIONS

This application is based upon and claims the benefit of priority from the prior Japanese Patent Applications No. 2007-284141, filed on Oct. 31, 2007; the entire contents of which are incorporated herein by reference.

BACKGROUND OF THE INVENTION

1. Field of the Invention

The present invention relates an image display apparatus that are capable of enhancing visual contrast of a displayed video and reducing power consumption.

2. Related Art

In these years, image display apparatuses typified by liquid crystal displays that have a light source and a light modulation element for modulating light intensity from the light source have become widely available. However, because the light modulation element of such an image display apparatus does not have ideal modulation characteristics, it causes degradation of contrast resulting from leakage of light from the light modulation element especially when black is displayed on the apparatus.

To prevent such degradation of contrast, a number of methods have been proposed for performing luminance modulation of the light source in combination with conversion of the gray-scale level of each pixel of an input video, namely gamma conversion, as appropriate for the input video.

For example, Japanese Patent No. 3215388 describes a technique for determining a backlight luminance and a gray-scale level conversion function (hereinafter a "level conversion function) based on the minimum, maximum, and average gray-scale levels of an input video. JP-A 2005-148710 (Kokai) discloses a technique for generating a histogram of an input video, determining a backlight luminance from the mode, and determining a level conversion function with respect to a bin of the histogram to which the mode belongs.

As compared to an image display apparatus having a constant light source luminance, the above techniques both can enhance contrast by controlling the light source luminance and the level conversion function for an input video as appropriate for the video and also can reduce power consumption because they can lower backlight luminance in accordance with the input video.

However, the technique of Japanese Patent No. 3215388 determines the level conversion function only based on the minimum and maximum gray-scale levels and does not consider the frequency distribution (histogram) of gray-scale levels. It thus has difficulty in obtaining a sufficient contrast for some videos. That is to say, there are a large number of videos that have the same minimum and/or maximum gray-scale level but significantly differ in the distribution of gray-scale levels and the technique sets the same level conversion function for all of such videos, which results in the problem of insufficient contrast of an input video.

The technique of JP-A 2005-148710 (Kokai) determines a level conversion function based on the histogram of an input video and in consideration of the bin to which the mode belongs as well as its frequency. With this technique, however, it is still difficult to obtain a sufficient contrast for a video having a multimodal histogram, such as one having two peaks.

SUMMARY OF THE INVENTION

According to an aspect of the present invention, there is provided with an image display apparatus, comprising:

an image displaying unit that includes:

a light source unit that emits light whose luminance is adjustable; and a light modulation device configured to display an image by modulating a transmittance or a reflectance of light from the light source unit based on a signal representing the image, a histogram generating unit configured to generate, from the image, a histogram representing frequencies of pixels contained in level ranges associated with representative gray-scale levels;

a light source luminance calculator configured to calculate a light source luminance that is to be set in the light source unit based on the histogram, as an object light source luminance;

a function storing unit configured to store a level conversion function for performing level conversion of gray-scale level;

a first evaluation value calculator configured to calculate first differences between a first brightness preset for each of the representative gray-scale levels and a second brightness obtained when an output gray-scale level resulting from conversion of each of the representative gray-scale levels with the level conversion function is displayed on the image displaying unit at the object light source luminance, calculate products of the first differences and the frequencies of the representative gray-scale levels, and calculate a total sum of such products as a first evaluation value;

a second evaluation value calculator configured to calculate second differences between a first gradient which is a gradient of the first brightness preset for each of the representative gray-scale levels and a second gradient which is a gradient of the second brightness as when an output gray-scale level resulting from conversion of each of the representative gray-scale levels with the level conversion function is displayed on the image displaying unit at the object light source luminance, calculate products of the second differences and the frequencies of the representative gray-scales, and calculate a total sum of such products as a second evaluation value;

a third evaluation value calculator configured to calculate a third evaluation value by giving first and second weights to the first and the second evaluation values and then summing those first and second evaluation values;

a function acquiring unit configured to acquire a plurality of the third evaluation values by repeating performing of processing by the first to third evaluation value calculators with modification to the level conversion function and acquire an output level conversion function which is a level conversion function that has a smallest third evaluation value or the third evaluation value equal to or smaller than a threshold value; and a control unit configured to supply a signal representing a converted video resulting from conversion of the image with the output level conversion function to the light modulation device and to control the light source unit to illuminate at the object light source luminance.

According to an aspect of the present invention, there is provided with an image display method, comprising:

generating, from the image, a histogram representing frequencies of pixels contained in level ranges associated with representative gray-scale levels;

calculating a light source luminance that is to be set in a light source unit based on the histogram as an object light source luminance;

store a level conversion function for performing level conversion of gray-scale level in a function storage;

calculating first differences between a first brightness preset for each of the representative gray-scale levels and a second brightness obtained when an output gray-scale level resulting from conversion of each of the representative gray-scale levels with the level conversion function is displayed on the image displaying unit at the object light source luminance, calculating products of the first differences and the frequencies of the representative gray-scale levels, and calculating a total sum of such products as a first evaluation value;

calculating second differences between a first gradient which is a gradient of the first brightness preset for each of the representative gray-scale levels and a second gradient which is a gradient of the second brightness as when an output gray-scale level resulting from conversion of each of the representative gray-scale levels with the level conversion function is displayed on the image displaying unit at the object light source luminance, calculating products of the second differences and the frequencies of the representative gray-scales and calculating a total sum of such products as a second evaluation value;

calculating a third evaluation value by giving first and second weights to the first and the second evaluation values and then summing those first and second evaluation values;

acquiring a plurality of the third evaluation values by repeating performing of processing by calculations of the first to third evaluation value with modification to the level conversion function and acquiring an output level conversion function which is a level conversion function that has a smallest third evaluation value or the third evaluation value equal to or smaller than a threshold value; and supplying a signal representing a converted video resulting from conversion of the image with the output level conversion function to a light modulation device which displays an image by modulating a transmittance or a reflectance of light from the light source unit based on a signal representing the image and controlling the light source unit to illuminate at the object light source luminance.

BRIEF DESCRIPTION OF THE DRAWINGS

FIG. 6 shows an example of table data (data in a first table) on gray-scale level-brightness characteristics;

FIG. 7 shows an example of table data (data in a second table) on gray-scale level-brightness gradient characteristics;

FIG. 9 shows an example of table data (data in a third table) on gray-scale level-brightness characteristics;

FIG. 10 shows an example of table data (data in a fourth table) on gray-scale level-brightness gradient characteristics;

FIG. 12 shows gray-scale level-brightness characteristics for backlight luminance $I_{max}$;

FIG. 13 shows gray-scale level-brightness gradient characteristics for backlight luminance $I_{max}$;

FIG. 15 shows an example of the level conversion function lookup table;

DETAILED DESCRIPTION OF THE INVENTION

First Embodiment

Figure 1:
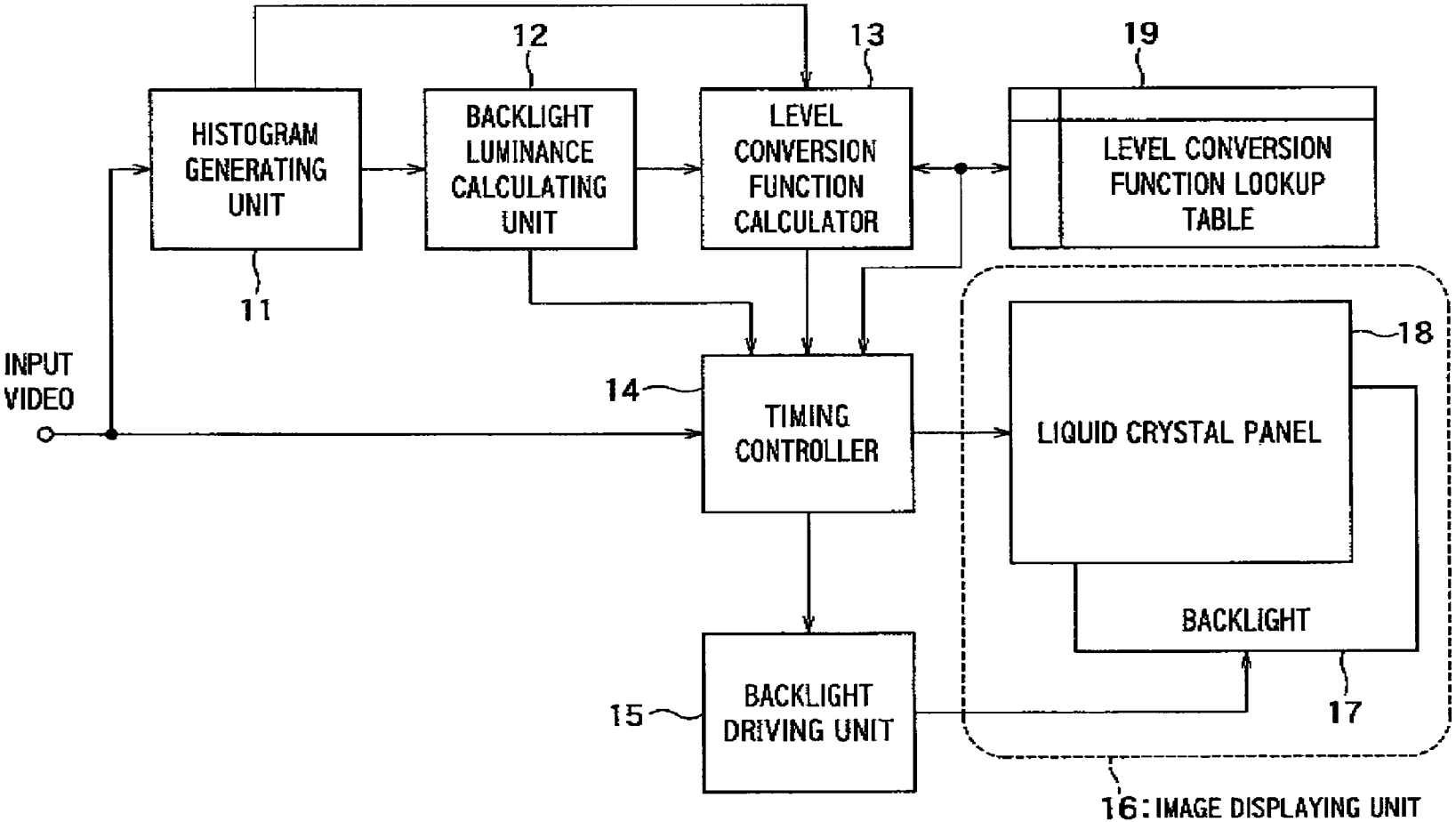
FIG. 1 shows a configuration of an image display apparatus according to a first embodiment of the present invention.

FIG. 1 shows a configuration of an image display apparatus according to a first embodiment of the present invention. The image display apparatus according to the first embodiment includes a histogram generating unit 11, a backlight luminance calculating unit (a light source luminance calculator) 12, a level conversion function calculator (first, second, and third evaluation value calculators, and a function acquiring unit) 13, a level conversion function lookup table (a function storage for storing level conversion functions) 19, a timing controller (a control unit) 14, a backlight driving unit 15, and an image displaying unit 16. The image displaying unit 16 is a liquid crystal displaying unit which is composed of a liquid crystal panel 18 as a light modulation element and a backlight 17 as a light source which is disposed on the back surface of the liquid crystal panel 18. An input image is input to the histogram generating unit 11 and the timing controller 14. The histogram generating unit 11 counts the number of pixels contained in each level range in steps of a predetermined levels in the input image and generates a histogram that maps a gray-scale level representative of each level range to the number of pixels contained in that level range (the number of pixels is an example of pixel frequency). The backlight luminance calculating unit 12 calculates a luminous luminance (or light source luminance) of the backlight 17 based on the histogram generated by the histogram generating unit 11. The level conversion function calculator 13 calculates a level conversion function which is used for converting the input image based on the histogram generated by the histogram generating unit 11 and the backlight luminance calculated by the backlight luminance calculating unit 12 with reference to the level conversion function lookup table 19. The timing controller 14 performs level conversion to the input image using the level conversion function calculated by the level conversion function calculator 13, and then adjusts synchronization between the converted image after level conversion and the backlight luminance calculated by the backlight luminance calculating unit 12. The converted image is sent to the liquid crystal panel 18 with a synchronization signal for driving the liquid crystal panel 18 and the backlight luminance is sent to the backlight driving unit 15. The backlight driving unit 15 generates a backlight driving signal for actually driving and controlling the backlight 17 based on the backlight luminance input and sends the signal to the backlight 17. In the image displaying unit 16, the converted image is written to the liquid crystal panel 18 and simultaneously the backlight 17 illuminates based on the backlight driving signal output from the backlight driving unit 15, thereby displaying the image on the liquid crystal panel 18.

Now, operation of the individual units will be described in detail. The operation will be described in the case of using a video. A video contains a plurality of the image frames, and the image frames is just called the image or the frame.

(The Histogram Generating Unit 11)

The histogram generating unit 11 counts the number of pixels contained in each level range in steps of predetermined levels in an input video and generates a histogram that maps a gray-scale level representative of each level range to the frequency (i.e., the number of pixels) contained in that level range.

Figure 2:
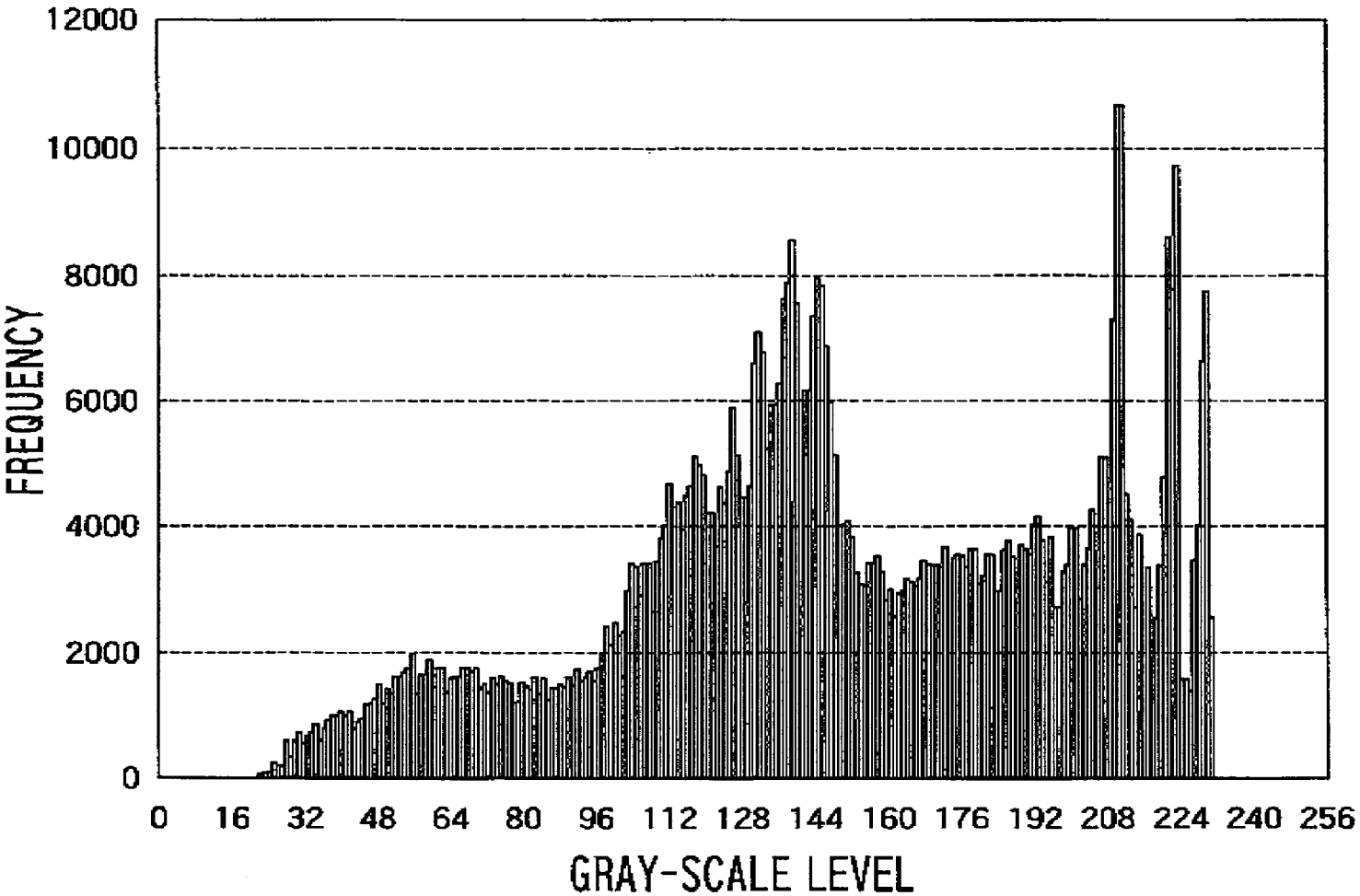
FIG. 2 shows an example of a histogram.

While the input video can be of various formats, this embodiment assumes an input video made up of three channels, red, green, and blue, and the histogram generating unit 11 generates one histogram without distinguishing the individual channels. When each of the read, green and blue channels of the input video is of an B-bit gray-scale level, a frequency distribution from 0 to 255 gray-scale level as shown in FIG. 2 is obtained by counting the frequency of each gray-scale level and detecting a histogram. The configuration of the histogram generating unit 11 may be modified as described below.

As a first modification example, besides frequency, the histogram may also use a value that is normalized according to the total number of pixels as shown below, for example $$h_n(x) = \frac{h(x)}{\sum_{i=0}^{255} h(i)} \quad \text{[Formula 1]}$$

where "$h_n(x)$" represents the frequency normalized according to the total number of pixels of a gray-scale level x, and "h(x)" represents the frequency of the gray-scale level x.

As a second modification example, a histogram may be generated using only the largest one of gray-scale levels of the three channels, red, green and blue, in each pixel.

As a third modification example, when the input video is made up of three channels, Y, Cb(Pb), and Cr(Pr), which are constituted by a luminance signal and a color difference signal, a histogram for Y, the luminance channel, may be generated.

As a fourth modification example, an input video of three channels, Y, Cb (Pb) and Cr (Pr) may be converted into a video of three channel, red, green, and blue, according to Formula 2, and then a histogram can be generated in the above-mentioned manner.

$$\begin{bmatrix} R \\ G \\ B \end{bmatrix} = \begin{bmatrix} 1.0000 & 0.0000 & 1.4020 \\ 1.0000 & -0.3441 & -0.7141 \\ 1.0000 & 1.7720 & 0.0000 \end{bmatrix} \begin{bmatrix} Y \\ Cb-128 \\ Cr-128 \end{bmatrix} \quad \text{[Formula 2]}$$

where "Y", "Cb" and "Cr" represent values of luminance and color-difference signals normalized to 8 bits, and "R", "G", and "B" are values of video signals for three channels, red, green and blue, that are normalized to 8 bits. Formula 2 is an example of conversion and other conversion coefficient may be used.

A fifth modification example is the reverse of the above method: an input video of three channels, red, green and blue, may be subjected to conversion to a value of Y channel according to Formula 3 and a histogram may be generated.

$$Y=0.299R+0.587G+0.114B \quad \text{[Formula 3]}$$

Formula 3 is an example of conversion and other conversion coefficient may be used.

As a sixth modification example, multiple histograms may be generated. For example, the backlight luminance calculating unit 12 and/or a first evaluation value calculating step by the level conversion function calculator 13 to be discussed later may employ a histogram that uses the largest gray-scale level among the those of three channels, red, green and blue, of each pixel, and a second evaluation value calculating step by the level conversion function calculator 13, which will be discussed later, may use a histogram that does not distinguish the gray-scale levels of the three channels, red, green and blue, of each pixel.

Figure 3:
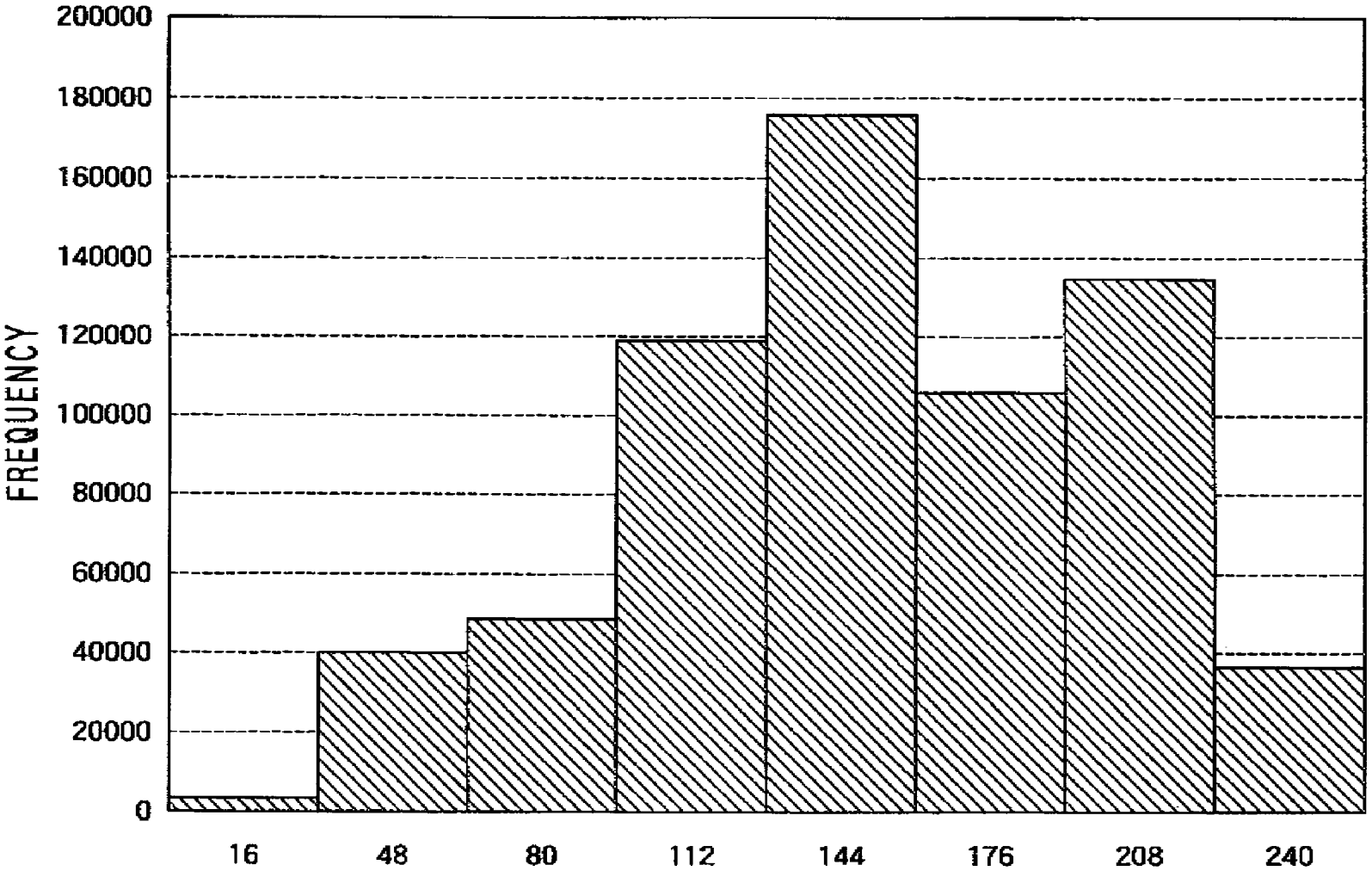
FIG. 3 shows an example of a histogram that is in increments of 32 gray-scale levels.

As a seventh modification example, a histogram in steps of a certain level range may be generated for the purpose of reducing the amount of memory required for maintaining histograms or the amount of processing required for generating histograms, in addition to calculating the frequency of each one level as shown in FIG. 2. For instance, FIG. 3 shows an example of generating a histogram in steps of 32 levels. An input video of 8-bit gray-scale level can be represented by the three higher-order bits, that is, in steps of 32 levels, by converting the five lower-order bits to 0 in binary expression. A gray-scale level representative of one level range (e.g., from 0 to 31 level) may be the median of the range. For instance, in the example shown in FIG. 3, 16 level is representative of 0 to 31 level and 48 level is of 32 to 63 level. To further reduce the amount of calculation and/or memory, only some levels of a histogram may be detected. For example, after generating a histogram of all gray-scale levels, gray-scale levels that represent the average, median, mode, minimum, and maximum value of the histogram may be detected and the frequency of histogram bins corresponding to levels other than those levels may be set to zero.

The histogram generated through such processing is input to the backlight luminance calculating unit 12.

(The Backlight Luminance Calculating Unit 12)

The backlight luminance calculating unit 12 calculates a backlight luminance based on the histogram generated by the histogram generating unit 11. While backlight luminance can be calculated in various ways, this embodiment determines an average value as a representative value from a histogram and calculates a backlight luminance from the average value.

First, an average value is calculated from a histogram according to Formula 4:

$$A = \frac{\sum_{i=0}^{255} \frac{i}{255} \cdot h(i)}{\sum_{i=0}^{255} h(i)} \quad \text{[Formula 4]}$$

Formula 4 calculates an average gray-scale level normalized to between 0 and 1, but an average luminance may be used instead as in Formula 5:

$$A = \frac{\sum_{i=0}^{255} \left(\frac{i}{255}\right)^{\Gamma} \cdot h(i)}{\sum_{i=0}^{255} h(i)} \quad \text{[Formula 5]}$$

where "Γ" represents a gamma value used for input video correction and this value is typically 2.2. Furthermore, an average lightness may be determined as Formula 6 using a lightness that is defined in a uniform color space:

$$A = \frac{\sum_{i=0}^{255} \left(\frac{i}{255}\right)^{\frac{\Gamma}{3}} \cdot h(i)}{\sum_{i=0}^{255} h(i)} \quad \text{[Formula 6]}$$

Strictly speaking, the lightness is standardized by the International Commission on Illumination (CIE) and it varies non-linearly in a dark area. In Formula 6, however, lightness is simplified to be proportional to one-third power.

Also, while Formulas 4 to 6 determine an average value, it is also possible to determine the mode or median from a histogram and calculate the backlight luminance from the value. For example, "A" may be set to a gray-scale level as the median. Also, when the median is luminance or lightness rather than a gray-scale level as In Formulas 5 and 6, it is expressed as Formulas 7 and 8, respectively:

$$A = \left(\frac{M}{255}\right)^{\Gamma} \quad \text{[Formula 7]}$$

$$A = \left(\frac{M}{255}\right)^{\frac{\Gamma}{3}} \quad \text{[Formula 8]}$$

where "M" represents a gray-scale level as the median. Although the above formulas determine the representative value "A" by calculation with respect to the median "M", as another example of a configuration, the relationship between the median "M" and the representative value "A" may be determined in advance and maintained in a lookup table (LUT), which is composed of Read Only Memory (ROM) or the like. The representative value "A" is then determined by referencing the LUT by median "M" determined from the histogram for each frame of the input video.

Figure 4:
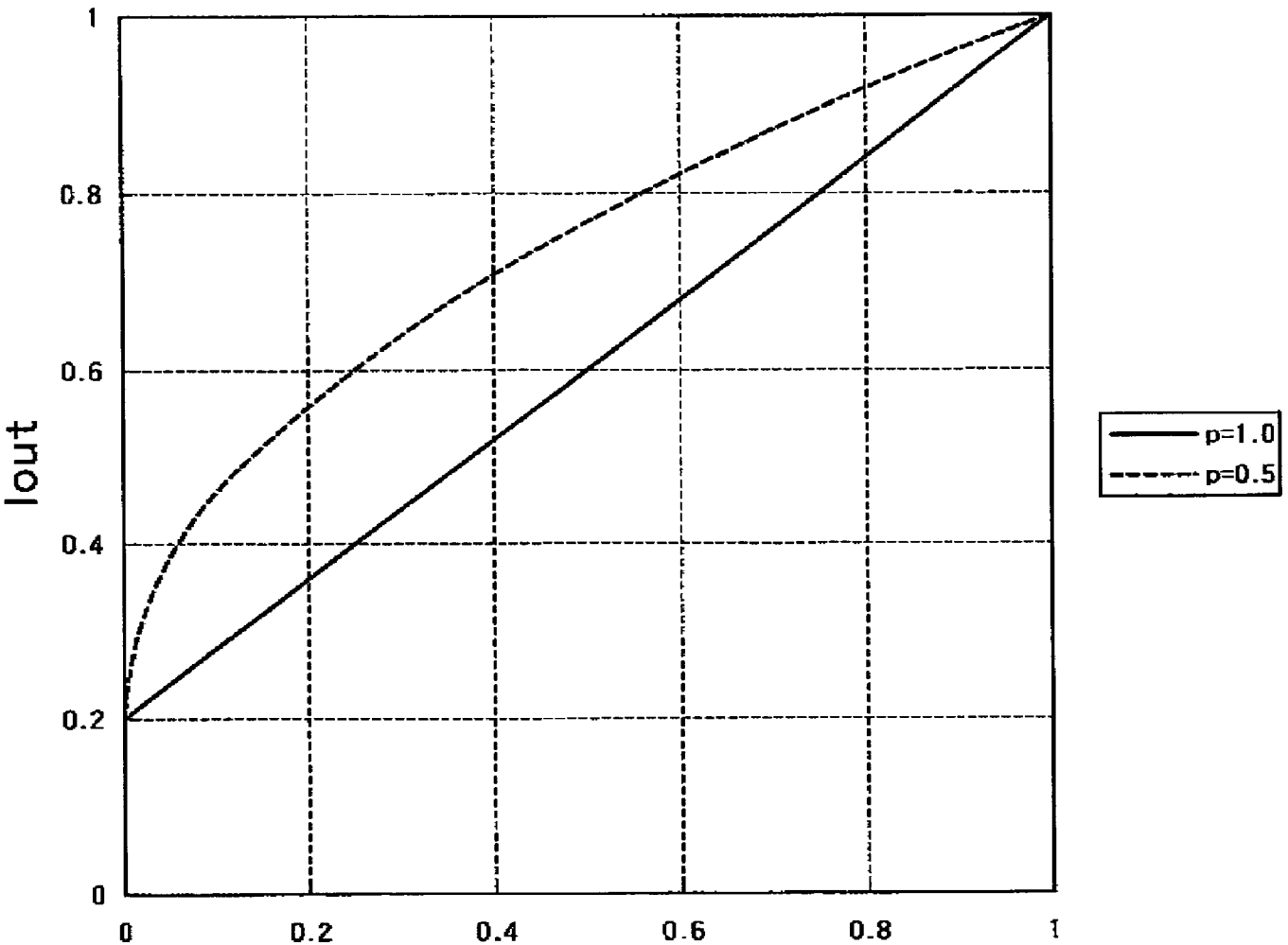
FIG. 4 illustrates an example of relationship between representative value A and backlight luminance $I_{out}$.

Using the representative value "A" thus calculated, the backlight luminance $I_{out}$ is calculated according to Formula 9:

$$I_{out} = A^{p}(I_{max} - I_{min}) + I_{min} \quad \text{[Formula 9]}$$

where "$I_{min}$" and "$I_{max}$" are the minimum and maximum values in the modulation range of the backlight luminance, respectively, and "p" is a controlling parameter. FIG. 4 shows an example of the relationship between the representative value "A" and output backlight luminance "$I_{out}$". FIG. 4 shows a case where "$I_{min}$" is set to 0.2, "$I_{max}$" is to 1.0, and "p" is to 0.5 and 1.0. The controlling parameter "p" may be set by the user to suit the characteristics of the image displaying unit 16 and/or usage environment.

(The Level Conversion Function Calculator 13)

Figure 5:
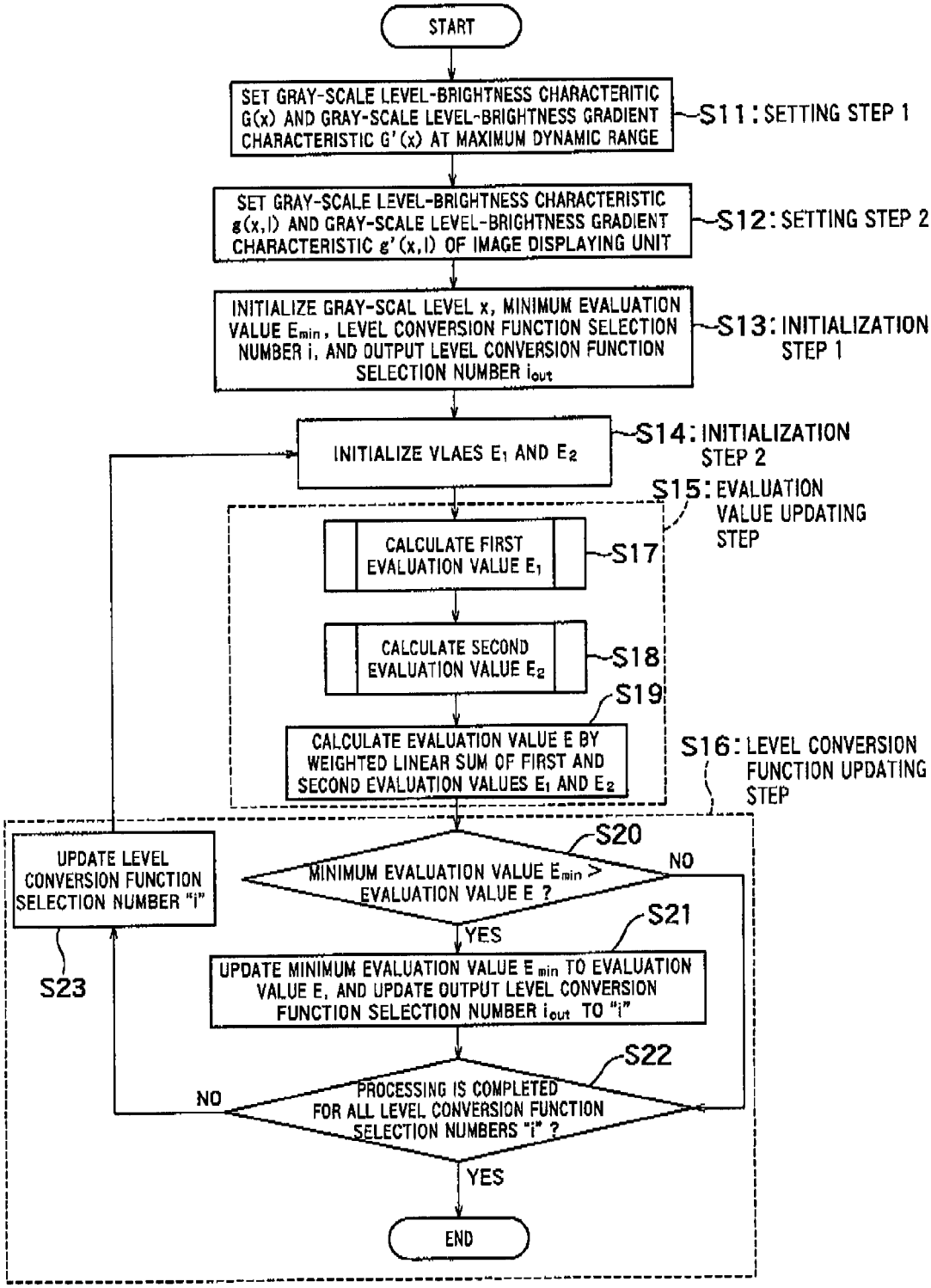
FIG. 5 is a flowchart illustrating the way of calculation performed in the operation of a level conversion function calculator according to the first embodiment.

The level conversion function calculator 13 calculates a level conversion function based on the histogram generated by the histogram generating unit 11 and the backlight luminance calculated by the backlight luminance calculating unit 12. In the following, the way of calculating a level conversion function will be described in detail with respect to the flowchart of FIG. 5.

At setting step 1 (S11), a gray-scale level-brightness characteristic and a gray-scale level-brightness gradient characteristic that are desired for display on the image displaying unit 16 are set. A maximum dynamic range of the image displaying unit 16 is preset in the level conversion function calculator 13. For instance, an ideal maximum dynamic range with the maximum being 1 and the minimum being 0 is expressed as Formula 10:

$$D_{min}=0$$

$$D_{max}=1 \quad \text{[Formula 10]}$$

where "$D_{min}$" and "$D_{max}$" represent the maximum and minimum values of the maximum dynamic range displayed on the image displaying unit 16, respectively. The maximum dynamic range can also be set as in Formula 11 based on a preset luminance modulation range of backlight luminance and the characteristics of the liquid crystal panel 18:

$$D_{min}=T_{min}I_{min}$$

$$D_{max}=T_{max}I_{max} \quad \text{[Formula 11]}$$

where "$I_{min}$" and "$I_{max}$" represent the minimum and maximum values of the backlight luminance modulation range, respectively, and "$T_{min}$" and "$T_{max}$" represent the minimum and maximum transmittances of the liquid crystal panel 18, respectively. Since "$I_{min}$", "$I_{max}$", "$T_{min}$" and "$T_{max}$" may be relative values, "$I_{min}$" can be set as a relative value with "$I_{max}$" set to 1, and "$T_{min}$" can be set as a relative value with "$T_{max}$" set to 1, for example. In terms of analysis, the maximum dynamic range is represented as Formula 11. In reality, however, the luminance of the image displaying unit 16 as measured when the smallest gray-scale level displayable on the liquid crystal panel 18 (0 gray-scale level for a liquid crystal panel capable of 8-bit representation) is displayed on the liquid crystal panel 18 and the backlight 17 illuminates with the minimum backlight luminance within the luminance modulation range is set in the minimum luminance "$D_{min}$" that is displayable on the image displaying unit 16. Similarly, the luminance of the image displaying unit 16 as measured when the largest gray-scale level displayable on the liquid crystal panel 18 (255 gray-scale level for a liquid crystal panel capable of B-bit representation) is displayed on the liquid crystal panel 18 and the backlight 17 illuminates with the maximum backlight luminance within the luminance modulation range may be set in the maximum luminance "$D_{max}$" that is displayable on the image displaying unit 16. Here, by setting the maximum luminance "$D_{max}$" to 1 and setting "$D_{min}$" as the minimum luminance with the maximum luminance "$D_{max}$" normalized to 1, the maximum dynamic range can be set as a relative value.

Next, a gray-scale level-brightness characteristic in the maximum dynamic range thus determined is set. When brightness is luminance, the gray-scale level-brightness characteristic can be calculated as Formula 12:

$$G(x)=\left(\frac{x}{255}\right)^{\Gamma}(D_{max}-D_{min})+D_{min} \quad \text{[Formula 12]}$$

where "x" represents a gray-scale level expressed in 8 bits and "Γ" represents a gamma value utilized for input video correction. The gamma value is typically 2.2. While Formula 12 represents a gray-scale level-luminance characteristic, a gray-scale level-brightness characteristic may also be a gray-scale level-logarithmic luminance characteristic as in Formula 13 because human sensitivity characteristics for brightness are proportional to the logarithm of luminance.

$$G_{log}(x)=\frac{\log(G(x))}{\log(G(255))} \quad \text{[Formula 13]}$$

Alternatively, a gray-scale level-lightness characteristic may be employed using the lightness defined in a uniform color space:

$$G_{L*}(x)=G(x)^{1/3} \quad \text{[Formula 14]}$$

Strictly speaking, lightness varies in a non-linear manner in a dark area standardized by CIE, but it is simplified to be proportional to one-third power here.

Each of "G(x)", "$G_{log}$ (x)", and "$G_{L*}$(x)" corresponds to a brightness predefined for each gray-scale level.

Next, a gray-scale level-brightness gradient characteristic within the maximum dynamic range is set. The gray-scale level-brightness gradient characteristic is equivalent to linear differentiation of the gray-scale level-brightness characteristic. That is, when brightness is luminance, the gray-scale level-luminance gradient characteristic can be analytically calculated as Formula 15:

$$G'(x)=\frac{d}{dx}G(x)=\frac{\Gamma}{255}\left(\frac{x}{255}\right)^{\Gamma-1}(D_{max}-D_{min}) \quad \text{[Formula 15]}$$

A gray-scale level-lightness gradient characteristic as shown In Formula 16 is also possible using the lightness defined in a uniform color space, $$G'_{L*}(x)=\frac{d}{dx}G_{L*}(x)=\frac{\Gamma}{3}\cdot\frac{1}{255}\left(\frac{x}{255}\right)^{\frac{\Gamma}{3}-1}(D_{max}-D_{min}) \quad \text{[Formula 16]}$$

Each of "G'(x)" and "$G_{L*}$'(x)" corresponds to a brightness gradient predefined for each gray-scale level.

Figure 8:
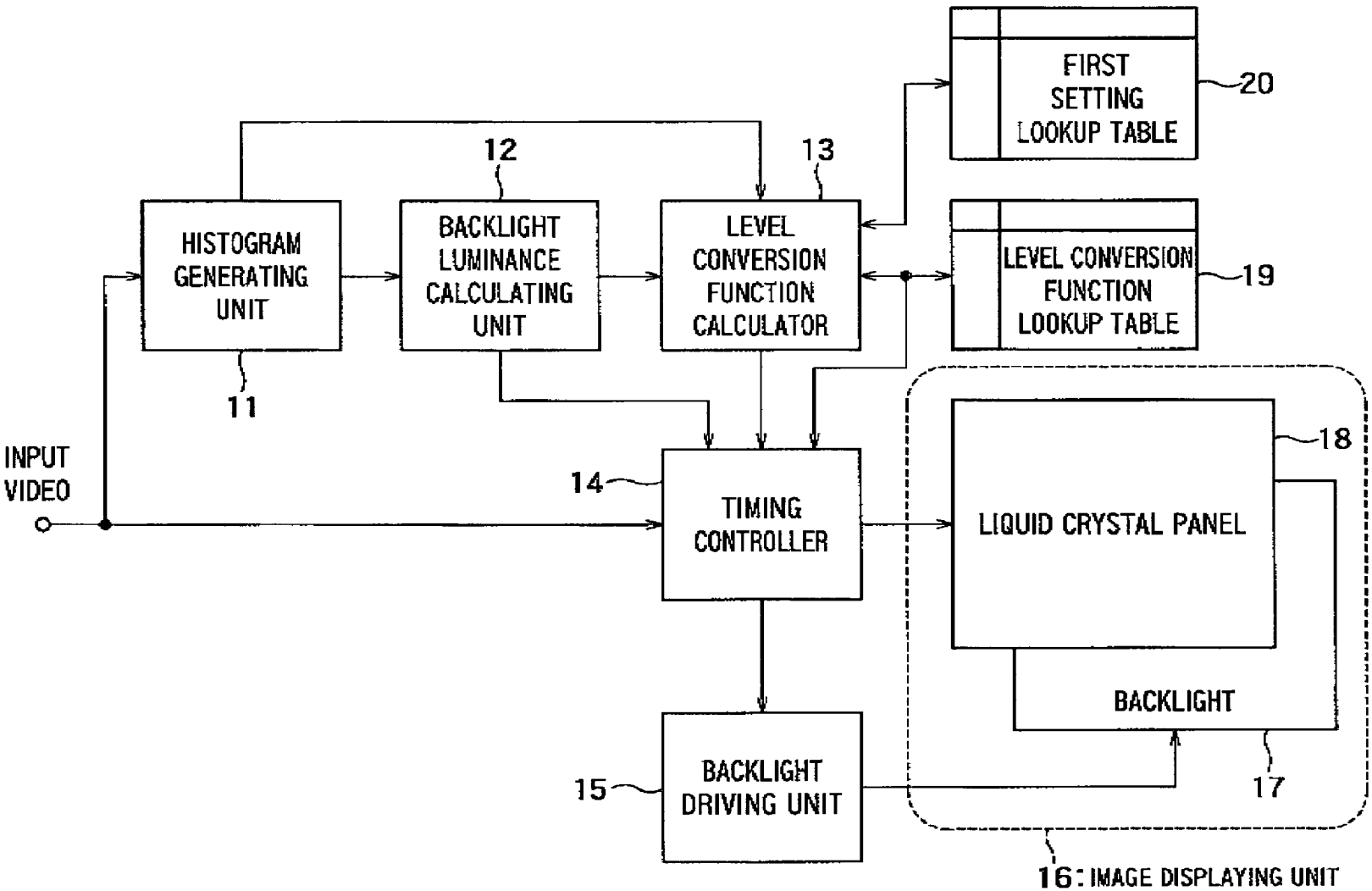
FIG. 8 shows a configuration in which the apparatus of FIG. 1 is provided with a first setting lookup table.

The gray-scale level-brightness and gray-scale level-brightness gradient characteristics may be calculated using Formulas 12 to 16, but they can also be determined in the following manner. By way of example, after defining "$D_{min}$" and "$D_{max}$", lookup table data that maps gray-scale level x to brightness G(x) is created from the relationship between the gray-scale level x and brightness G(x). Similarly, a lookup table that maps gray-scale level x to brightness gradient G'(x) is created. An example of table data on gray-scale level-brightness characteristic (data in a first table) is shown in FIG. 6, and an example of table data on gray-scale level-brightness gradient characteristic (data in a second table) is shown in FIG. 7. Then, the created table data is maintained as a first setting lookup table 20 on ROM or the like that is accessible to the level conversion function calculator 13 as shown in FIG. 8. To determine the brightness of a gray-scale level, a brightness corresponding to a gray-scale level x is determined by making reference to the ROM by gray-scale level x. Similarly, to determine the brightness gradient of a gray-scale level x, a brightness gradient corresponding to the gray-scale level x is determined by making reference to the ROM by gray-scale level x. When multiple numbers of "$D_{min}$" and "$D_{max}$" are prepared and the combination of "$D_{min}$" and "$D_{max}$" is changed under the user's instruction, for example, multiple pieces of table data corresponding to individual combinations may be prepared and table data for a certain combination that has been set may be referenced.

The brightness gradient of gray-scale level x can also be determined from table data on gray-scale level-brightness characteristics (data in the first table) shown in FIG. 6, in which case the table data on gray-scale level-brightness gradient characteristics (data in the second table) of FIG. 7 need not be prepared. To determine the brightness gradient of a gray-scale level x using the table data of FIG. 6, for example, either the difference between the brightness for the gray-scale level x and that of a gray-scale level larger or smaller than the gray-scale level x (e.g., a level neighboring the gray-scale level x) or the difference between a gray-scale level larger than the gray-scale level x and a smaller gray-scale level is obtained from the table data on gray-scale level-brightness characteristics (data in the first table) of FIG. 6 as the gradient corresponding to the gray-scale level x. What is described here also applies to the relationships in the table data of FIG. 9 (data in a third table) and those in FIG. 10 (data in a fourth table), which will be discussed later, in which case preparation of the table data of FIG. 10 (data in the fourth table) may be omitted.

At setting step 2 (S11), the actual gray-scale level-brightness characteristic and gray-scale level-brightness gradient characteristic of the image displaying unit 16 are set. The dynamic range of the image displaying unit 16 with backlight luminance I is expressed as Formula 17:

$$d_{min}(I)=T_{min}I$$

$$d_{max}(I)=T_{max}I \qquad \text{[Formula 17]}$$

where "$d_{min}(I)$" and "$d_{max}(I)$" represent the minimum and maximum values of a dynamic range that can be displayed on the image displaying unit 16 when backlight luminance is I, respectively. Analytically, the dynamic range of the image displaying unit 16 is expressed as Formula 17. In reality, however, the luminance of the image displaying unit 16 as measured when the smallest gray-scale level that can be displayed on the liquid crystal panel 18 (0 gray-scale level for a liquid crystal panel capable of 8-bit representation) is displayed on the liquid crystal panel 18 and the backlight 17 illuminates with backlight luminance I is set in the minimum display luminance $d_{min}(I)$ that is displayable on the image displaying unit 16 with backlight luminance I. Similarly, the luminance of the image displaying unit 16 as measured when the largest gray-scale level that can be displayed on the liquid crystal panel 18 (255 gray-scale level for a liquid crystal panel capable of 8-bit representation) is displayed on the liquid crystal panel 18 and the backlight 17 illuminates with backlight luminance I is set in the maximum display luminance $d_{max}(I)$ that is displayable on the image displaying unit 16 with backlight luminance I. Then, the smallest display luminance with $d_{max}$ ($I_{max}$) being normalized to 1 is set in $d_{min}(I)$, and the maximum display luminance is set in $d_{max}(I)$.

Next, the gray-scale level-brightness characteristic of the image displaying unit 16 at backlight luminance I is set. When brightness is luminance, the gray-scale level-luminance characteristic (generally called gamma characteristics) of the image displaying unit 16 is analytically expressed as Formula 18:

$$g(x, I) = \left(\frac{x}{255}\right)^{\gamma}(d_{max}(I) - d_{min}(I)) + d_{min}(I) \qquad \text{[Formula 18]}$$

where "x" represents a gray-scale level expressed in 8 bits and "γ" represents a gamma value utilized for correction of the liquid crystal panel 18. The gamma value is generally 2.2. While Formula 18 represents a gray-scale level-luminance characteristic, a gray-scale level-brightness characteristic may also be a gray-scale level-logarithmic luminance characteristic like Formula 19 because human sensitivity characteristic for brightness is proportional to the logarithm of luminance.

$$g_{log}(x, I) = \frac{\log(g(x, I))}{\log(g(255, I_{max}))} \qquad \text{[Formula 19]}$$

Alternatively, a gray-scale level-lightness characteristic may be determined using the lightness defined in a uniform color space:

$$g_{L^*}(x,I)=g(x,I)^{1/3} \qquad \text{[Formula 20]}$$

where the lightness in Formula 20 is simplified to be proportional to one-third power of luminance as in Formula 14.

Each of "g(x, I)", "$g_{log}$ (x, I)", and "$G_{L^*}$(x, I)" corresponds to a brightness when a gray-scale level x is displayed on the image displaying unit 16 at backlight luminance I.

Next, the gray-scale level-brightness gradient characteristic of the image displaying unit 16 at backlight luminance I is set. When brightness is luminance, the gray-scale level-luminance gradient characteristic of the image displaying unit 16 is analytically expressed as Formula 21:

$$g'(x, I) = \frac{d}{dx}g'(x, I) = \frac{\gamma}{255}\left(\frac{x}{255}\right)^{\gamma-1}(d_{max}(I) - d_{min}(I)) \qquad \text{[Formula 21]}$$

Alternatively, a gray-scale level-lightness gradient characteristic may be determined using the lightness defined in a uniform color space:

$$g'_{L^*}(x, I) = \frac{d}{dx}g'_{L^*}(x, I) = \frac{\gamma}{3}\cdot\frac{1}{255}\left(\frac{x}{255}\right)^{\frac{\gamma}{3}-1}(d_{max}(I) - d_{min}(I)) \qquad \text{[Formula 22]}$$

Each of "g'(x, I)" and "$g_{L^*}$'(x, I)" corresponds to a brightness gradient of when a gray-scale level x is displayed on the image displaying unit 16 at backlight luminance I.

Figure 11:
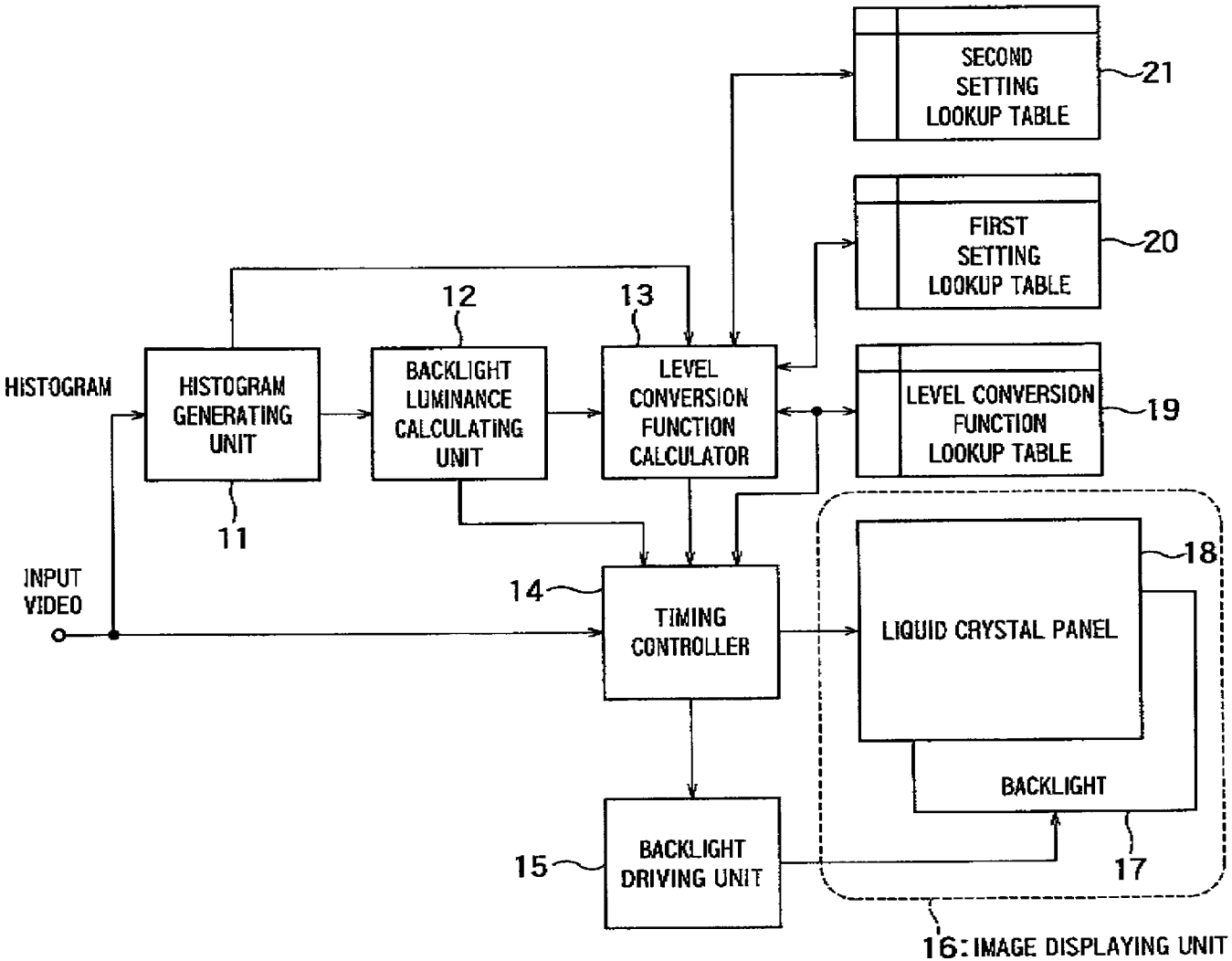
FIG. 11 shows a configuration in which the apparatus of FIG. 1 is provided with a second setting lookup table.

While the gray-scale level-brightness and gray-scale level-brightness gradient characteristics of the image displaying unit 16 may be calculated using Formulas 18 to 22, they can also be determined in the following manner. By way of example, after defining "$D_{min}(I)$" and "$D_{max}(I)$", lookup table data that maps gray-scale level x and backlight luminance I to brightness g(x, I) is created based on the relationship of the gray-scale level x and backlight luminance I to brightness g(x, I). Similarly, from the relationship of the gray-scale x and backlight luminance I to brightness gradient g'(x, I), a lookup table that maps the gray-scale level x and backlight luminance I to brightness gradient g'(x, I) is created. An example of table data on gray-scale level-brightness characteristics (data in a third table) is shown in FIG. 9, and an example of table data on gray-scale level-brightness gradient characteristics (data in a fourth table) is shown in FIG. 10. The table data of FIG. 9 maintains mappings between gray-scale levels and brightness based on data on backlight luminance from 0.1 to 1.0 in increments of 0.1, and FIG. 10 shows an example of table data that maintains mappings between gray-scale levels and brightness gradients based on data on backlight luminance from 0.1 to 1.0 in increments of 0.1. The created table data is then maintained as a second setting lookup table 21 on ROM or the like that is accessible to the level conversion function calculator 13 as shown in FIG. 11. To determine the brightness of a gray-scale level, a brightness corresponding to a gray-scale level x at backlight luminance I is determined by making reference to the ROM by gray-scale level x and backlight luminance I. Similarly, to determine the brightness gradient of a gray-scale level, a brightness gradient corresponding to a gray-scale level x with backlight luminance I is determined by making reference to the ROM by gray-scale level x and backlight luminance I. In addition, while the tables of FIGS. 9 and 10 maintain gray-scale level-brightness and gray-scale level-brightness gradient characteristics for each value of backlight luminance I, as another configuration, only gray-scale level-brightness and gray-scale level-brightness gradient characteristics for backlight luminance $I_{max}$ (=1.0) are maintained as shown in FIGS. 12 and 13, and for other backlight luminance, proportional calculation may be performed with respect to the brightness corresponding to backlight luminance $I_{max}$.

The setting steps 1 and 2 need not be performed for every frame of an input video: they have to be done once at the beginning (e.g., on power-up of the image display apparatus). In addition, when gray-scale level-brightness and gray-scale level-brightness gradient characteristics are maintained as lookup table data in advance, the setting steps 1 and 2 may be omitted.

At initialization step 1 (S13), variables to be used in subsequent processing are initialized. For example, processing like Formula 23 is performed:

$$x \leftarrow 0$$

$$E_{min} \leftarrow \text{MAX_VAL}$$

$$i \leftarrow 0$$

$$i_{out} \leftarrow i \qquad \text{[Formula 23]}$$

where "$E_{min}$" represents the minimum evaluation value which will be used at level conversion function updating step (S16) to be discussed later, and "i" represents a level conversion function selection number for selecting from multiple level conversion functions $f_i(x)$ which are set for gray-scale level x, which will be discussed below. "$I_{out}$" is a finally determined number for selecting an output level conversion function. The symbol "←" means that the value on the right side is substituted into the left side. "MAX_VAL" is the maximum value that can be assumed by an evaluation value E (a third evaluation value), which will be discussed later.

Figure 14:
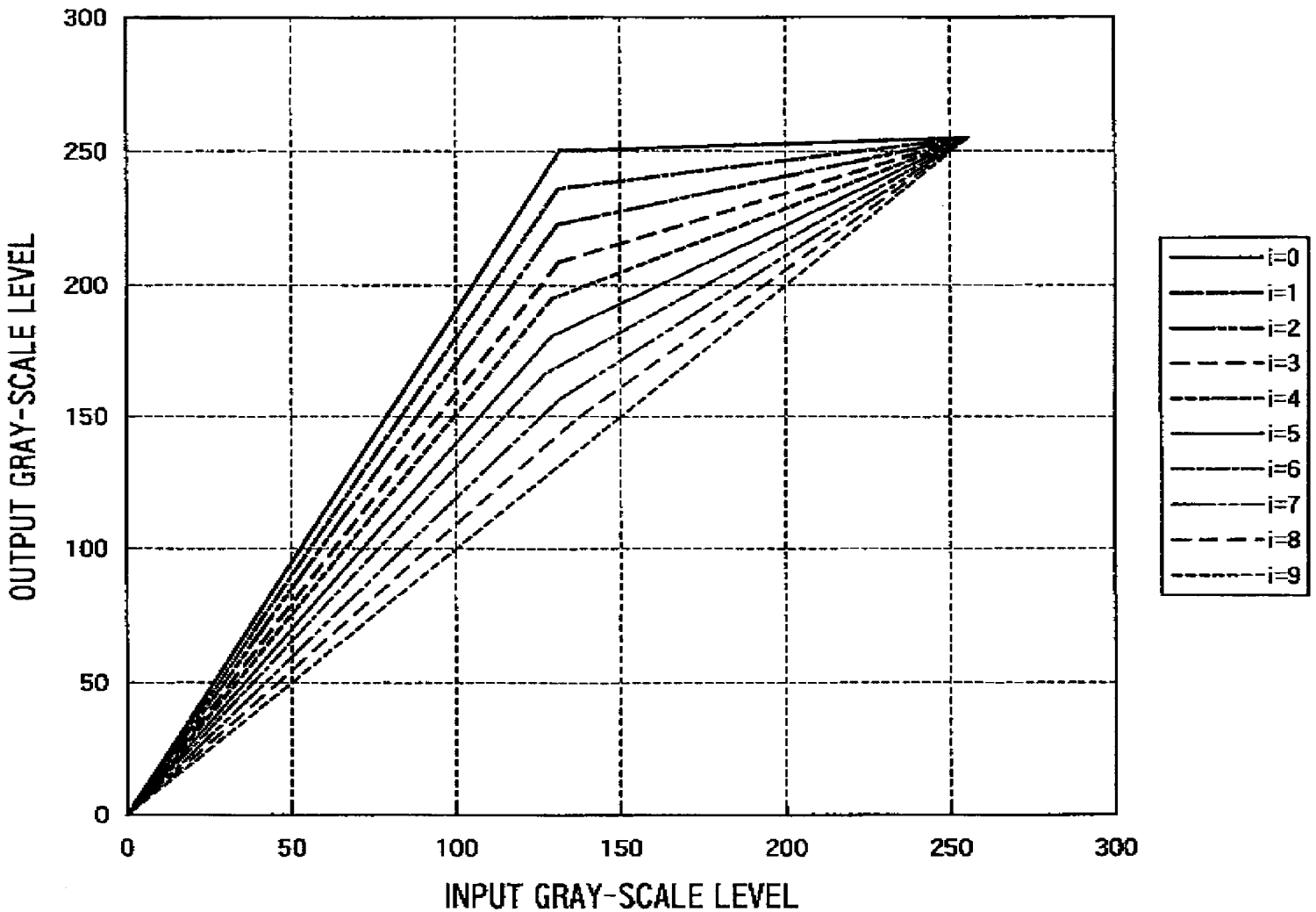
FIG. 14 shows ten level conversion functions prepared.

As the level conversion function $f_i(x)$, ten level conversion functions shown in FIG. 14 are set in this embodiment. The lateral axis of FIG. 14 represents an input gray-scale level x and the longitudinal axis represents an output gray-scale level $f_i(x)$. In addition to a configuration not dependent on the backlight luminance I shown in FIG. 14, multiple level conversion functions that vary from a value of backlight luminance I to another may be set as the level conversion function. In the latter case, the level conversion function is represented in the form of a function between a gray-scale level x and backlight luminance I, e.g., "$f_i(x, I)$". The level conversion function may also be determined by maintaining a coefficient of the level conversion function for each level conversion function selection number or may be determined inside the level conversion function calculator 13 by calculation. However, this embodiment maintains the level conversion functions shown in FIG. 14 as table data in the level conversion function lookup table 19, which may be ROM or the like, so that the level conversion function is determined by referencing the level conversion function lookup table 19 by level conversion function selection number. An example of the level conversion function lookup table 19 is shown in FIG. 15. The example of FIG. 15 maintains output gray-scale levels corresponding to input gray-scale levels which increment by one level. However, to reduce the amount of data maintained in the lookup table, output gray-scale levels corresponding to input gray-scale levels that are in blocks of multiple levels (e.g., 32 levels) may be maintained and an output gray-scale level corresponding to an input gray-scale level not maintained in the table data can be determined by appropriate interpolation, such as linear interpolation generally used. At evaluation value updating step (S15) to be discussed later, the level conversion function lookup table 19 is referenced by gray-scale level x and level conversion function selection number "i" to determine an output gray-scale level $f_i(x)$.

At initializing step 2 (S14), a first evaluation value $E_1$ and a second evaluation value $E_2$ which will be used at the evaluation value updating step (S15) to be discussed later are initialized as shown in Formula 24:

$$E_1 \leftarrow 0$$

$$E_2 \leftarrow 0 \qquad \text{[Formula 24]}$$

In evaluation value updating step (S15), the first and second evaluation values $E_1$ and $E_2$ are calculated at first evaluation value updating step (S17) and second evaluation value updating step (S18).

Figure 16:
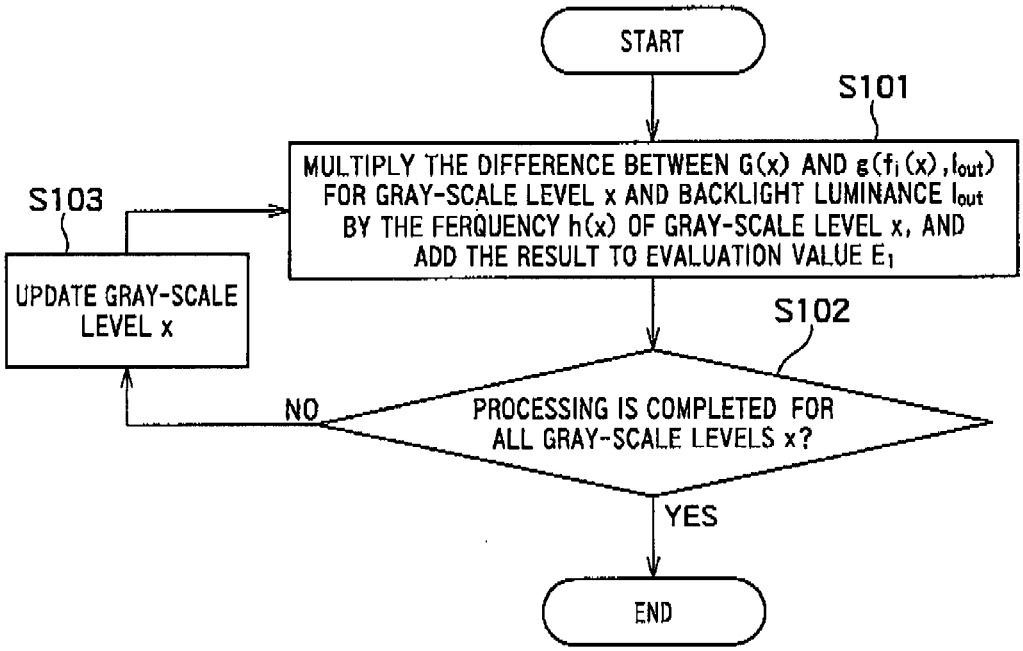
FIG. 16 is a flowchart illustrating the operation at a first evaluation value calculating step.

Operation at the first evaluation value calculating step (S17) will be described using the flowchart shown in FIG. 16. At step S101, a brightness G(x) in the maximum dynamic range for the current gray-scale level x is first determined. Then, using the level conversion function indicated by the level conversion function selection number i, the output gray-scale level $f_i(x)$ corresponding to gray-scale level x is determined. Next, a brightness $g(f_i(x), I_{out})$ on the image displaying unit 16 corresponding to the output gray-scale level $f_i(x)$ for the backlight luminance $I_{out}$ calculated by the backlight luminance calculating unit 12 is determined. Then, the difference between G(x) and $g(f_i(x), I_{out})$ is calculated. Next, the difference is multiplied by frequency h(x) of gray-scale level x which is determined by the histogram generating unit 11 and the result thereof is added to the evaluation value $E_1$. For example, when the difference is evaluated as an absolute value, it is represented as Formula 25:

$$E_1 \leftarrow E_1 + |G(x) - g(f_i(x), I_{out})| h(x) \qquad \text{[Formula 25]}$$

When the difference is evaluated as a square error, it is represented as Formula 26:

$$E_1 \leftarrow E_1 + \{G(x) - g(f_i(x), I_{out})\}^2 h(x) \qquad \text{[Formula 26]}$$

The evaluation performed in Formulas 25 and 26 using the gray-scale level-luminance characteristic may be done with the gray-scale level-brightness characteristics which were set at the setting step 1 (S11) and setting step 2 (S12). For example, when the difference is evaluated as a square error using gray-scale level-lightness characteristic, it is expressed as Formula 27:

$$E_1 \leftarrow E_1 + \{G_{L*}(x) - g_{L*}(f_1(x), I_{out})\}^2 h(x) \qquad \text{[Formula 27]}$$

It is also possible at the first evaluation value calculating step (S17) to add a weight to "h(x)" determined by the histogram generating unit 11. For instance, Formula 25, which is an updating expression at the first evaluation value calculating step, can be modified as Formula 28:

$$E_1 \leftarrow E_1 + |G(x) - g(f_i(x), I_{out})| h(x)^{\alpha} \qquad \text{[Formula 28]}$$

where "α" is a weight given to frequency h(x) of gray-scale level x as an exponent. While various values can be assumed by "α", it has been empirically recognized that it is set to a value larger than 0 and equal to or smaller than 1.

After calculating the first evaluation value for the current gray-scale level x, it is determined whether calculation of the first evaluation value has been completed for all of gray-scale levels x (S102). If not (NO), gray-scale level x is updated (S103), and the first evaluation value is calculated again (S101). For example, if the histogram generated by the histogram generating unit 11 determines the frequencies of 0 to 255 gray-scale levels in increments of one level, it is first determined whether gray-scale level x is 255 or greater, and if it is smaller than 255, gray-scale level x is incremented by one to be updated.

Figure 17:
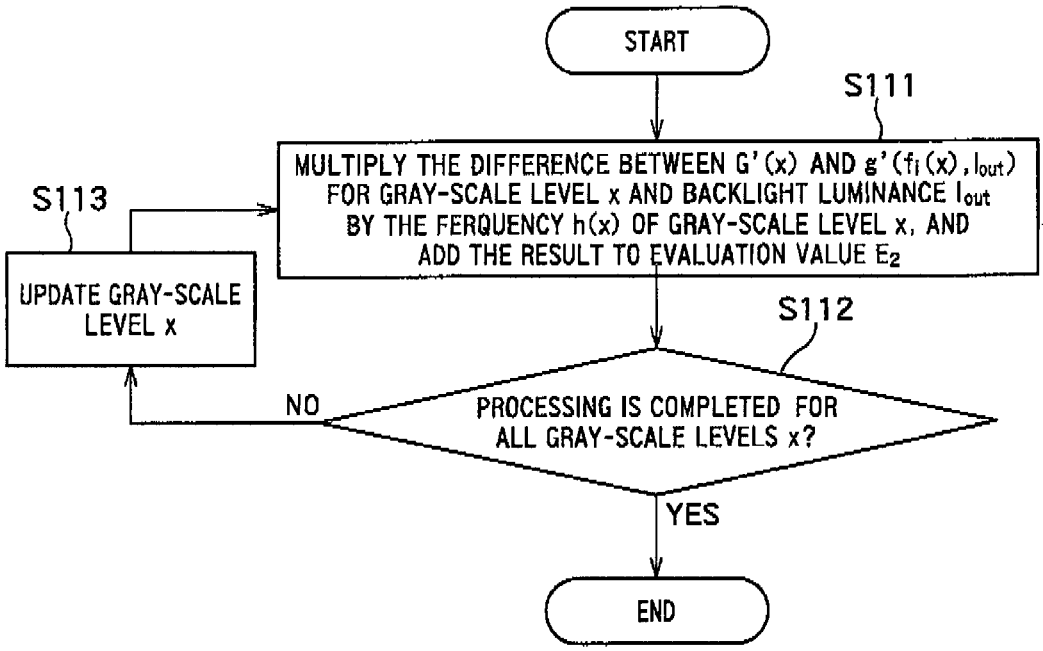
FIG. 17 is a flowchart illustrating the operation at a second evaluation value calculating step.

Now, operation at the second evaluation value calculating step (S18) will be described using the flowchart shown in FIG. 17. At step 111, a brightness gradient G'(x) in the maximum dynamic range for the current gray-scale level x is first determined. Next, using the level conversion function indicated by the level conversion function selection number i, an output gray-scale level $f_i(x)$ corresponding to the current gray-scale level x is determined. Next, for the gray-scale level x, the brightness gradient $g'(f_i(x), I_{out})$ of the image displaying unit 16 corresponding to output gray-scale level $f_i(x)$ with the backlight luminance $I_{out}$ calculated by the backlight luminance calculating unit 12 is determined. Next, the difference between G'(x) and $g'(f_i(x), I_{out})$ is calculated. Next, the difference is multiplied by frequency h(x) of gray-scale level x which is determined by the histogram generating unit 11 and the result thereof is added to the second evaluation value $E_2$. For example, when the difference is evaluated in an absolute value, it is represented as Formula 29:

$$E_2 \leftarrow E_2 + |G'(x) - g'(f_i(x), I_{out})| h(x) \quad \text{[Formula 29]}$$

When the difference is evaluated as a square error, it is represented as Formula 30:

$$E_2 \leftarrow E_2 + \{G'(x) - g'(f_i(x), I_{out})\}^2 h(x) \quad \text{[Formula 30]}$$

The evaluation performed in Formulas 29 and 30 using the gray-scale level-luminance gradient characteristic may be done with the gray-scale level-brightness gradient characteristics which were set at the setting step 1 (S11) and setting step 2 (S12). For example, when the difference is evaluated as a square error using gray-scale level-lightness gradient characteristic, it is represented as Formula 31:

$$E_2 \leftarrow E_2 + \{G_{L^*}'(x) - g_{L^*}'(f_i(x) I_{out})\}^2 h(x) \quad \text{[Formula 31]}$$

It is also possible to add a weight to h(x) determined by the histogram generating unit 11. For example, the updating formula (Formula 29) can be modified as Formula 32:

$$E_2 \leftarrow E_2 + |G'(x) - g'(f_i(x), I_{out})| h(x)^{\beta} \quad \text{[Formula 32]}$$

where "β" is a weight given to frequency h(x) of gray-scale level x as an exponent. While various values can be assumed by "β", it has been empirically recognized that it is set to a value larger than 0 and equal to or smaller than 1.

Furthermore, although the first and second evaluation value calculating steps (S17 and S18) use the same frequency h(x) in the above description, they may use difference frequencies. For example, the histogram generating unit 11 may generate two types of histograms including a histogram $h_1(x)$ which uses the largest gray-scale level among those of the three channels, red, green and blue, in each pixel, and a histogram $h_2(x)$ which is generated without distinguishing the gray-scale levels of three channels, red, green and blue, in each pixel. The two histograms may then be used at the first and second evaluation value calculating steps (S17 and S18), respectively. In this case, Formula 28 which is an updating formula used at the first evaluation value calculating step (S17) and Formula 32 which is an updating formula used at the second evaluation value calculating step (S18) are expressed as below, respectively:

$$E_1 \leftarrow E_1 + |G(x) - g(f_i(x), I_{out})| h_1(x)^{\alpha} \quad \text{[Formula 33]}$$

$$E_2 \leftarrow E_2 + |G'(x) - g'(f_i(x), I_{out})| h_2(x)^{\beta} \quad \text{[Formula 34]}$$

After calculating the second evaluation value for the current gray-scale level x, it is determined whether calculation of the second evaluation value has been completed for all of gray-scale levels x (S112). If not (NO), gray-scale level x is updated (S113), and the second evaluation value is calculated again (S111). For example, if the histogram generated by the histogram generating unit 11 determines the frequencies of 0 to 255 gray-scale levels in increments of one level, it is first determined whether gray-scale level x is 255 or greater, and if it is smaller than 255, gray-scale level x is incremented by one to be updated.

After the first and second evaluation values $E_1$ and $E_2$ are calculated, an evaluation values E (a third evaluation value) is calculated by weighted linear sum, as shown in Formula 35, with respect to the first and second evaluation values $E_1$ and $E_2$ (S19):

$$E \leftarrow \lambda E_1 + (1-\lambda) E_2 \quad \text{[Formula 35]}$$

where "λ" represents a weight to the first and second evaluation values $E_1$ and $E_2$, a value in a range from 0 to 1.

At level conversion function updating step (S16), it is determined whether the evaluation value E (the third evaluation value) determined at evaluation value updating step (S15) with the level conversion function fi(x) indicated by the current level conversion function selection number "i" is minimum (S20). If it is minimum (YES), the current level conversion function selection number "i" is set as output level conversion function selection number $i_{out}$, and the minimum evaluation value $E_{min}$ is updated to the current evaluation value E (S21). Next, it is determined whether evaluation is completed for level conversion functions corresponding to all of level conversion function selection numbers that were preset (S22). If not completed (NO), the level conversion function selection number "i" is updated (i is incremented by one) (S23). If completed (YES), the output level conversion function selection number $i_{out}$ at the time is output from the level conversion function calculator 13.

Here, the first and second evaluation values $E_1$ and $E_2$ as well as evaluation value E (the third evaluation value) are described. The first evaluation value $E_1$ represents the level of closeness between a brightness that is desired for display on the image displaying unit 16 and the actual brightness of image display obtained with backlight luminance I and level conversion function $f_i(x)$. That is, the smaller the first evaluation value E1 is, the closer the brightness desired on the image displaying unit 16 is to the actual brightness of the image displaying unit 16. Meanwhile, the second evaluation value $E_2$ represents the level of closeness between a brightness gradient that is desired for display on the image displaying unit 16 and the actual brightness gradient of the image displaying unit 16 obtained with backlight luminance I and level conversion function $f_i(x)$. That is to say, the smaller the second evaluation value $E_2$ is, the closer the brightness gradient (i.e., the difference between neighboring gray-scale levels or contrast) is to the actual brightness gradient (i.e., the difference between neighboring gray-scale levels or contrast) of the image displaying unit 16. The evaluation value E is the weighted linear sum of the first and the second evaluation values, a value calculated in consideration of the balance between the two evaluation values. That is, as the evaluation value E becomes smaller, it implies that the first and second evaluation values become smaller with a certain balance, indicating that both the brightness and brightness gradient that are required on the image displaying unit 16 are closer to the actual brightness and brightness gradient of the image displaying unit 16.

(The Timing Controller 14)

The timing controller 14 applies the level conversion function decided by the level conversion function calculator 13 to an input video signal to generate a converted video signal and also generates a backlight luminance signal based on the backlight luminance calculated by the backlight luminance calculating unit 12. The timing controller 14 then sends the converted video signal to the liquid crystal panel 18 and the backlight luminance signal to the backlight driving unit 15 while controlling the timing of sending the two signals.

First, the way of converting a gray-scale level is described. This embodiment performs gray-scale level conversion by referencing the level conversion function lookup table 19 by the output level conversion function selection number "$i_{out}$" which is calculated by the level conversion function calculator 13 and applying an appropriate level conversion function $f_{iout}(x)$ to an input video. That is, to an input gray-scale level L(u, v) of an input video at a horizontal pixel position "u" and a vertical pixel position "v", processing by Formula 36 is performed:

$$L_{out}(u,v)=f_{i_{out}}(L(u,v)) \quad \text{[Formula 36]}$$

where "$L_{out}$ (u, v)" represents the converted gray-scale level of a pixel of the input video positioned at (u, v). By applying the processing of Formula 36 to all pixels contained in one frame of the input video, the input video is converted.

Timing control is now described. Since the histogram generating unit 11 generates a histogram by scanning all the pixels in one frame of the input video as its basic operation, the time at which a video is input to the timing controller 14 differ by one frame or longer from the time at which a backlight luminance calculated by the backlight luminance calculating unit 12 using the histogram of that video is input to the timing controller 14. Accordingly, to adjust the timing delay, the timing controller 14 delays the output timing of the input video using a frame buffer, for example, to synchronize it with the output of a backlight luminance signal. Also, the above-mentioned configuration synchronizes the output timing of one frame of the input video with the output timing of a backlight luminance calculated from that frame. However, since an input video is typically temporally continuous for some extent, a backlight luminance determined from an input video at the nth frame can be synchronized with the input video at the n+1th frame. In other words, the backlight luminance is delayed by one frame period with respect to the video actually shown on the image displaying unit 16. In this case, the frame buffer (or memory size) can be made small because the input video need not be significantly delayed in the timing controller 14. The timing controller 14 also generates various synchronization signals necessary for driving the liquid crystal panel 18 (horizontal and vertical synchronization signals and so forth) and sends those signals to the liquid crystal panel 18 with a converted video which was converted with a level conversion function.

(The Backlight Driving Unit 15)

The backlight driving unit 15 generates a backlight driving signal for causing the backlight 17 to actually illuminate based on a backlight luminance signal output from the timing controller 14. The design of the backlight driving signal may vary depending on the type of the light source set in the backlight 17. The light source of the backlight 17 which is generally used for a liquid crystal display apparatus is a cold cathode ray tube or a light emitting diode (LED). Such devices allow modulation of luminance by control of voltage and/or current applied thereto. However, a general way of modulating light source luminance is Pulse Width Modulation (PWM) control, which modulates luminance by rapidly switching between an illuminating period and a non-illuminating period. This embodiment uses an LED light source which permits light emitting intensity to be controlled relatively easily as the light source of the backlight 17 and modulates the luminance of the LED light source by PWM control. Thus, the backlight driving unit 15 generates a PWM signal based on the backlight luminance signal and sends the control signal to the backlight 17.

(The Image Displaying Unit 16)

As mentioned above, the image displaying unit 16 is composed of the liquid crystal panel 18 as the light modulation device and the backlight 17 disposed on the back surface of the liquid crystal panel 18 that allows light source luminance to be modulated. The image displaying unit 16 writes the converted video signal output from the timing controller 14 to the liquid crystal panel (or light modulation element) 16. The image displaying unit 16 also displays an input video by illuminating the backlight 17 according to the backlight driving signal output from the backlight driving unit 15. As mentioned above, this embodiment uses an LED light source as the light source of the backlight 17.

As described above, according to this embodiment, an image display apparatus with excellent visual contrast and reduced power consumption can be provided.

Second Embodiment

The basic configuration of the image displaying apparatus as a second embodiment of the invention is similar to that of the first embodiment, but the backlight luminance calculating unit calculates backlight luminance in a different manner in the present embodiment. The first embodiment determines a representative value from a histogram generated by the histogram generating unit 11 and calculates a backlight luminance based on the representative value, whereas this embodiment is characterized by determining a backlight luminance more suitable for an input image by calculating the backlight luminance in consideration of histogram distribution.

Figure 18:
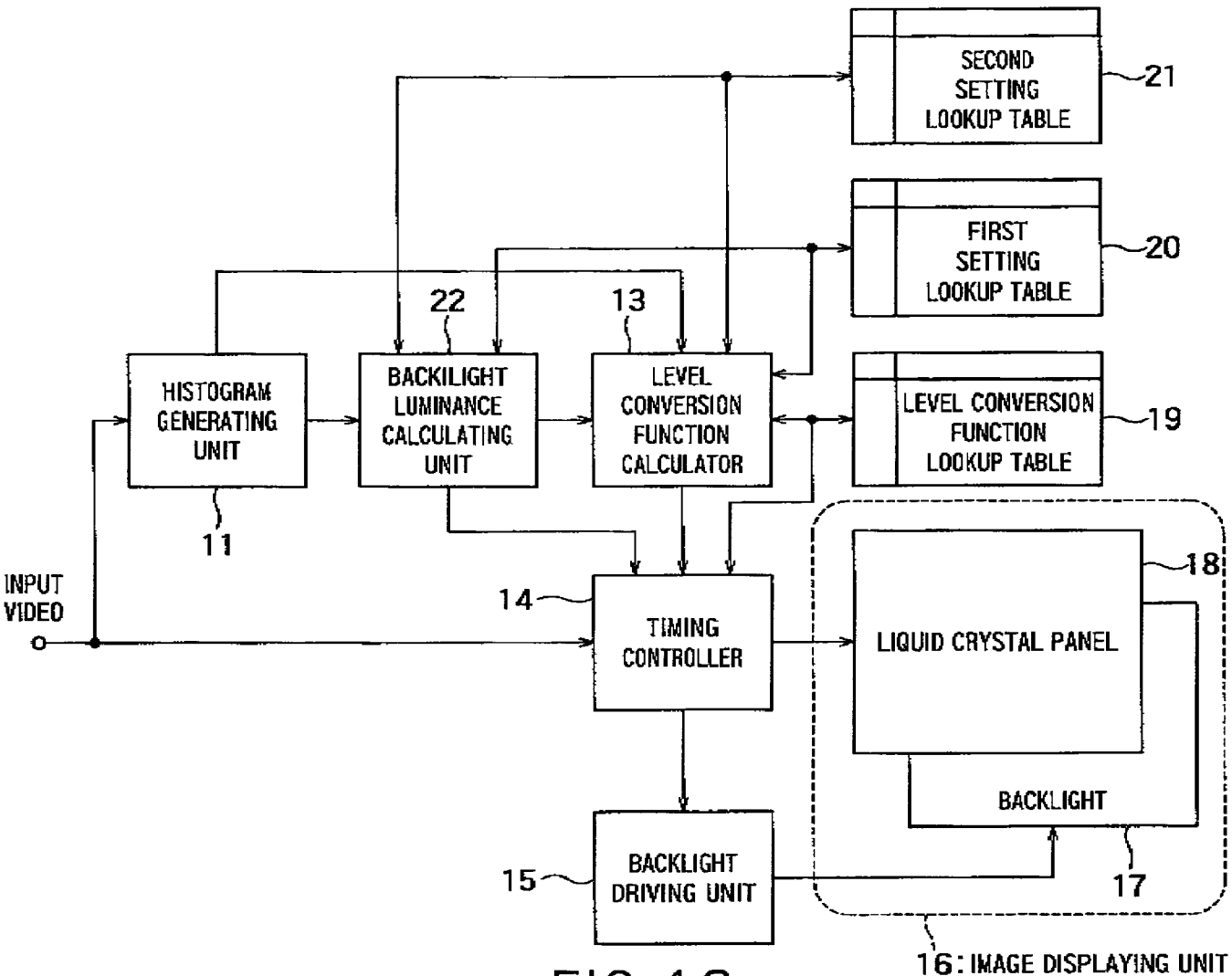
FIG. 18 shows the configuration of an image display apparatus according to a second embodiment of the present invention.

FIG. 18 shows the configuration of the image display apparatus according to the second embodiment of the present invention. The configuration of FIG. 18 is obtained by applying the configuration of the first embodiment shown in FIG. 11 to the second embodiment. The image display apparatus of the second embodiment is configured to enable the backlight luminance calculating unit 22 to reference the first and second setting lookup tables 20 and 21. The configuration of the backlight luminance calculating unit 22 that is different from the first embodiment will be described in detail below. As configurations of other components are similar to the first embodiment, description of them is omitted.

(The Backlight Luminance Calculating Unit 22)

Figure 19:
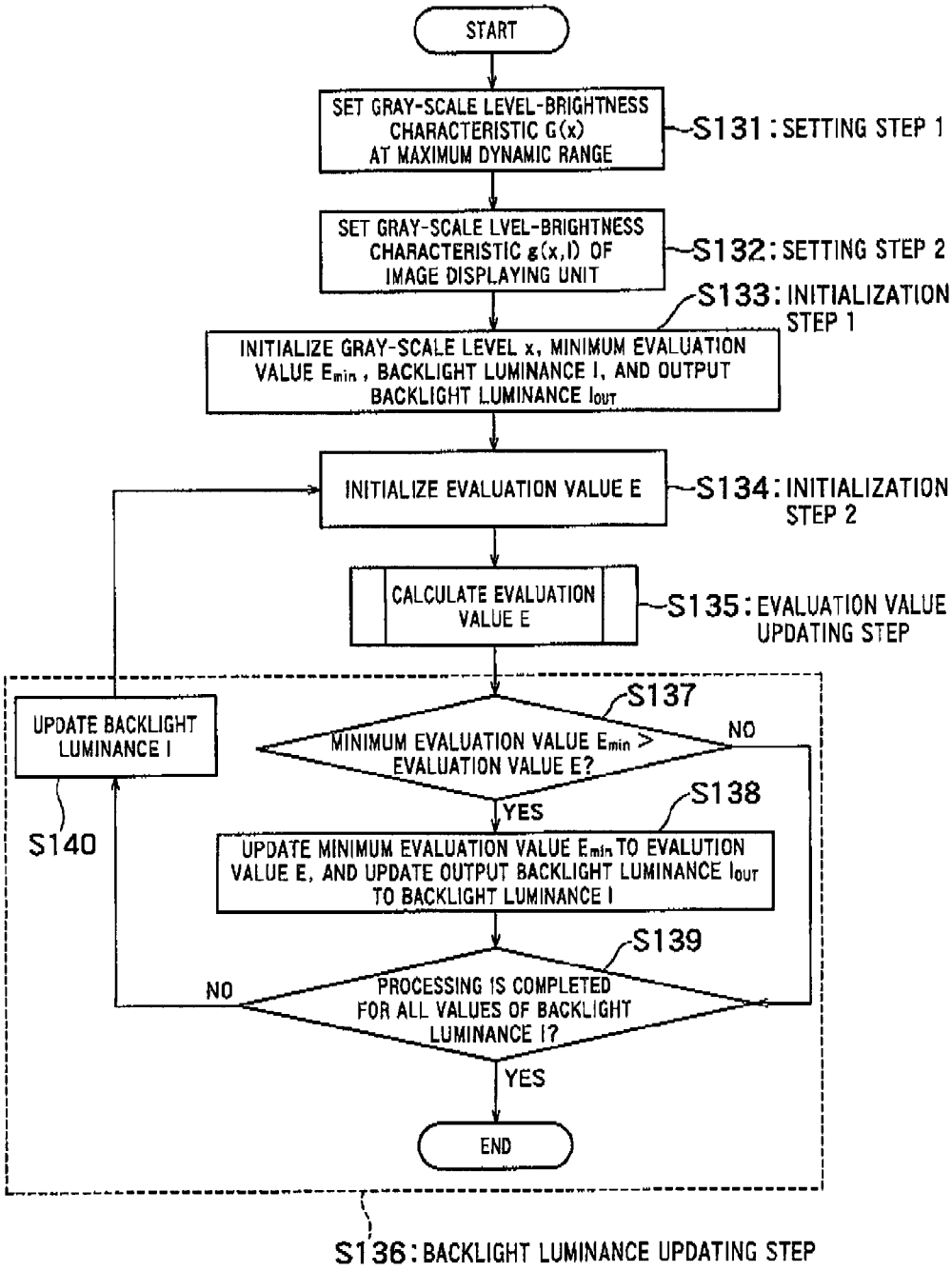
FIG. 19 is a flowchart illustrating the operation of a backlight luminance calculating unit.

The operation of the backlight luminance calculating unit 22 in the second embodiment will be described in detail with respect to the flowchart of FIG. 19.

At setting step 1 (S131), a gray-scale level-brightness characteristic in the maximum dynamic range is set in a similar way to Formulas 10 to 14 of the first embodiment. While the gray-scale level-brightness characteristic in the maximum dynamic range may be determined by calculation inside the backlight luminance calculating unit 22, this embodiment uses the first setting lookup table 20 which maps gray-scale levels x to brightness G(x) as in the first embodiment. To determine a brightness G(x) in the maximum dynamic range corresponding to a gray-scale level x at evaluation value updating step (S135), which will be described below, the first evaluation value lookup table 20 is referenced by gray-scale level x to determine the corresponding brightness G(x).

At setting step 2 (S132), the gray-scale level-brightness characteristic of the image displaying unit 16 with backlight luminance I is set as Formulas 17 to 20 of the first embodiment. While the gray-scale level-brightness characteristic of the image displaying unit 16 may be determined inside the backlight luminance calculating unit 22 by calculation, this embodiment uses the second setting lookup table 21 which maps gray-scale levels x at backlight luminance I to brightness g(x, I) of the image displaying unit 16 as in the first embodiment. To determine brightness g(x, I) of the image displaying unit 16 corresponding to a gray-scale level x with backlight luminance I at evaluation value updating step (S135), which will be described below, the second evaluation value lookup table 21 is referenced by backlight luminance I and gray-scale level x to determine the corresponding brightness g(x, I).

At initializing step 1 (S133), variables for use in subsequent processing are initialized. For example, processing like Formula 37 is performed.

$$x \leftarrow 0$$

$$E_{min} \leftarrow \text{MAX_VAL}$$

$$I \leftarrow I_{min}$$

$$I_{out} \leftarrow I \qquad \text{[Formula 37]}$$

where "$I_{min}$" represents the minimum value of a backlight luminance modulation range and "$I_{out}$" represents the finally determined output backlight luminance.

At initialization step 2 (S134), an evaluation value E (a fourth evaluation value) to be used at evaluation value updating step (S135), which will be discussed later, is initialized as shown in Formula 38.

$$E \leftarrow 0 \qquad \text{[Formula 38]}$$

Figure 20:
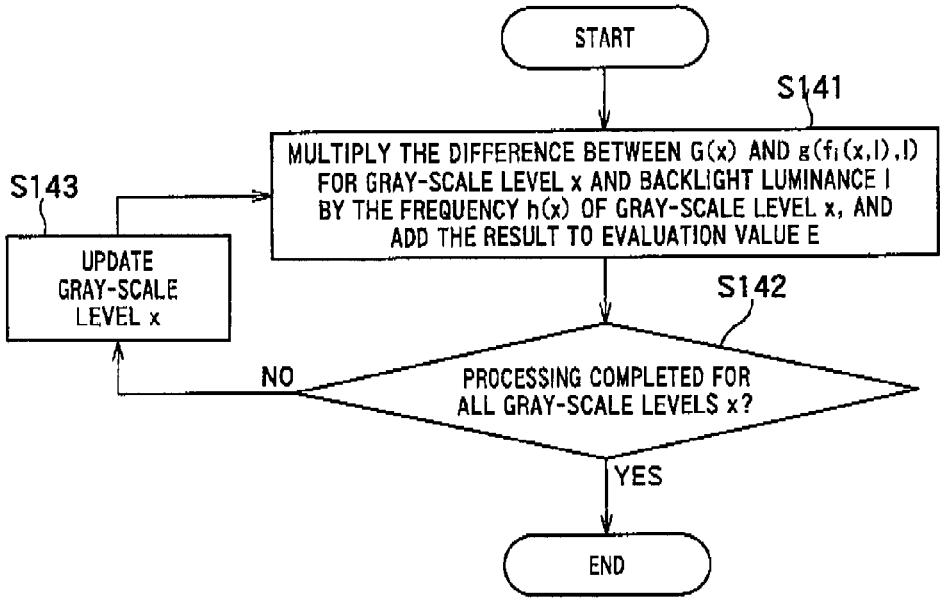
FIG. 20 is a flowchart illustrating the operation at an evaluation value updating step.

Operation at the evaluation value updating step (S135) will be described using the flowchart shown in FIG. 20. At step S141, a brightness G(X) for the current gray-scale level x in the maximum dynamic range is first determined. Next, using an initial level conversion function $f_c$ (x, I) which is predefined for each value of backlight luminance, an output gray-scale level $f_c$(x, I) corresponding to the gray-scale level x with the current backlight luminance I is determined. Next, the brightness g($f_c$(x, I), I) of the image displaying unit 16 corresponding to the output gray-scale level $f_c$(x, I) with the current backlight luminance I is determined. The difference between G(x) and g($f_c$(x, I), I) is calculated next. Then, the difference is multiplied by the frequency h(x) of the gray-scale level x determined by the histogram generating unit 11 and the result thereof. Is added to the evaluation value E. For example, when the difference is evaluated in an absolute value, it is represented as Formula 39:

$$E \leftarrow E + |G(x) - g(f_c(x,I),I)|h(x) \qquad \text{[Formula 39]}$$

When the difference is evaluated as a square error, it is represented as Formula 40:

$$E \leftarrow E + \{G(x) - g(f_c(x,I),I)\}^2 h(x) \qquad \text{[Formula 40]}$$

The evaluation performed in Formulas 39 and 40 using the gray-scale level-luminance characteristic may be done with the gray-scale level-brightness characteristics which were set at the setting step 1 (S131) and setting step 2 (S132). For example, when the difference is evaluated as a square error using a gray-scale level-lightness characteristic, it is represented as Formula 41:

$$E \leftarrow E + \{G_{L^*}(x) - g_{L^*}(f_c(x,I),I)\}^2 h(x) \qquad \text{[Formula 41]}$$

It is also possible to add a weight to h(x) determined by the histogram generating unit 11. For instance, the updating formula (Formula 39) can be modified as Formula 42:

$$E \leftarrow E + |G(x) - g(f_c(x,I),I)|h(x) \qquad \text{[Formula 42]}$$

where "X" is a weight given to frequency h(x) of gray-scale level x as an exponent. While various values can be assumed by "X", it has been empirically recognized that it is set to a value larger than 0 and equal to or smaller than 1.

Figure 21:
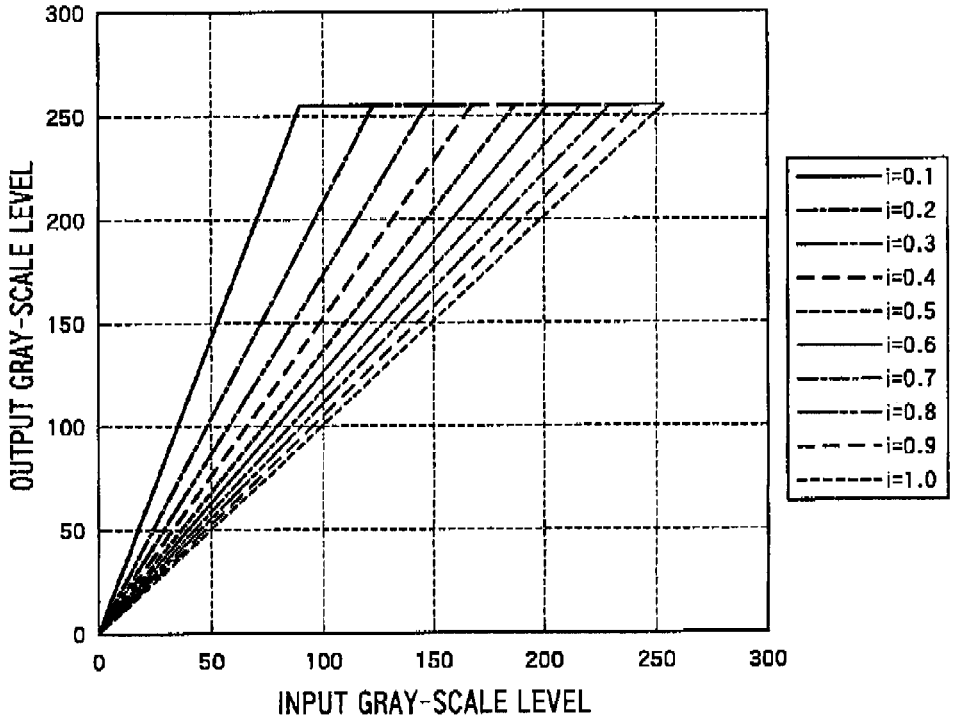
FIG. 21 shows an example of an initial level conversion function.
Figure 22:
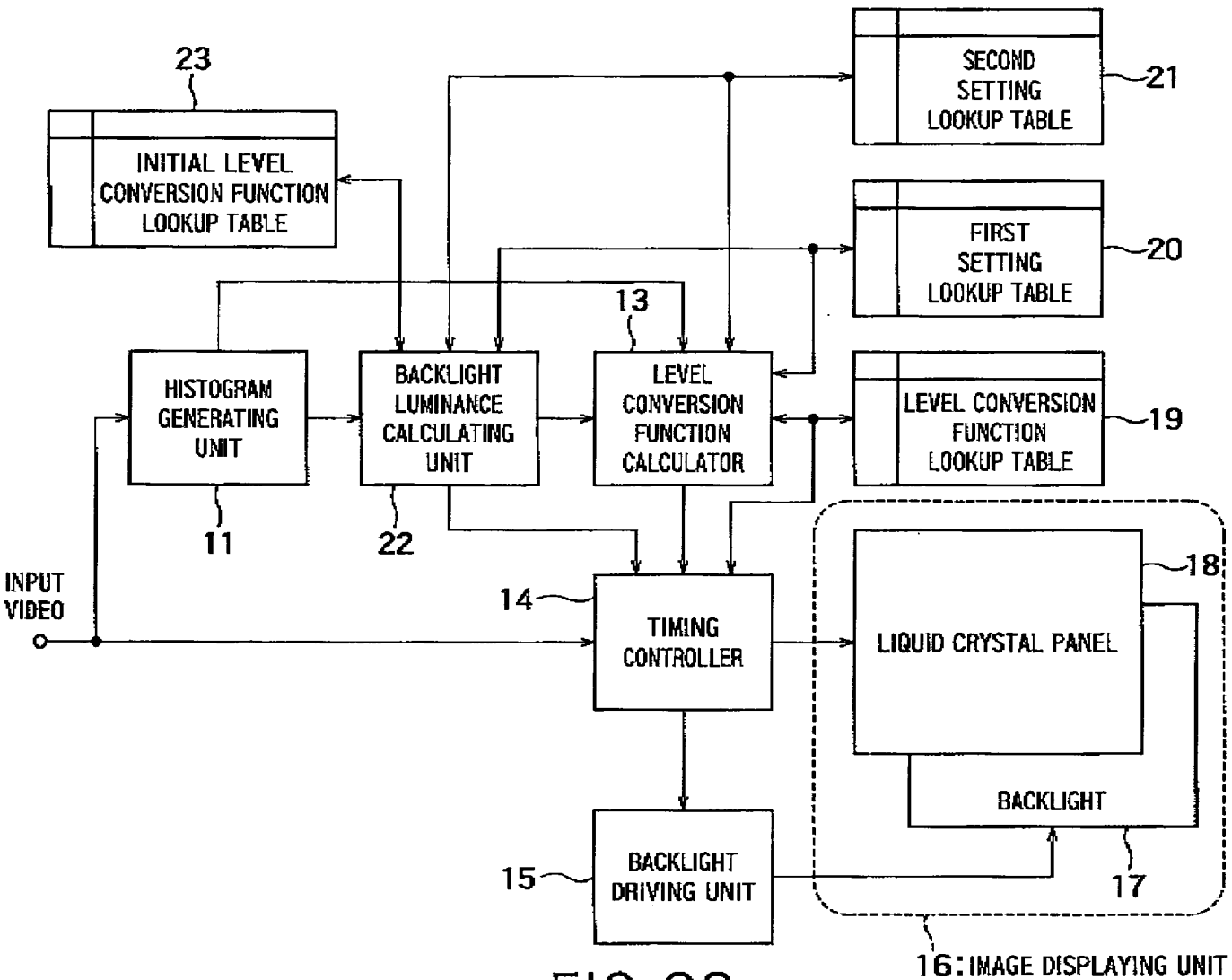
FIG. 22 shows a configuration in which the apparatus of FIG. 18 is provided with an initial level conversion function lookup table.

Now, the initial level conversion function $f_c$(x, I) (a second level conversion function) which is predefined for each value of backlight luminance will be described. The initial level conversion function $f_c$(x, I) can be set to various values, but it is desirably set such that an output gray-scale level corresponding to an input gray-scale level becomes larger as the backlight luminance I becomes smaller. This embodiment thus adopts the initial level conversion functions shown in FIG. 21. FIG. 21 shows correspondence between input gray-scale level x and output gray-scale level $f_c$(x, I) for data on backlight luminance I from 0.1 to 1.0 in increments of 0.1. The initial level conversion functions of FIG. 21 are maintained as an initial level conversion function lookup table 23 on ROM or the like that is accessible to the backlight luminance calculating unit 22, as shown in FIG. 22. To determine an output gray-scale level $f_c$(x, I) corresponding to an input gray-scale level x with backlight luminance I, the initial level conversion function lookup table 23 is referenced by gray-scale level x and backlight luminance I by the backlight luminance calculating unit 22 to determine the corresponding output gray-scale level $f_c$(x, I). The lookup table 23 corresponds to a second function storing unit for storing second level conversion functions prepared for each value of backlight luminance (or light source luminance), for instance. While the lookup table 23 is referenced to determine the initial level conversion function in the above description, as another configuration, the initial level conversion function may also be set by calculation inside the backlight luminance calculating unit 22. For instance, an initial level conversion function $f_c$(x, I) can be used that makes gray-scale level-luminance characteristic G(x) in the maximum dynamic range be equal to the actual gray-scale level-luminance characteristic g($f_c$(x, I), I) of the image displaying unit 16. In that case, the initial level conversion function $f_c$(x, I) is expressed as Formula 43:

$$f_c(x, I) = \begin{cases} 0 & G(x) < d_{min}(I) \\ 255 & G(x) > d_{max}(I) \\ \left(\dfrac{G(x) - d_{min}(I)}{d_{max}(I) - d_{min}(I)}\right)^{\frac{1}{\gamma}} \times 255 & \text{otherwise} \end{cases} \qquad \text{[Formula 43]}$$

The case specification of Formula 43 is a saturating process for fitting the output gray-scale level $f_c$(x, I) corresponding to input gray-scale level x with backlight luminance I into an 8-bit value range from 0 to 255.

Then, after calculating the evaluation value E for the current gray-scale level x, it is determined whether calculation of the evaluation value is completed for all of gray-scale levels x (S142). If not (NO), the gray-scale level x is updated (S143), and an evaluation value is calculated again (S141). For example, if the histogram generated by the histogram generating unit 11 determines the frequencies of 0 to 255 gray-scale levels in increments of one level, it is first determined whether the gray-scale level x is 255 or greater, and if it is smaller than 255, the gray-scale level x is incremented by one to be updated.

At backlight luminance updating step (S136), it is determined whether the evaluation value E determined at the evaluation value updating step (S135) with the current backlight luminance I is smallest (S137). If it is smallest (YES), the current backlight luminance I is set as output backlight luminance $I_{out}$ and the smallest evaluation value $E_{min}$ is updated to the current evaluation value E (S138). Next, it is determined whether evaluation is completed for all values of backlight luminance I that were preset (S139). If not (NO), backlight luminance I is updated (S140) and the flow returns to the initialization step 2 (S134) again. For example, when the modulation range of backlight luminance I is from "$I_{min}$" to "$I_{max}$" in increments of 0.1, 0.1 is added to backlight luminance I to update backlight luminance I if the current backlight luminance I is smaller than "$I_{max}$". If evaluation is completed for all values of predefined backlight luminance I, the output backlight luminance $I_{out}$ at the time is output from the backlight luminance calculating unit 22.

As described above, this embodiment can provide an image display apparatus with excellent visual contrast and reduced power consumption because it is capable of calculating backlight luminance in consideration of histogram distribution.

Third Embodiment

The basic configuration of an image display apparatus according to a third embodiment of the present invention is similar to that of the first embodiment, but the level conversion function calculator of this embodiment calculates the output level conversion function in a different way. The first embodiment makes reference to level conversion functions maintained in advance in a level conversion function lookup table to decide an output level conversion function, whereas this embodiment determines the level conversion function by calculation inside the level conversion function calculator.

Figure 23:
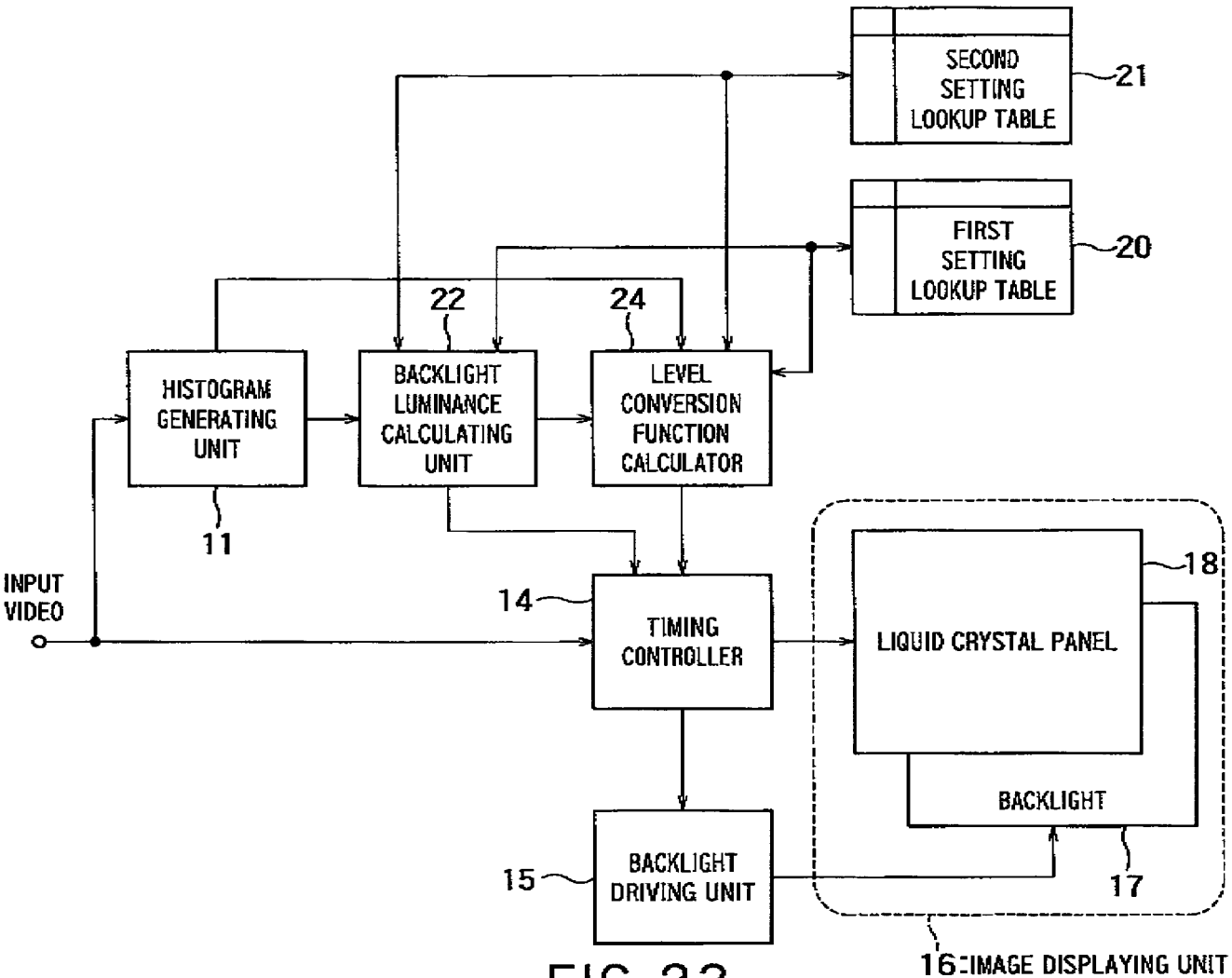
FIG. 23 shows the configuration of an image display apparatus according to a third embodiment of the present invention.

FIG. 23 shows the configuration of the image display apparatus according to the third embodiment of the invention. The configuration of FIG. 23 is obtained by applying the first embodiment configuration shown in FIG. 11 to the third embodiment. Since the image display apparatus of the third embodiment is configured to determine the output level conversion function inside the level conversion function calculator 24, it does not require a level conversion function lookup table. The configuration of the level conversion function calculator 24 that is different from that of the first embodiment will be described in detail below. As configurations of other components are similar to the first embodiment, description of them is omitted.

(The Level Conversion Function Calculator 24)

Figure 24:
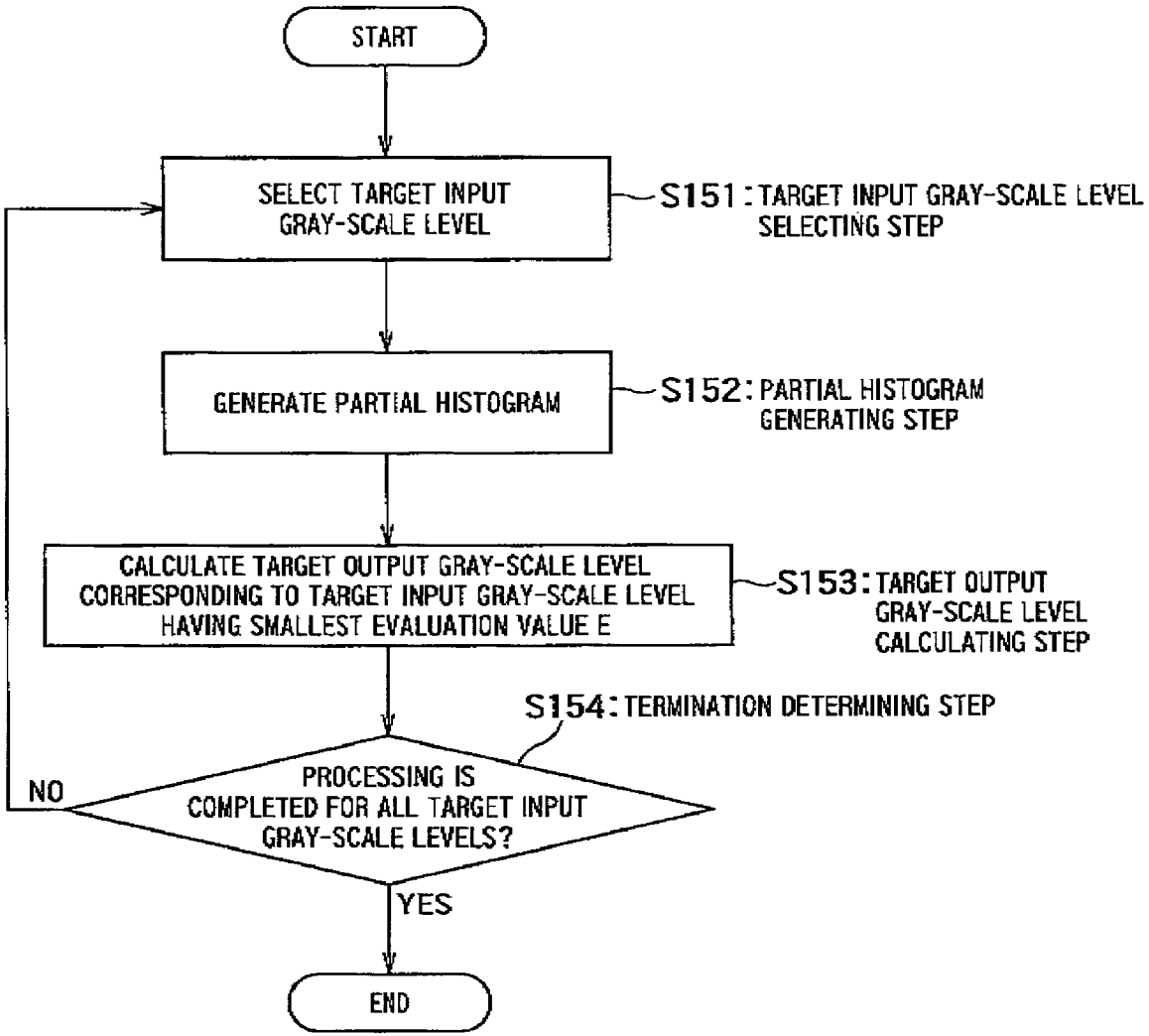
FIG. 24 is a flowchart illustrating the operation of the level conversion function calculator in the third embodiment.
Figure 26:
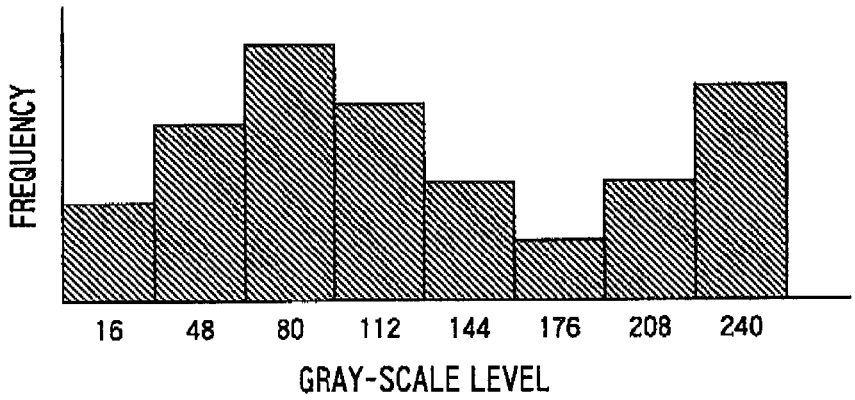
FIG. 26 shows an example of a histogram that shows frequencies of every 32 gray-scale levels.

The operation of the level conversion function calculator 24 in the third embodiment will be described in detail using the flowchart shown in FIG. 24. For the sake of simplicity, it is assumed that a histogram generated by the histogram generating unit 11 shows frequency on a 32-level basis as shown in FIG. 26 and a level conversion function is determined by identifying correspondence of an output gray-scale level to an input gray-scale level, which is a 32-level block, and an intermediate (in-between) input gray-scale level is determined by linear interpolation.

At target input gray-scale level selecting step (S151), one input gray-scale level that will be thereafter processed is selected from a plurality of input gray-scale levels for a level conversion function. In the subsequent processing, an output gray-scale level that corresponds to the selected input gray-scale level is calculated. While the target input gray-scale level can be selected in various ways, this embodiment selects it in the following manner. First, as shown by the black circles in FIG. 25, an output gray-scale level corresponding to the 0 input gray-scale level is set as 0 gray-scale level and an output gray-scale level that corresponds to 255 input gray-scale level is set as 255 gray-scale level in a level conversion function. Then, as shown by the white circle in FIG. 25, 128 gray-scale level which is at the midpoint between 0 and 256 gray-scale levels is selected as the target input gray-scale level. Thereafter, as shown by the white circles in FIG. 28, 64 gray-scale level which is positioned at the midpoint between 0 and 128 gray-scale levels is selected, and 192 gray-scale level positioned at the midpoint between 128 and 255 gray-scale levels is further selected. Then, as shown by the white circles in FIG. 30, 32 gray-scale level which is positioned at the midpoint between 0 and 64 gray-scale level is selected, and in a similar way, 96 gray-scale level positioned at the midpoint between 64 and 128 gray-scale levels, 160 gray-scale level positioned at the midpoint between 128 and 192 gray-scale levels, and 224 gray-scale level positioned at the midpoint between 192 and 255 gray-scale levels are selected. As this embodiment determines the level conversion function as the relationship of an output gray-scale level to an input gray-scale level which is in increments of 32 levels, processing is terminated after selection has been made up to the above-described point. If the apparatus is configured to determine a level conversion function for each one gray-scale level, selection of midpoint levels can be further continued to select all levels from 0 to 255 gray-scale level in increments of one level.

Figure 25:
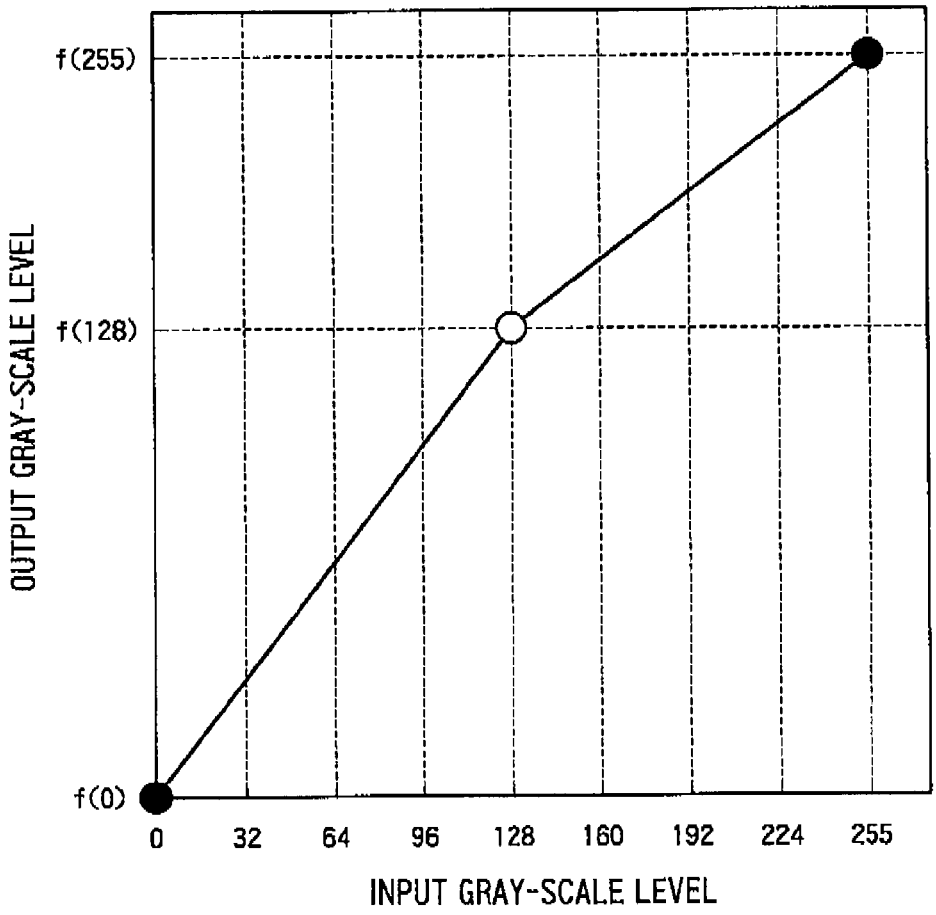
FIG. 25 shows a level conversion function halfway in generation.
Figure 27:
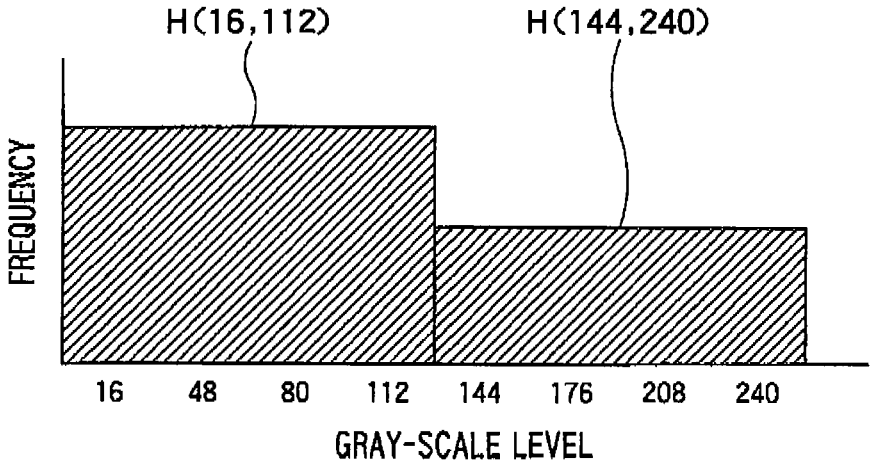
FIG. 27 shows an example of a partial histogram that has two bins.
Figure 29:
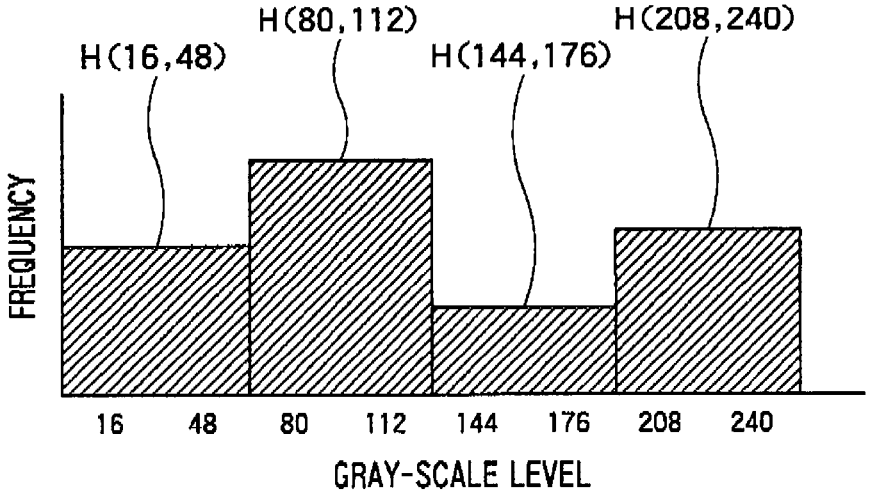
FIG. 29 shows another example of a partial histogram that has two bins.

At partial histogram generating step (S152), a partial histogram is generated based on the input gray-scale level which was selected at the target input gray-scale level selecting step (S151). When 128 gray-scale level is selected as the target input gray-scale level as shown in FIG. 25, a partial histogram having two bins respectively having a bin width from 0 to 127 gray-scale level and a bin width from 128 to 255 gray-scale level is generated as shown in FIG. 27 from the histogram determined by the histogram generating unit 11 shown in FIG. 26. That is, the partial histogram is expressed as Formulas 44 and 45:

$$H(0, 127) = \sum_{i=0}^{127} h(i) \quad \text{[Formula 44]}$$

$$H(128, 255) = \sum_{i=128}^{255} h(i) \quad \text{[Formula 45]}$$

where "$H(i_0, i_1)$" represents the total frequency of the gray-scale level $i_0$ to $i_1$ based on the frequency h(x) of gray-scale level x determined by the histogram generating unit 11. That is to say, when 128 gray-scale level is selected as the input gray-scale level, a partial histogram having two bins respectively representing the frequency belonging to between 0 and 127 gray-scale levels and the frequency belonging to between 128 to 255 gray-scale levels is generated. Similarly, when 64 gray-scale level is selected at the target input gray-scale level selecting step (S151), a partial histogram having two bins respectively representing the frequency belonging to between 0 and 63 gray-scale levels and that belonging to between 64 and 127 gray-scale levels is determined from the histogram generated by the histogram generating unit 11 as shown in FIG. 29. The histogram of this case is represented by Formulas 46 and 47;

$$H(0, 63) = \sum_{i=0}^{63} h(i) \quad \text{[Formula 46]}$$

$$H(64, 127) = \sum_{i=64}^{127} h(i) \quad \text{[Formula 47]}$$

Similarly, a partial histogram generated when 192 gray-scale level is selected at the target input gray-scale level selecting step (S151) is represented as Formulas 48 and 49:

$$H(128, 191) = \sum_{i=128}^{191} h(i) \quad \text{[Formula 48]}$$

$$H(192, 255) = \sum_{i=192}^{255} h(i) \quad \text{[Formula 49]}$$

Figure 30:
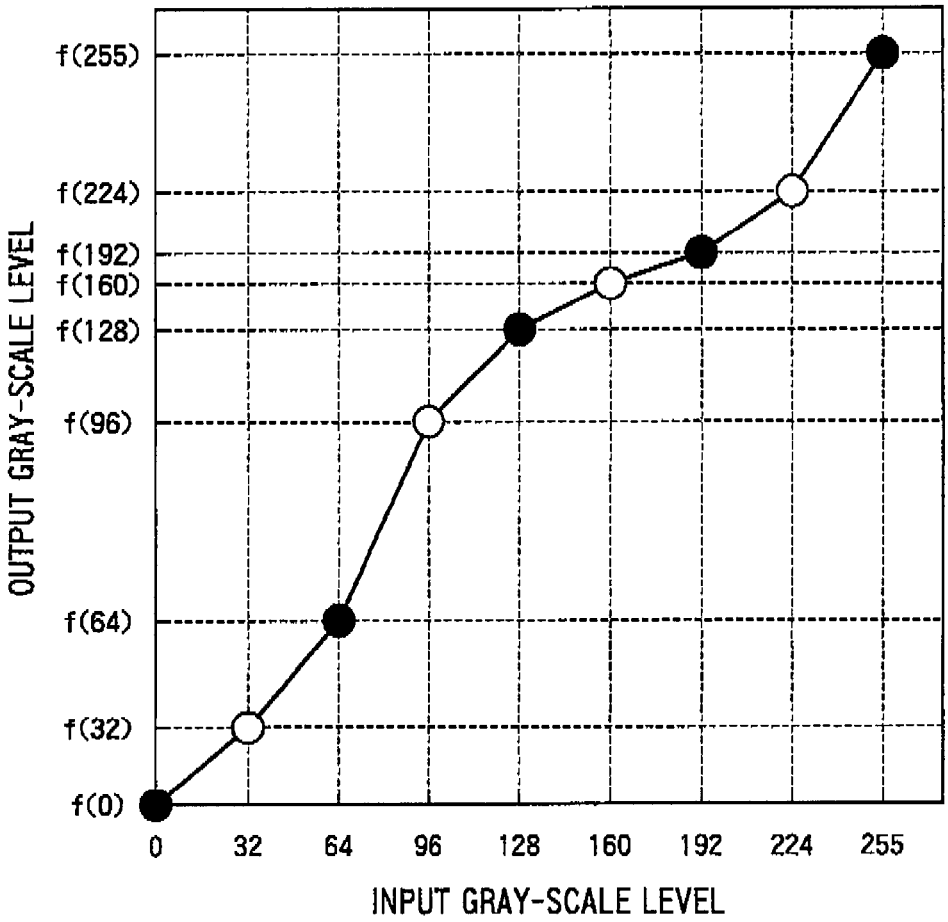
FIG. 30 shows a level conversion function halfway in generation.

For target input gray-scale levels shown as the white circles in FIG. 30, the histogram determined by the histogram generating unit 11 will be the same as the partial histogram, thus it is not necessary to generate a partial histogram at the partial histogram generating step (S152). For example, a partial histogram for 32 gray-scale level as the target input gray-scale level is expressed as Formulas 50 and 51:

$$H(0, 31) = \sum_{i=0}^{31} h(i) = h(16) \quad \text{[Formula 50]}$$

$$H(32, 63) = \sum_{i=32}^{63} h(i) = h(48) \quad \text{[Formula 51]}$$

Figure 31:
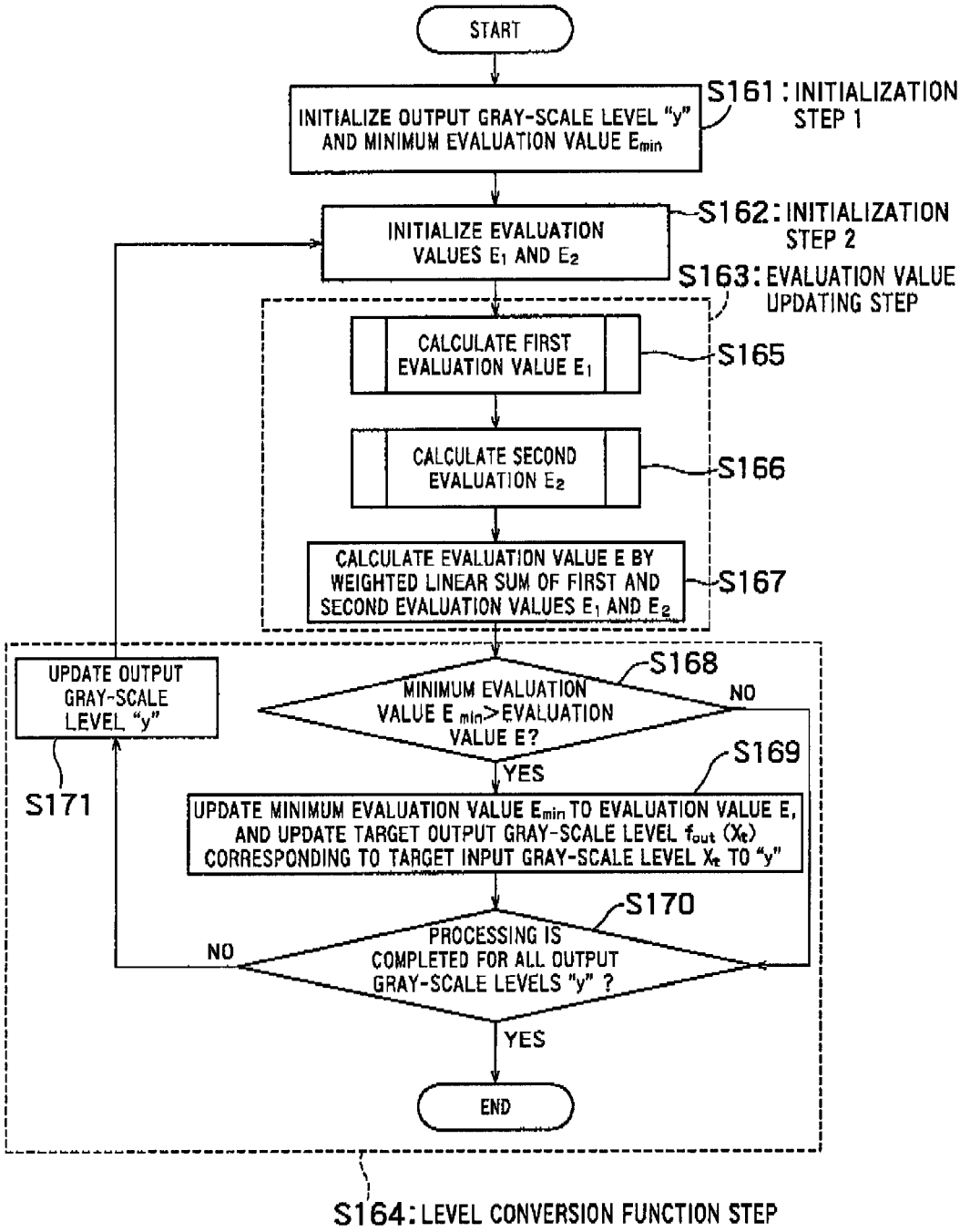
FIG. 31 is a flowchart illustrating the operation at target output gray-scale level calculating step.

At target output gray-scale level calculating step (S153), an output gray-scale level corresponding to the target input gray-scale level selected at the target input gray-scale level selecting step (S151) is calculated. Operation at the target output gray-scale level calculating step (S153) is described using the flowchart shown in FIG. 31.

Figure 28:
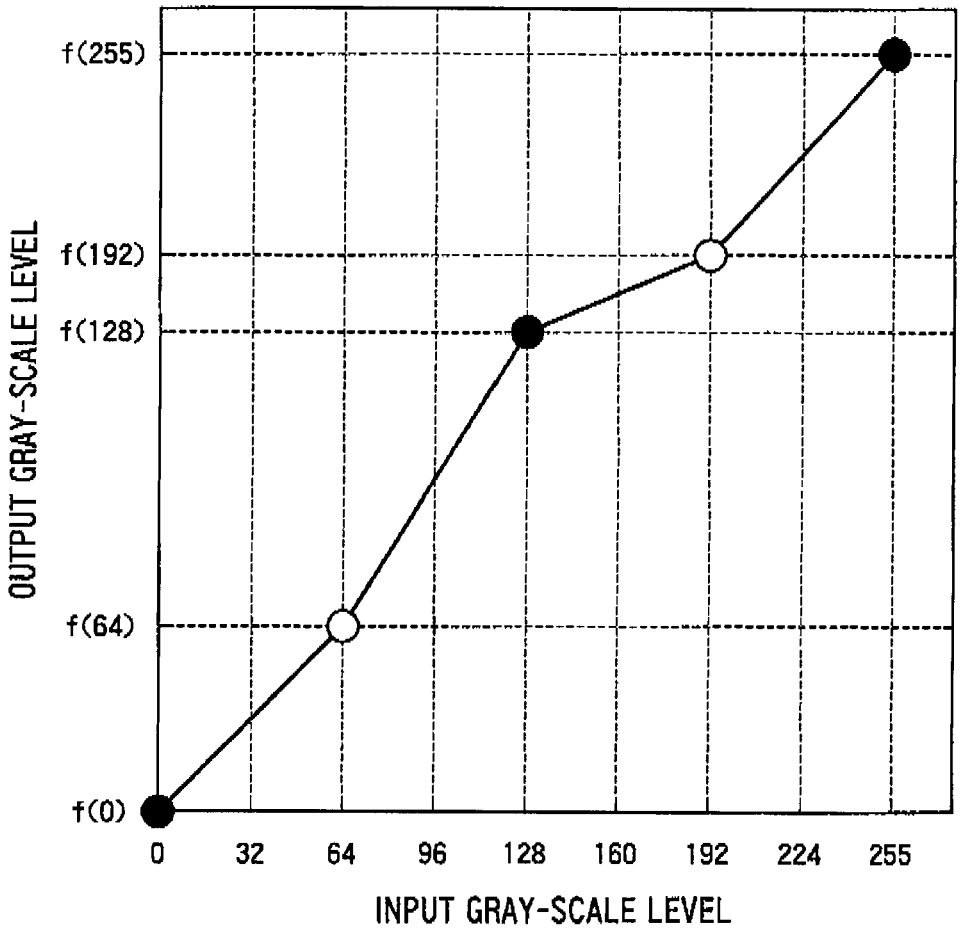
FIG. 28 shows a level conversion function halfway in generation.

At initialization step 1 (S161), variables to be used in subsequent processing are initialized. For example, processing like Formula 52 is performed:

$$y \leftarrow f_{out}(x_0)$$

$$E_{min} \leftarrow \text{MAX_VAL} \quad \text{[Formula 52]}$$

where "y" represents an output gray-scale level resulting from a level conversion function applied to an input gray-scale level x, and "$f_{out}(x)$" represents the finally calculated output level conversion function. For $f_{out}(0)$, 0 gray-scale level is preset, and for $f_{out}(255)$, 255 gray-scale level is preset. "$E_{min}$" represents the minimum evaluation value which will be used at level conversion function updating step (S164) discussed below. "$X_0$" represents the minimum gray-scale level in a certain range for selecting the target input gray-scale level $x_t$ as the midpoint level in the range at the target input gray-scale level selecting step (S151). The value $x_1$ used at the level conversion function updating step (S164) described below represents the maximum gray-scale level within the range. For example, when the target input gray-scale level $x_t$ is 64 level, "$x_0$" is 0 gray-scale level and "$x_1$" is 128 level as shown in FIG. 28. Likewise, when the target input gray-scale level $x_t$ is 160 gray-scale level, "$x_0$" is 128 gray-scale level and "$x_1$" is 192 gray-scale level as shown in FIG. 30.

At initialization step 2 (S162), the first evaluation value $E_1$ and the second evaluation value $E_2$ which will be used at the evaluation value updating step (S163) to be discussed later are initialized as shown in Formula 53:

$$E_1 \leftarrow 0$$

$$E_2 \leftarrow 0 \quad \text{[Formula 53]}$$

In evaluation value updating step (S163), the first and second evaluation values $E_1$ and $E_2$ are calculated at the first and second evaluation value updating steps (S165 and S166).

The first evaluation value calculating step (S165) operates to first determine a brightness $G(x_t)$ in the maximum dynamic range of the target input gray-scale level $x_t$ by making reference to the first setting lookup table 20. Next, the brightness $g(y, I_{out})$ of the image displaying unit 16 corresponding to the output gray-scale level "y" with the backlight luminance $I_{out}$ which is calculated by the backlight luminance calculating unit 22 is determined by referencing the second setting lookup table 21. Then, the difference between $G(x_t)$ and $g(y, I_{out})$ is calculated. Then, the difference is multiplied by the sum of the two frequencies $H(x_0, x_t-1)$ and $H(x_t, x_1)$ determined at the partial histogram generating step (S152), and the product is substituted into the evaluation value $E_1$. For example, when the difference is evaluated as an absolute value, it is expressed as Formula 54:

$$E_1 \leftarrow |G(x_t)-g(y,I_{out})|(H(x_0,x_t-1)+H(x_p,x_1)) \quad \text{[Formula 54]}$$

When the difference is evaluated as a square error, it is represented as Formula 55;

$$E_1 \leftarrow \{G(x_t)-g(y,I_{out})\}^2(H(x_0,x_t-1)+H(x_p,x_1)) \quad \text{[Formula 55]}$$

The evaluation performed in Formulas 54 and 55 using the gray-scale level-luminance characteristic may be done with the gray-scale level-brightness characteristics which were set at the setting step 1 (S161) and setting step 2 (S162) as described in the first embodiment. For example, when the difference is evaluated as a square error using a gray-scale level-lightness characteristic, it is represented as Formula 56:

$$E_1 \leftarrow \{G_{L^*}(x_t)-g_{L^*}(y,I_{out})\}^2(H(x_0,x_t-1)+H(x_p,x_1)) \quad \text{[Formula 56]}$$

Operation at the second evaluation value calculating step (S166) will be described next. First, brightnesses $G(x_t)$, $G(x_0)$, and $G(x_1)$ in the maximum dynamic range corresponding to the target input gray-scale level $x_t$, and the minimum and maximum gray-scale levels $x_0$ and $x_1$ in the level range in which "$x_t$" is selected as the midpoint level are determined by referencing the first setting lookup table 20. Next, brightnesses $g(y, I_{out})$, $g(f(x_0), I_{out})$ and $g(f(x_1), I_{out})$ of the image displaying unit 16 corresponding to output gray-scale levels $f(x_0)$ and $f(x_1)$ with an output level conversion function at output gray-scale level y, and $x_0$, and $x_1$ with backlight luminance $I_{out}$ calculated by the backlight luminance calculating unit 22 are determined by referencing the second setting lookup table 21. Then, the differentiation of the gray-scale level-brightness characteristic in the maximum dynamic range is replaced with a difference and a gradient is calculated as below:

$$\Delta G(x_0,x_t)=G(x_t)-G(x_0)$$

$$\Delta G(x_t,x_1)=G(x_1)-G(x_t) \quad \text{[Formula 57]}$$

Similarly, the differentiation of the gray-scale level-brightness gradient characteristic of the image displaying unit 16 is replaced with a difference and a gradient is calculated as follows:

$$\Delta g(f_{out}(x_0),y)=g(y,I_{out})-g(f_{out}(x_0),I_{out})$$

$$\Delta g(y,f_{out}(x_1))=g(f_{out}(x_1),I_{out})-g(y,I_{out}) \quad \text{[Formula 58]}$$

Here, unlike the first embodiment, this embodiment replaces gradient with difference. Therefore, the first and second setting lookup tables 20 and 21 do not have to maintain gray-scale level-brightness characteristics as in the first embodiment and a difference equivalent to a gradient is calculated from gray-scale level-brightness characteristic. Next, the difference between $\Delta G(x_0, x_t)$ and $\Delta g(f_{out}(x_0), y)$ and the difference between $\Delta G(x_t, x_1)$ and $\Delta g(y, f_{out}(x_1))$ are calculated. Then, the differences are respectively multiplied by two frequencies $H(x_0, x_t-1)$ and $H(x_t, x_1)$ determined at the partial histogram generating step (S152), and the products are added to the evaluation value $E_2$. For example, when the difference is evaluated in an absolute value, it is represented as Formula 59:

$$E_2 \leftarrow \Delta G(x_0,x_t)-\Delta g(f_{out}(x_0),y)|H(x_0,x_t-1)+|\Delta G(x_t,x_1)-\Delta g(y,f_{out}(x_1))|H(x_t,x_1) \quad \text{[Formula 59]}$$

Formula 59 is equivalent to a formula that replaces the differentiation of Formula 29 of the first embodiment with a difference and the frequency with a frequency that is determined from a partial histogram. When the difference is evaluated as a square error, it is represented as Formula 60:

$$E_2 \leftarrow \{\Delta G(x_0,x_t)-\Delta g(f_{out}(x_0),y)\}^2 H(x_0,x_t-1)+\{\Delta G(x_t,x_1)-\Delta g(y,f_{out}(x_1))\}^2 H(x_t,x_1) \quad \text{[Formula 60]}$$

The evaluation performed in Formulas 59 and 60 using the gray-scale level-luminance gradient characteristic may be done with the gray-scale level-brightness gradient characteristics which were set at the setting step 1 and setting step 2. For example, when the difference is evaluated as a square error using gray-scale level-lightness gradient characteristic, it is represented as Formula 61:

$$E_2 \leftarrow \{\Delta G_{L^*}(x_0,x_t)-\Delta g_L(f_{out}(x_0),y)\}^2 H(x_0,x_t-1)+\{\Delta G_{L^*}(x_t,x_1)-\Delta g_{L^*}(y,f_{out}(x_1))\}^2 H(x_t,x_1) \quad \text{[Formula 61]}$$

After calculation of the first and second evaluation values $E_1$ and $E_2$, an evaluation value E (a third evaluation value) is calculated by weighted linear sum, as shown in Formula 62, of the first and second evaluation values:

$$E \leftarrow \lambda E_1+(1-\lambda)E_2 \quad \text{[Formula 62]}$$

where "λ" represents a weight for the first and second evaluation values, a value in a range from 0 to 1.

At level conversion function updating step (S164), it is determined whether the evaluation value E determined at the evaluation value updating step (S163) for the current output gray-scale level "y" corresponding to the target input gray-scale level $x_t$ is minimum. If it is minimum (YES), the current output gray-scale level "y" is set as the target output gray-scale level $f_{out}(x_t)$ corresponding to the target input gray-scale level $x_t$, and the minimum evaluation value $E_{min}$ is updated to the current evaluation value E (S169). Then, it is determined whether evaluation is completed for all of output gray-scale levels "y" that were preset (S170). If not (NO), the output gray-scale level "y" is updated (S171). Specifically, if the output gray-scale level "y" is smaller than output gray-scale level $f_{out}(x_1)$ corresponding to the maximum gray-scale level $x_1$ in the level range in which the target input gray-scale level $x_t$ is selected as the midpoint level, the output gray-scale level "y" is incremented by a predetermined value (typically one) to be updated. Accordingly, the output gray-scale level "y" is a value equal to or greater than $f_{out}(x_0)$ and equal to or smaller than $f_{out}(x_1)$. If evaluation is completed (YES), the target output gray-scale level $f_{out}(x_t)$ at the time is output.

At termination determination step (S154), it is determined whether all of target input gray-scale levels that should be selected were selected at the target input gray-scale level selecting step (S151). Specifically, this embodiment determines whether all of the levels from 0 to 255 gray-scale level that are in increments of 32 levels were selected, and if not (NO), the flow returns to the target input gray-scale level selection step (S151) to select the next target input gray-scale level. If all the levels have been selected (YES), the output level conversion function $f_{out}(x)$ is output from the level conversion function calculator 24. In this embodiment, output level conversion functions $f_{out}(x)$ corresponding to input gray-scale levels that are in steps of 32 levels are calculated. Thus, the level conversion function calculator 24 of this embodiment is configured to linearly interpolate the output level conversion functions $f_{out}(x)$ at the end so as to determine an output level conversion function $f_{out}(x)$ that corresponds to all the input gray-scale levels x. The linear interpolation of output level conversion functions $f_{out}(x)$ may be performed at any point in the timing controller 14 as long as it takes place before level conversion of an input video, in addition to being performed in the level conversion function calculator 24. For instance, output level conversion functions for every 32 levels may be output by the level conversion function calculator 24 and a level conversion function corresponding to all the input gray-scale levels may be determined by linear interpolation inside the timing controller 14.

As described above, this embodiment can provide an image display apparatus with excellent visual contrast and reduced power consumption because it can set a level conversion function adaptively to an input video.

Fourth Embodiment

The basic configuration of an image display apparatus according to a fourth embodiment of the present invention is similar to that of the third embodiment, but the level conversion function calculator of this embodiment calculates the output level conversion function in a different way. The third embodiment selects the target input gray-scale level by stepwise selecting a level that is located halfway between input gray-scales for which corresponding output gray-scale levels have been already calculated, whereas this embodiment selects it from a higher level toward a lower level in sequence. The configuration of the level conversion function calculator that is different from that of the third embodiment will be described in detail below. Reference will be made to FIG. 23 for the block diagram showing the configuration of the fourth embodiment and configurations of other components are not described since they are similar to those of the first embodiment.

(The Level Conversion Function Calculator 24)

Figure 32:
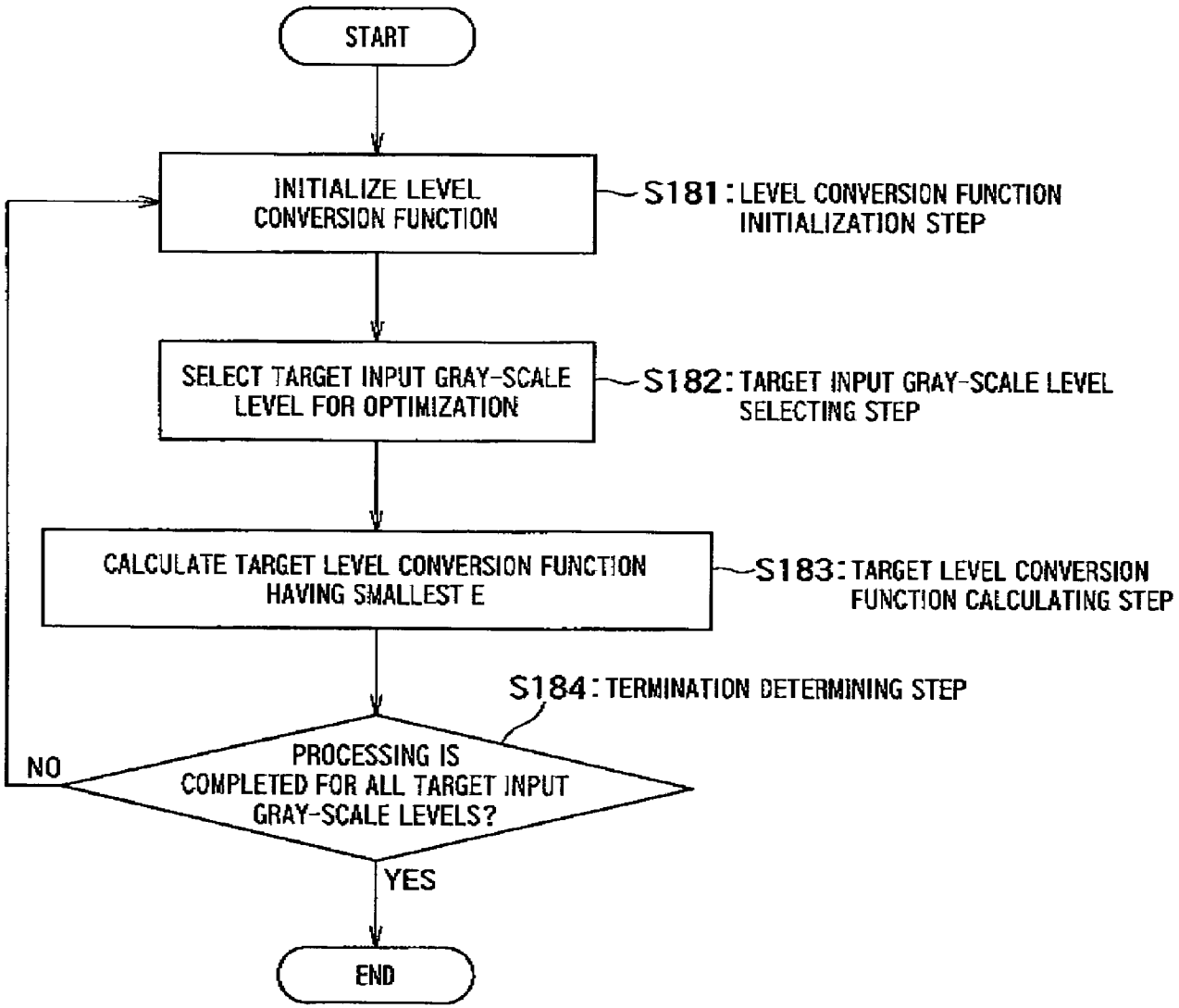
FIG. 32 is a flowchart illustrating the operation of the level conversion function calculator in a fourth embodiment.
Figure 35:
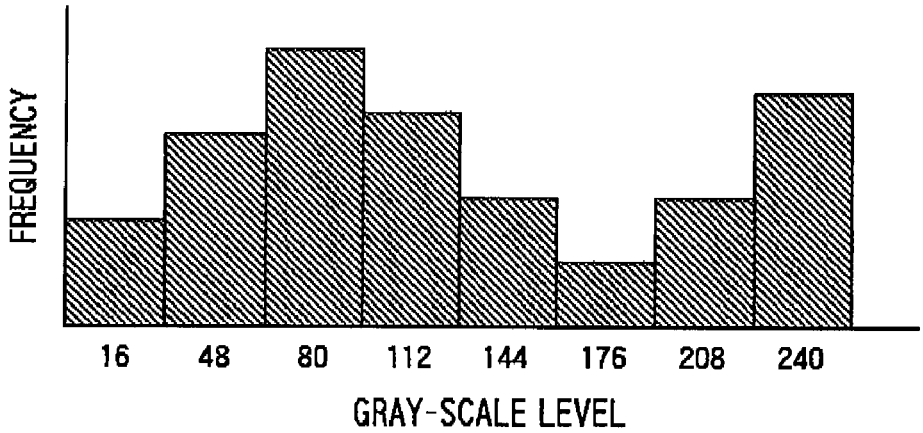
FIG. 35 shows all input gray-scale levels that should be processed.

The operation of the level conversion function calculator 24 according to the fourth embodiment will be described in detail using the flowchart shown in FIG. 32. For the sake of simplicity, it is assumed that a histogram generated by the histogram generating unit 11 determines frequency on a 32-level basis as shown in FIG. 35 and the level conversion function is determined by identifying output gray-scale levels that correspond to input gray-scale levels that are in blocks of 32 levels and an intermediate input gray-scale level is determined by linear interpolation.

Figure 33:
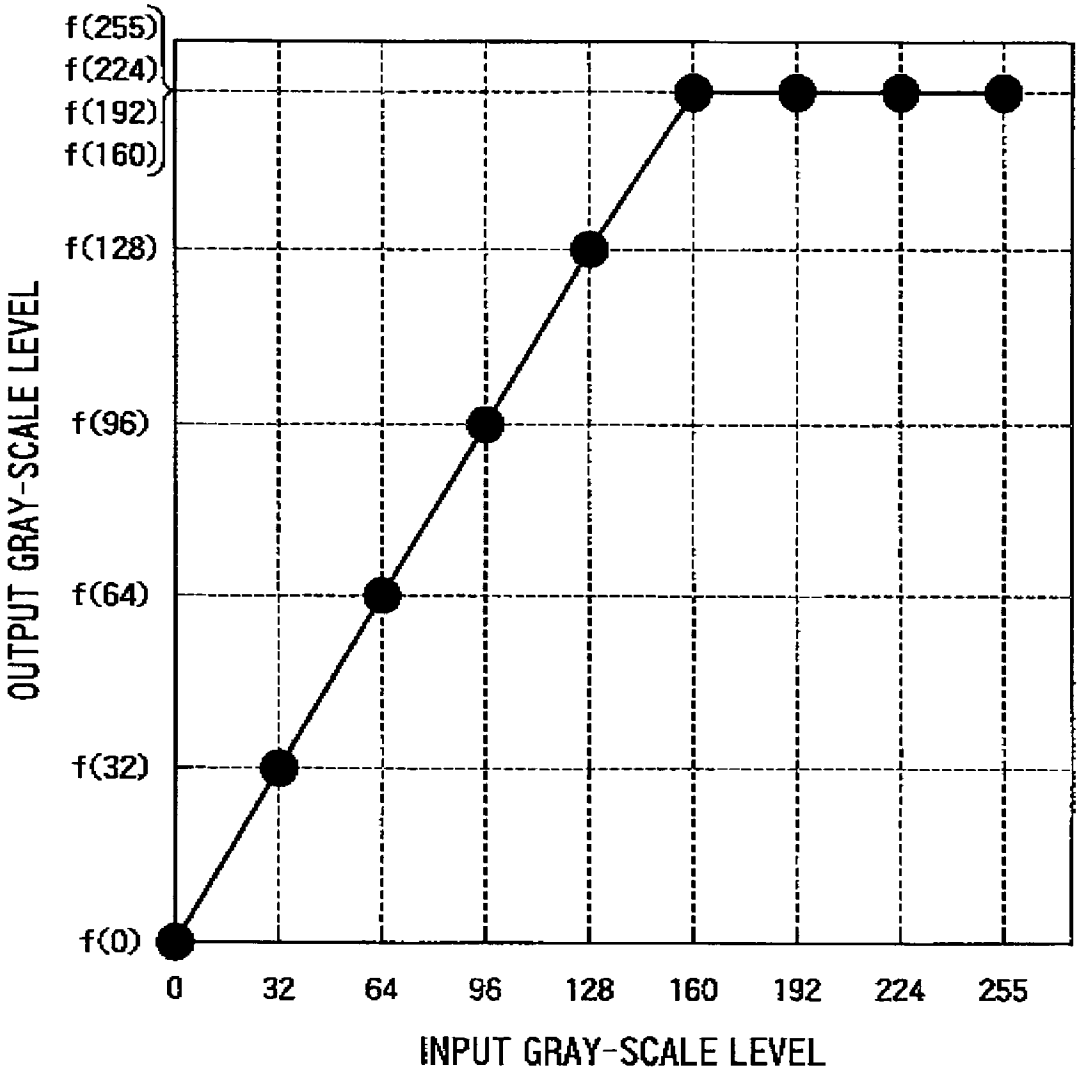
FIG. 33 shows an example of an initialized level conversion function.

At level conversion function initialization step (S181), the initial values of output gray-scale levels that correspond to input gray-scale levels that are in increments of 32 levels are set, that is, the level conversion function is initialized. While the initial value can be set in various ways, e.g., setting the input gray-scale level as the output gray-scale level as it is, this embodiment uses the initial level conversion function $f_c(x, I_{out})$ which was used in the second embodiment. An example of the initialized level conversion function is shown in FIG. 33, where "$I_{out}$" represents an output backlight luminance calculated by the backlight luminance calculating unit 22.

Figure 34:
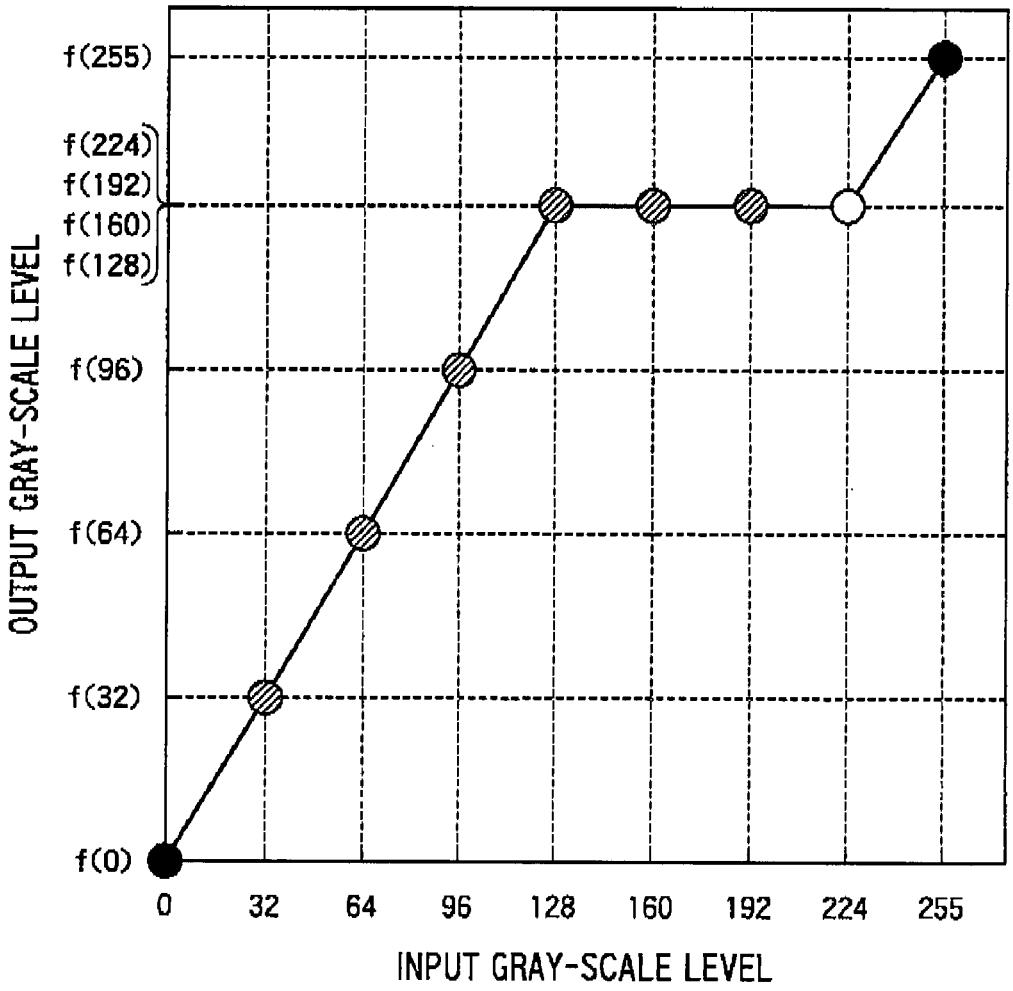
FIG. 34 shows a state of a level conversion function that is being updated.
Figure 36:
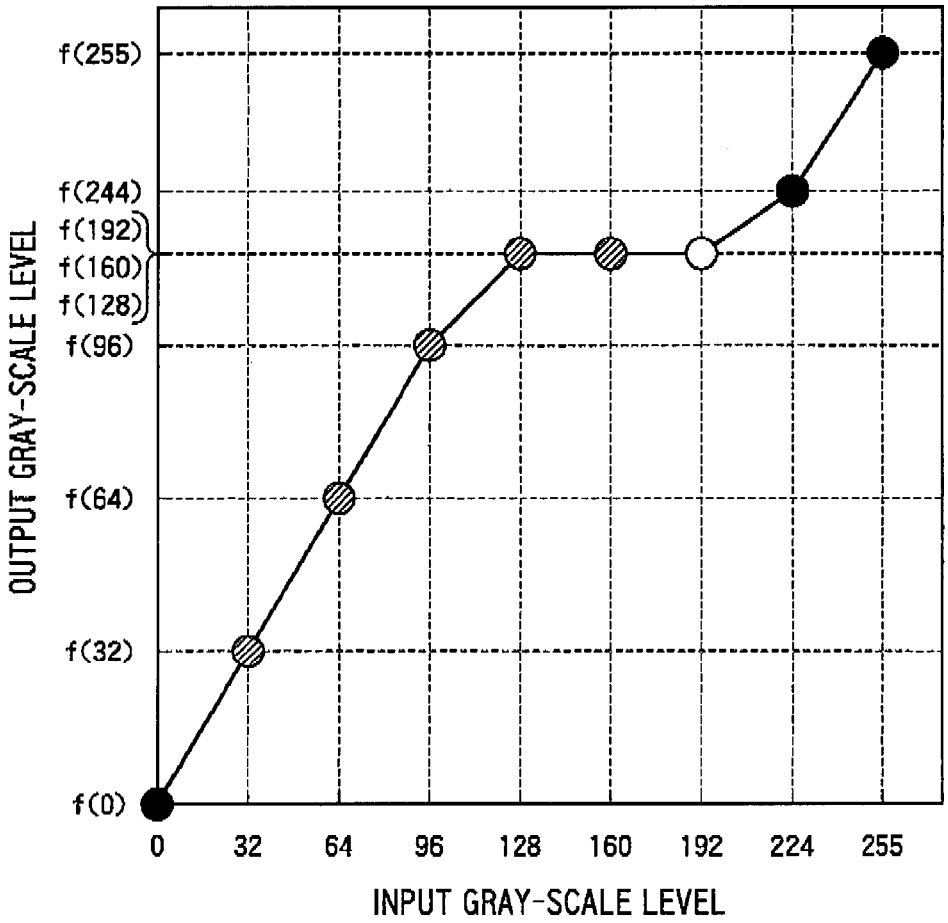
FIG. 36 shows a state of a level conversion function that is being updated.
Figure 38:
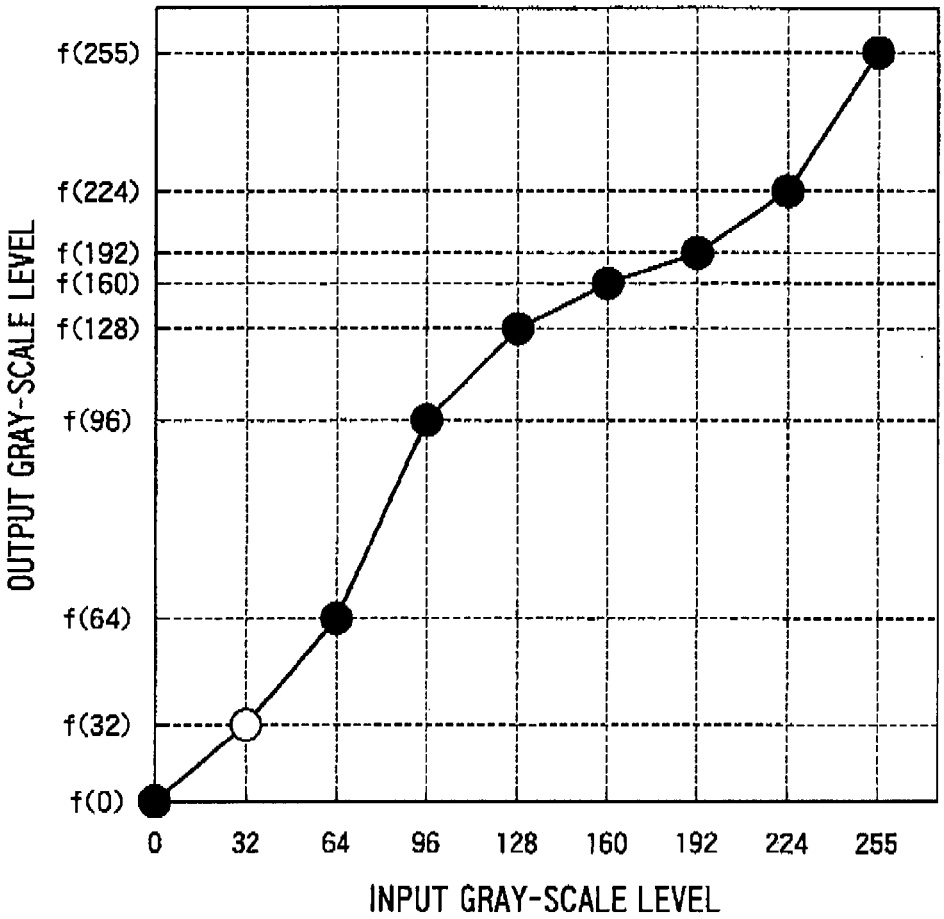
FIG. 38 shows a state of a level conversion function that is being updated.

At target input gray-scale level selecting step (S182), one input gray-scale level that will be subsequently processed is selected from among a plurality of input gray-scale levels for a level conversion function. In this embodiment, the target input gray-scale level is selected starting from a high gray-scale level toward a lower level in sequence. First, as in the third embodiment, an output gray-scale level that corresponds to 0 gray-scale level as the input gray-scale level is set as 0 gray-scale level, and one that corresponds to 255 gray-scale level as the input gray-scale level is set as 255 gray-scale level. Then, as shown by the white circle in FIG. 34, 224 gray-scale level that is on the higher level side is selected. Thereafter, as shown by the white circle in FIG. 36, 192 gray-scale level is selected. It is followed by similar selection of input gray-scale levels in steps of 32 levels in descending order, and finally 32 gray-scale level is selected as shown by the white circle in FIG. 38.

Figure 40:
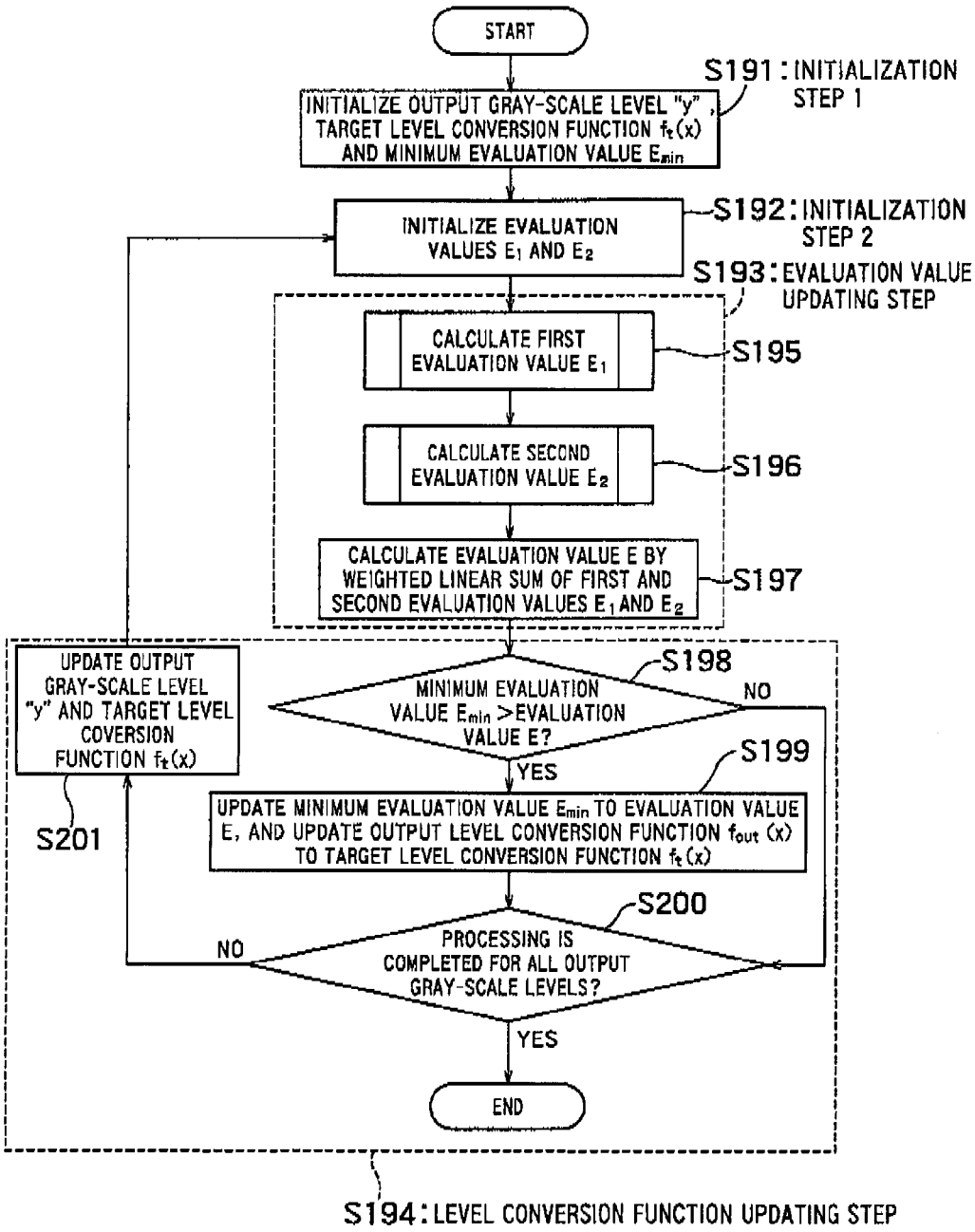
FIG. 40 is a flowchart illustrating the operation at target level conversion function calculating step.

At target level conversion function calculating step (S183), an output level conversion function corresponding to the target input gray-scale level selected at the target input gray-scale level selecting step (S182) is calculated. Operation at the target level conversion function calculating step (S183) is described using the flowchart shown in FIG. 40.

At initialization step 1 (S191), variables to be used in subsequent processing are initialized. For example, processing like Formula 63 is performed:

$$y \leftarrow f_{out}(x_t)$$

$$f_t(x) \leftarrow f_{out}(x)$$

$$E_{min} \leftarrow \text{MAX_VAL} \qquad \text{[Formula 63]}$$

where "y" represents an output gray-scale level resulting from a level conversion function being applied to the target input gray-scale level $x_t$ which was selected at the target input gray-scale level selecting step, and "$f_{out}(x)$" represents the finally calculated output level conversion function. "$f_{out}(x)$" has been set to $f_c(x, I_{out})$ at the level conversion function initialization step (S181) described above. "$f_t(x)$" represents a target level conversion function that will be used in subsequent level conversion function updating step (S194) and is initialized to an output level conversion function $f_{out}(x)$ at the initialization step 1 (S191). "$E_{min}$" represents the minimum evaluation value that will be used at level conversion function updating step (S194) discussed later.

At initialization step 2 (S192), the first evaluation value $E_1$ and the second evaluation value $E_2$ that will be used at evaluation value updating step (S193), to be discussed later, are initialized as shown in Formula 64:

$$E_1 \leftarrow 0$$

$$E_2 \leftarrow 0 \qquad \text{[Formula 64]}$$

In evaluation value updating step (S193), the first and second evaluation values $E_1$ and $E_2$ are calculated at the first and second evaluation value updating steps (S195 and S196).

Figure 37:
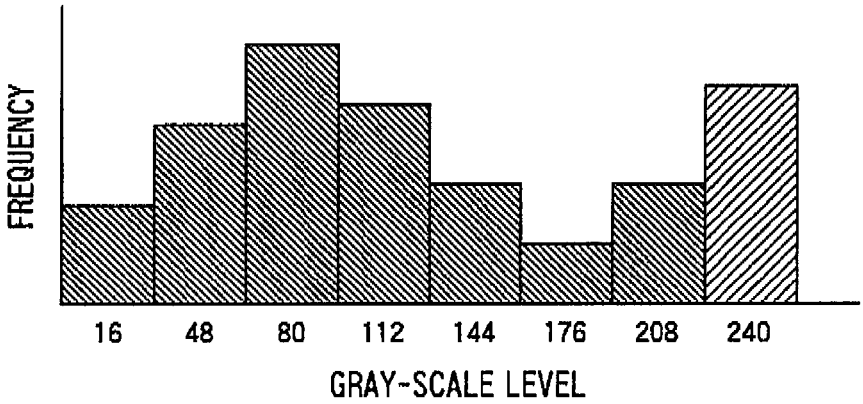
FIG. 37 shows a bin for which calculation of a square error may be omitted.
Figure 39:
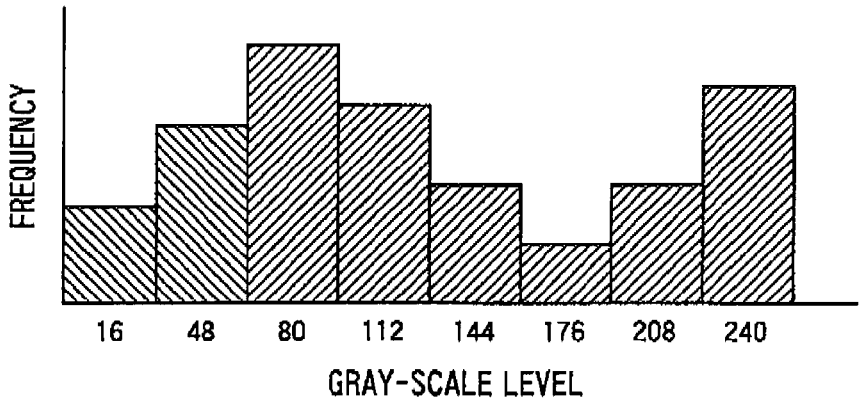
FIG. 39 shows bins for which calculation of a square error may be omitted.

The first evaluation value calculating step (S195) operates to first determine a brightness G(x) for the input gray-scale level x in the maximum dynamic range by making reference to the first setting lookup table 20. Next, the brightness $g(f_t(x), I_{out})$ of the image displaying unit 16 corresponding to the output gray-scale level $f_t(x)$ that will be obtained at the backlight luminance $I_{out}$ which was calculated by the backlight luminance calculating unit 22 and using the target level conversion function is determined by referencing the second setting lookup table 21. Next, the difference between G(x) and $g(f_t(x), I_{out})$ is calculated. Then, the difference is multiplied by the frequency h(x) of gray-scale level x determined by the histogram generating unit 11 and the result is added to the evaluation value $E_1$. This processing is performed to all input gray-scale levels ("x" is 16, 48, 80, 112, 144, 176, 208, and 240 gray-scale levels as shown in FIG. 35, for example, as this embodiment generates a histogram on a 32-level basis,) to calculate the evaluation value $E_1$. When the difference is evaluated as a square error, it is represented as Formula 65;

$$E_1 \leftarrow \sum_x \{G(x) - g(f_t(x), I_{out})\}^2 h(x) \qquad \text{[Formula 65]}$$

where "x" is 16, 48, 80, 112, 144, 176, 208, and 240 in this embodiment. The evaluation performed in Formula 65 using the gray-scale level-luminance characteristic may be done with the gray-scale level-brightness characteristics which were set at the setting step 1 and setting step 2 described in the second embodiment. For example, when the difference is evaluated as a square error using gray-scale level-lightness characteristic, it is expressed as Formula 66:

$$E_1 \leftarrow \sum_x \{G_{L^*}(x) - g_{L^*}(f_t(x), I_{out})\}^2 h(x) \qquad \text{[Formula 66]}$$

where "x" is 16, 48, 80, 112, 144, 176, 208, and 240 in this embodiment. Here, when target input gray-scale level $x_t$ is 192 gray-scale level as shown at the white circle in FIG. 36, for instance, output gray-scale levels $f_{out}(224)$ and $f_{out}(255)$ corresponding to 224 and 255 gray-scale levels as input gray-scale levels, which are shown by the black circles in FIG. 36, have been already calculated. Thus, out of square errors for input gray-scales shown in Formula 65 or 66, the square error for 240 gray-scale level as the input gray-scale level x is a value that does not change even when output gray-scale level "y" shown as the white circle in FIG. 36 changes. Thus, in the histogram shown in FIG. 37, calculation of the square error for the 240-level bin shown as the diagonally shaded area may be omitted. Similarly, when the target input gray-scale level $x_t$ is 32 gray-scale level as shown by the white circle in FIG. 38, output gray-scale levels from $f_{out}(64)$ to $f_{out}(255)$ corresponding to 64 to 255 gray-scale levels as input gray-scale levels shown by the black circles in FIG. 38 have been already calculated. Thus, in the histogram shown in FIG. 39, calculation of the square error for the 80 to 240-level bins shown as the diagonally shaded area may be omitted.

Now, the operation at the second evaluation value calculating step (S196) is described. First, a brightness $G(x_s)$ in the maximum dynamic range for a gray-scale level $x_s$ which is at the boundary between bins of the histogram generated by the histogram generating unit 11 is determined by referencing the first setting lookup table 20. Then, the brightness $g(f_t(x_s), I_{out})$ of the image displaying unit 16 corresponding to the output gray-scale level $f_t(x_s)$ that will be obtained at the backlight luminance $I_{out}$ calculated by the backlight luminance calculating unit 22 and using the target level conversion function is determined by referencing the second setting lookup table 21. Since this embodiment generates a histogram on a 32-level basis, the boundary levels $x_s$ are 0, 32, 64, 96, 128, 160, 192, 224 and 255 gray-scale levels as shown in FIG. 35. Then, the differentiation of gray-scale level-brightness gradient characteristic for the maximum dynamic range is replaced with a difference and a gradient is calculated as below:

$$\Delta G(x)=G(x-16)-G(x+16) \quad \text{[Formula 67]}$$

where "x−16" and "x+16" represent the boundary gray-scale levels $x_s$ of the input gray-scale x. For instance, when the input gray-scale level x is 48 gray-scale level, the boundary gray-scale levels are 32 and 64 gray-scale levels. However, when the input gray-scale level x is 240 gray-scale level, one of the boundary levels is rounded to 255 level because 240+16=256. Also, while this embodiment uses ±16 since it uses histograms on a 32-level basis, this value may vary as appropriate for a histogram generated. For instance, when a generated histogram is in units of 16 levels, the value is ±8. In a similar way, the differentiation of gray-scale level-brightness gradient characteristic of the image displaying unit 16 is replaced with a difference and a gradient is calculated as below:

$$\Delta g(f_t(x),I_{out})=g(f_t(x-16),I_{out})-g(f_t(x+16),I_{out}) \quad \text{[Formula 68]}$$

The output gray-scale level $f_t(x_t)$ for the target input gray-scale level $x_t$ corresponds to "y". Here, unlike the first embodiment, this embodiment replaces gradient with difference. Therefore, the first and second setting lookup tables 20 and 21 do not have to maintain gray-scale level-brightness characteristics as in the first embodiment and a difference equivalent to a gradient is calculated from gray-scale level-brightness characteristic. Next, the difference between $\Delta G(x)$ and $\Delta g(f_t(x), I_{out})$ is calculated. The differences is then multiplied by the frequency h(x) of gray-scale level x determined by the histogram generating unit, and the result is added to the evaluation value $E_2$. The above processing is performed to all input gray-scale levels ("x" is 16, 48, 80, 112, 144, 176, 208 and 240 gray-scale levels as shown in FIG. 35, for example, as this embodiment generates a histogram on a 32-level basis) to calculate the evaluation values $E_2$. When the difference is evaluated as a square error, it is represented as Formula 69:

$$E_2 \leftarrow \sum_x \{\Delta G(x) - \Delta g(f_t(x), I_{out})\}^2 h(x) \quad \text{[Formula 69]}$$

Formula 69 is equivalent to replacement of the differentiation in Formula 29 in the first embodiment with a difference. The evaluation performed in Formula 69 using the gray-scale level-luminance gradient characteristic may be done with the gray-scale level-brightness gradient characteristics which were set at the setting step 1 (S191) and setting step 2 (S192). For example, when the difference is evaluated as a square error using a gray-scale level-lightness gradient characteristic, it is represented as Formula 70:

$$E_2 \leftarrow \sum_x \{\Delta G_{L^*}(x) - \Delta g_{L^*}(f_t(x), I_{out})\}^2 h(x) \quad \text{[Formula 70]}$$

As mentioned in the description of the first evaluation value calculating step (S195), calculation of a square error for which an output gray-scale level is already calculated may be omitted.

After calculating the first and second evaluation values $E_1$ and $E_2$, an evaluation value E (a third evaluation value) is calculated by weighted linear sum of the first and second evaluation values $E_1$ and $E_2$ as shown in Formula 71:

$$E \leftarrow \lambda E_1 + (1-\lambda) E_2 \quad \text{[Formula 71]}$$

where "λ" represents a weight to the first and second evaluation values, a value in a range from 0 to 1.

At level conversion function updating step (S194), it is determined whether the evaluation value E for the current target level conversion function $f_t(x)$ is minimum. If it is minimum (YES), the current target level conversion function $f_t(x)$ is set as the output level conversion function $f_{out}(x)$, and the minimum evaluation value $E_{min}$ is updated to the current evaluation value E (S199). Then, it is determined whether evaluation is completed for all of output gray-scale levels "y" that were preset (S200). If not (NO), the output gray-scale level "y" and target level conversion function $f_t(x)$ are updated (S201). That is, if the output gray-scale level "y" is greater than 0, a predetermined value (typically 1) is subtracted from the output gray-scale level "y" to update the output gray-scale level y. Also, as the output gray-scale level "y" changes, the target level conversion function $f_t(x)$ is updated. First, using the target input gray-scale level $x_t$ and the updated output gray-scale level "y", the target level conversion function $f_t(x)$ is updated as Formula 72:

$$f_t(x_t) \leftarrow y \quad \text{[Formula 72]}$$

Then, since the level conversion function monotonically increases the output gray-scale level with increase in the input gray-scale level, the output gray-scale level $f_t(x)$ is updated to $f_t(x_t)$ if the output gray-scale level $f_t(x)$ corresponding to an input gray-scale level that is smaller than the target input gray-scale level $x_t$ is large as compared to $f_t(x_t)$.

Figure 41:
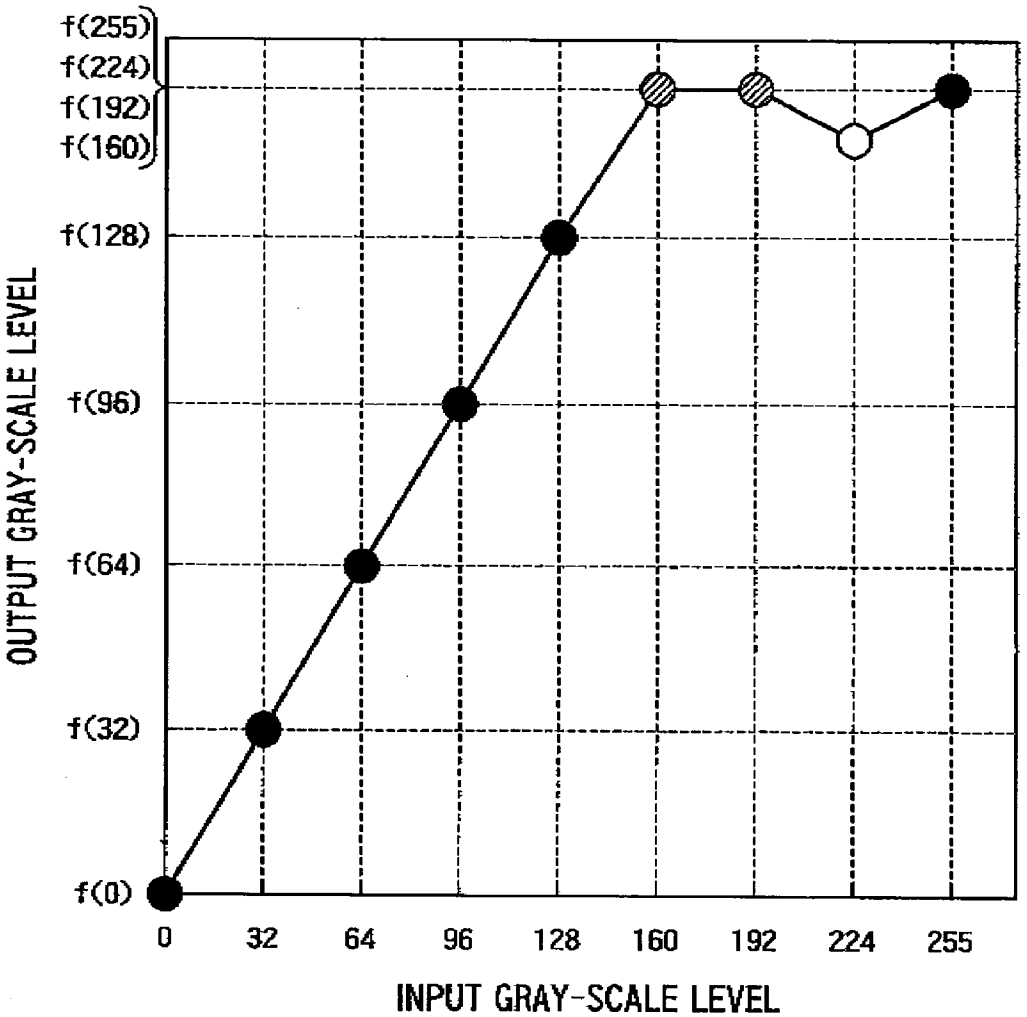
FIG. 41 supplementarily illustrates updating of a target level conversion function.
Figure 42:
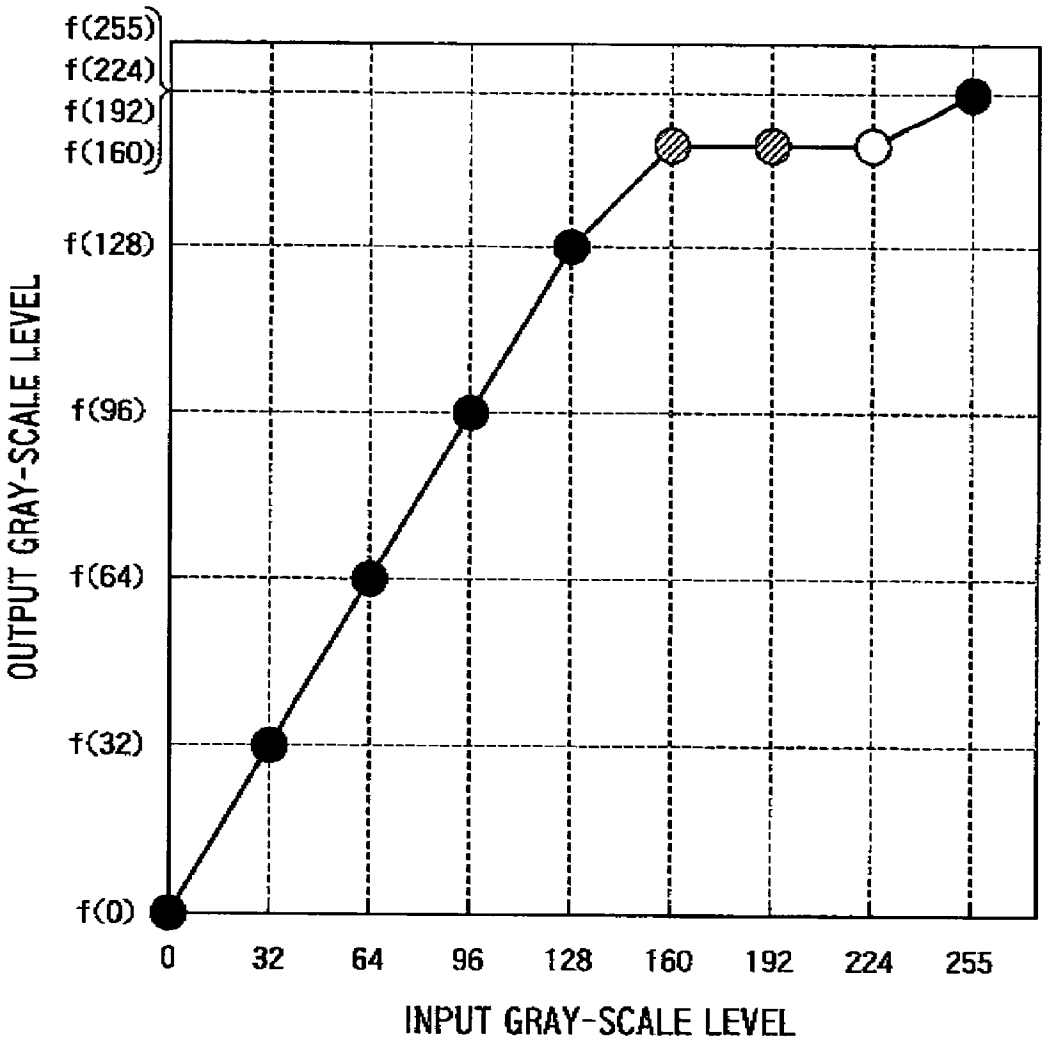
FIG. 42 supplementarily illustrates updating of a target level conversion function.

In the following, description is provided on a case where the target level conversion function of FIG. 33 is updated when the target input gray-scale level $x_t$ is 224 gray-scale level. First, change is made to the target level conversion function $f_t(x_t)$ that corresponds to the target input gray-scale level $x_t$ shown as the white circle in FIG. 41. At this point, output gray-scale levels $f_t(160)$ and $f_t(192)$ corresponding to input gray-scale levels smaller than the target input gray-scale level (i.e., 192 and 160 levels), which are shown as the shaded circles in FIG. 41, are of values larger than $f_t(x_t)$. Thus, as shown in FIG. 42, output gray-scale levels $f_t(x)$ corresponding to the input gray-scale levels smaller than the target input gray-scale level (192 and 160 gray-scale levels) are corrected to $f_t(x_t)$. Then, using the updated output gray-scale level "y" and target level conversion function $f_t(x)$, the evaluation value updating step (S93) and level conversion function updating step (S194) are repeated again. If evaluation is completed for all output gray-scale levels "y" that were preset, the target output level conversion function $f_{out}(x)$ at the time is output.

At termination determining step (S184), it is determined whether all of target input gray-scale levels that should be selected were selected at the target input gray-scale level selecting step (S182). Specifically, this embodiment determines whether all of the gray-scale levels from 0 to 255 levels in increments of 32 levels were selected, and if not (NO), the flow returns to the target input gray-scale level selection step (S182) to select the next target input gray-scale level. If all the levels have been selected (YES), the output level conversion function $f_{out}(x)$ at that point is output from the level conversion function calculator 24. In this embodiment, output level conversion functions $f_{out}(x)$ corresponding to input gray-scale levels that are in increments of 32 levels are calculated. Thus, the level conversion function calculator 24 of this embodiment is configured to linearly interpolate those output level conversion functions $f_{out}(x)$ at the end to determine an output level conversion function $f_{out}(x)$ that corresponds to all the input gray-scale levels x. Linear interpolation of output level conversion functions $f_{out}(x)$ may be performed at any point in the timing controller 14 as long as it takes place before level conversion of an input video. In addition to being performed in the level conversion function calculator 24. For instance, output level conversion functions for every 32 levels may be output by the level conversion function calculator 24 and a level conversion function corresponding to all the input gray-scale levels may be determined by linear interpolation inside the timing controller 14.

As described above, this embodiment can provide an image display apparatus with excellent visual contrast and reduced power consumption because it can set a level conversion function adaptively to an input video.

Fifth Embodiment

The basic configuration of an image display apparatus according to a fifth embodiment of the present invention is similar to those of the third and fourth embodiments, but this embodiment is configured to repeat calculation of a backlight luminance and a level conversion function. In the following, the configurations of the backlight luminance calculating unit and level conversion function calculator that involve repetition and are different from those of the third and fourth embodiments will be described in detail. As configurations of other components are similar to those of the first embodiment, description of them is omitted.

Figure 43:
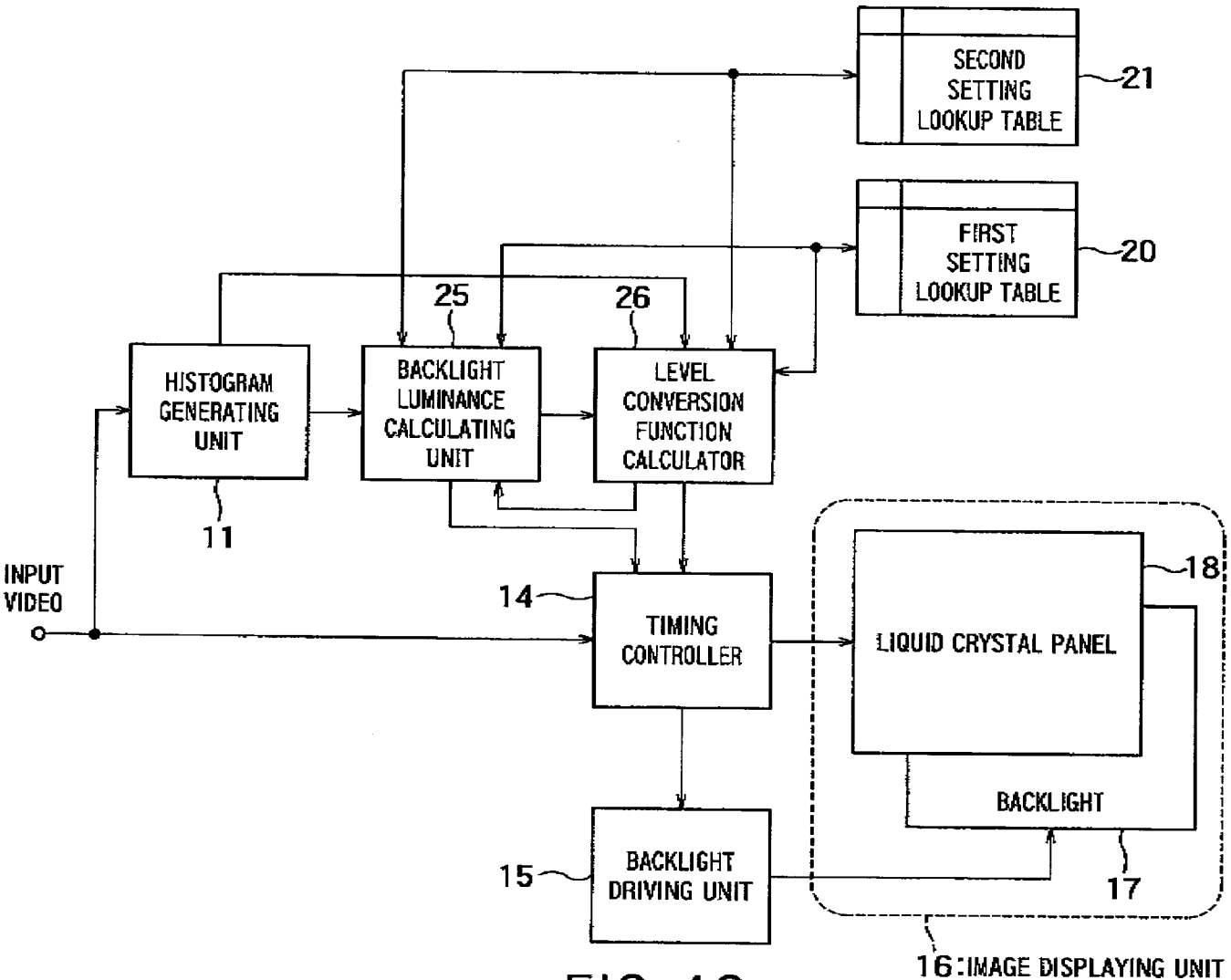
FIG. 43 shows the configuration of an image display apparatus according to a fifth embodiment of the present invention.

FIG. 43 shows the configuration of the image display apparatus according to the fifth embodiment of the present invention. The configuration of FIG. 43 is obtained by applying the configuration of the third embodiment shown in FIG. 23 to the fifth embodiment. The configuration of the image display apparatus according to the fifth embodiment enables a level conversion function calculated by the level conversion function calculator 26 to be input to the backlight luminance calculating unit 25.

Figure 44:
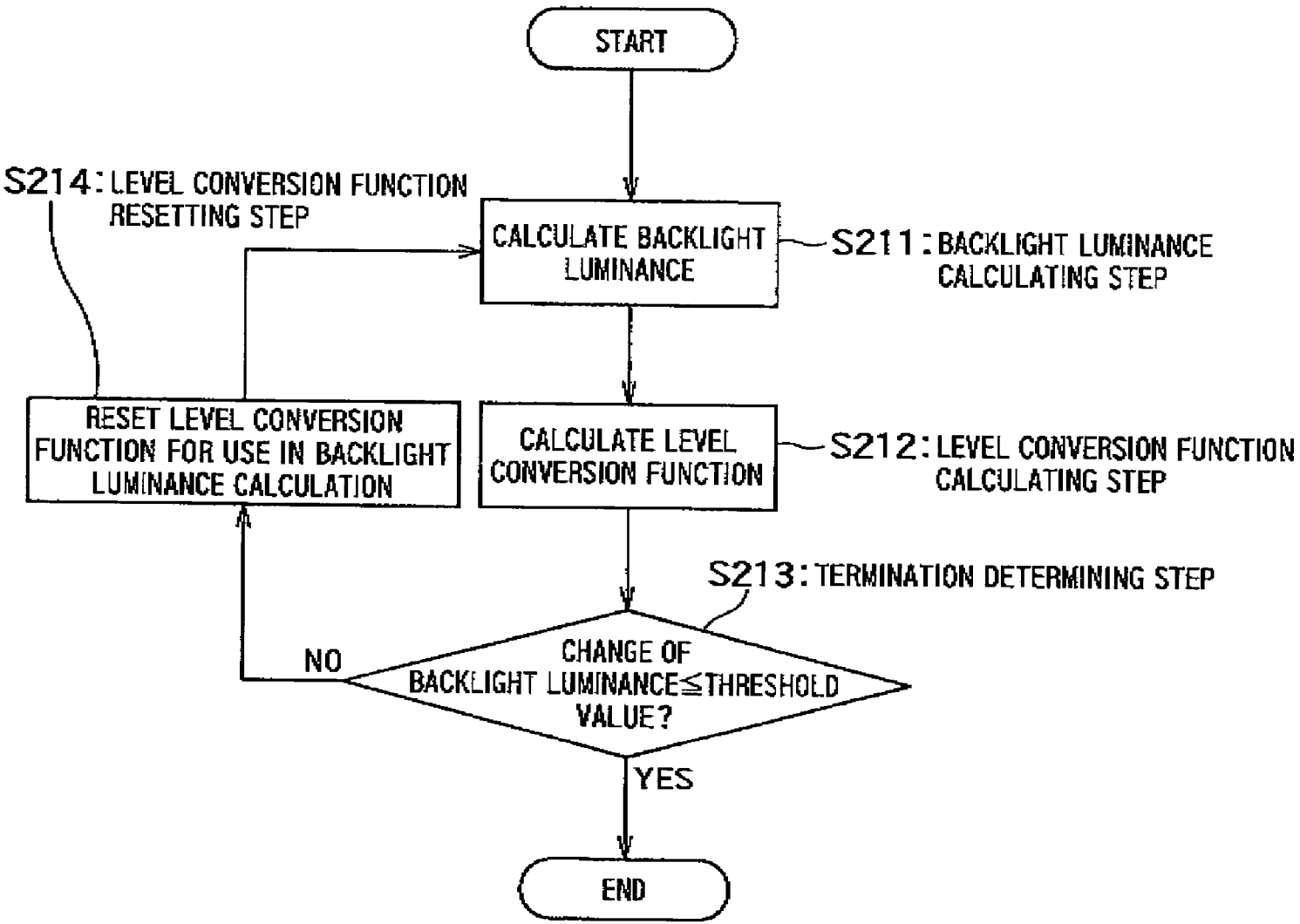
FIG. 44 is a flowchart illustrating the flow of calculation of a backlight luminance and a level conversion function in the fifth embodiment.

The flow of calculation of a backlight luminance and that of a level conversion function in this embodiment will be described using the flowchart shown in FIG. 44.

At backlight luminance calculating step (S211), an output backlight luminance $I_{out}$ is calculated. The backlight luminance is calculated as in the second embodiment using Formulas 37 to 43.

At level conversion function calculating step (S212), output level conversion function $f_{out}(x)$ is calculated. The level conversion function is calculated as in the third and fourth embodiments using the output backlight luminance $I_{out}$ determined at the backlight luminance calculating step (S211).

At termination determining step (S213), it is determined whether to repeat the backlight luminance calculating step (S211) and the level conversion function calculating step (S212). While this determination can be based on various conditions, this embodiment makes the determination according to whether the absolute value difference between the backlight luminance that was calculated in the immediately preceding backlight luminance calculating step and the one calculated at the current backlight luminance calculating step is smaller than a predetermined threshold value. That is, if the absolute value difference is larger than the threshold value, the backlight luminance calculating step (S211) and the level conversion function calculating step (212) are repeated once again. If the difference is smaller than the threshold value or if the number of repetitions has reached a predetermined value, the backlight luminance and the level conversion function at the time are output.

At level conversion function resetting step (S214), the level conversion function that is used at the backlight luminance calculating step (S211) is reset to the level conversion function $f_{out}(x)$ that was calculated at the level conversion function calculating step (S212). That is, the initial level conversion function $f_c(x, I)$ used at the backlight luminance calculating step is reset as below:

$$f_c(x,I) \leftarrow f_{out}(x) \quad \text{[Formula 73]}$$

Then, after the backlight luminance is calculated again at the backlight luminance calculating step (S211) using the level conversion function that has been reset, that output backlight luminance is used to calculate the level conversion function.

As described above, it is possible to calculate a backlight luminance and a level conversion function that are more suitable for the input video by repetitively calculating them.

As has been described, this embodiment can provide an image display apparatus with excellent visual contrast and reduced power consumption.

The present invention is not limited to the above-described embodiments and various modifications can be made thereto without departing from the spirit of the invention. For instance, while the above-described embodiments illustrate a transmissive liquid crystal display combining a liquid crystal panel and a backlight as the configuration of the image displaying unit, the embodiments can also be applied to various configurations of the image displaying unit other than the transmissive liquid crystal display. For example, the embodiments are also applicable to a projection image displaying unit that combines a liquid crystal panel as a light modulation element and a light source, such as a halogen light source. Alternatively, the embodiments are applicable to a projection image displaying unit that utilizes a halogen light source as the light source and a digital micro-mirror device as a light modulation element, which displays an image by controlling light reflection from the halogen light source.

What is claimed is:

1. An image display apparatus, comprising:

an image displaying unit that includes:

a light source unit that emits light whose luminance is adjustable; and a light modulation device configured to display an image by modulating a transmittance or a reflectance of light from the light source unit based on a signal representing the image, a histogram generating unit configured to generate, from the image, a histogram representing frequencies of pixels contained in level ranges associated with representative gray-scale levels;

a light source luminance calculator configured to calculate a light source luminance that is to be set in the light source unit based on the histogram, as an object light source luminance;

a function storing unit configured to store a level conversion function for performing level conversion of gray-scale level;

a first evaluation value calculator configured to calculate first differences between a first brightness preset for each of the representative gray-scale levels and a second brightness obtained when an output gray-scale level resulting from conversion of each of the representative gray-scale levels with the level conversion function is displayed on the image displaying unit at the object light source luminance, calculate products of the first differences and the frequencies of the representative gray-scale levels, and calculate a total sum of such products as a first evaluation value;

a second evaluation value calculator configured to calculate second differences between a first gradient which is a gradient of the first brightness preset for each of the representative gray-scale levels and a second gradient which is a gradient of the second brightness as when an output gray-scale level resulting from conversion of each of the representative gray-scale levels with the level conversion function is displayed on the image displaying unit at the object light source luminance, calculate products of the second differences and the frequencies of the representative gray-scales, and calculate a total sum of such products as a second evaluation value;

a third evaluation value calculator configured to calculate a third evaluation value by giving first and second weights to the first and the second evaluation values and then summing those first and second evaluation values;

a function acquiring unit configured to acquire a plurality of the third evaluation values by repeating performing of processing by the first to third evaluation value calculators with modification to the level conversion function and acquire an output level conversion function which is a level conversion function that has a smallest third evaluation value or the third evaluation value equal to or smaller than a threshold value; and a control unit configured to supply a signal representing a converted video resulting from conversion of the image with the output level conversion function to the light modulation device and to control the light source unit to illuminate at the object light source luminance.

2. The apparatus according to claim 1, wherein the light source luminance calculator calculates the object light source luminance based on at least one of an average value, a median, and a mode of the representative gray-scale levels which are calculated based on the histogram.

3. The apparatus according to claim 1, further comprising:

a second function storing unit having stored therein second level conversion functions prepared for first to Nth values of the light source luminance, wherein the light source luminance calculator for each of the first to Nth values of the light source luminance, calculates third differences between a first brightness preset for each of the representative gray-scale levels and a third brightness as when an output gray-scale level resulting from conversion of each of the representative gray-scale levels with the second level conversion function is displayed on the image displaying unit at the light source luminance, respectively, calculates the products of the third differences and the frequencies of the representative gray-scale levels, calculates the total sum of such products as a fourth evaluation value, and selects the light source luminance having a smallest fourth evaluation value or the fourth evaluation value equal or smaller than a second threshold value as the object light source luminance.

4. The apparatus according to claim 3, wherein the light source luminance calculator reselects the object light source luminance by using the output level conversion function as a second level conversion function common to the first to Nth values of the light source luminance, and the function acquiring unit acquires the output level conversion function by using the reselected object light source luminance.

5. The apparatus according to claim 1, wherein the function storing unit stores a plurality of the level conversion functions, and the function acquiring unit acquires the third evaluation value for each of the plurality of level conversion functions.

6. The apparatus according to claim 1, wherein the function acquiring unit selects one of the representative gray-scale levels;

acquires the plurality of the third evaluation values by changing the output gray-scale level corresponding to the selected representative gray-scale level in the level conversion function, updates the level conversion function so that the level conversion function outputs an output gray-scale level that has a smallest third evaluation value or the third evaluation value equal to or smaller than a third threshold value for the selected representative gray-scale level; and acquires the output level conversion function by repeating the selection of one from the representative gray-scale levels and updating of the level conversion function.

7. The apparatus according to claim 6, wherein an output gray-scale level corresponding to a smallest representative gray-scale level and an output gray-scale level corresponding to a largest representative gray-scale level are selected in the level conversion function in advance, and the function acquiring unit sequentially selects an intermediate gray-scale level between two representative gray-scale levels for which the output gray-scale levels has already been selected.

8. The apparatus according to claim 6, wherein the function acquiring unit selects the representative gray-scale level in descending order from a largest representative gray-scale level to a smallest representative gray-scale level in the level conversion function.

9. The apparatus according to claim 1, wherein the first evaluation value calculator calculates the product of the first difference and $\alpha$th power of the frequency ("$\alpha$" being a real number greater than 0) for each of the representative gray-scale levels, respectively, and calculates the total sum of each product as the first evaluation value, and the second evaluation value calculator calculates the product of the second difference and $\beta$th power of the frequency ("$\beta$" being a real number greater than 0) for each of the representative gray-scale levels, respectively, and calculates the total sum of each product as the second evaluation value.

10. The apparatus according to claim 1, further comprising a first table that maintains correspondence between the representative gray-scale levels and respective first brightness, wherein the first evaluation value calculator uses the first table to acquire the first brightness corresponding to each of the representative gray-scale levels, and the second evaluation value calculator uses the first table to acquire, as the first gradient corresponding to each of the representative gray-scale levels, either a difference between the first brightness for the representative gray-scale level and the first brightness for a larger or smaller gray-scale level than the representative gray-scale level or a difference between the first brightness for a larger gray-scale level than the representative gray-scale level and the first brightness for a smaller gray-scale level than the representative gray-scale level.

11. The apparatus according to claim 1, further comprising a first table that maintains correspondence between the representative gray-scale levels and respective first brightness, and a second table that maintains correspondence between the representative gray-scale levels and respective first gradient, wherein the first evaluation value calculator uses the first table to acquire the first brightness corresponding to each of the representative gray-scale levels, and the second evaluation value calculator uses the second table to acquire the first gradient corresponding to each of the representative gray-scale levels.

12. The apparatus according to claim 1, further comprising a third table that maintains correspondence among the representative gray-scale levels, a plurality of light source luminance, and brightness obtained when the output gray-scale level resulting from conversion of each of the representative gray-scale levels with the level conversion function is displayed at each of the light source luminance, wherein the first evaluation value calculator references the third table based on the object light source luminance to acquire the second brightness corresponding to each of the representative gray-scale levels, and the second evaluation value calculator references the third table based on the object light source luminance to acquire, as the second gradient corresponding to each of the representative gray-scale levels, either a difference between the second brightness for the representative gray-scale level and the second brightness for a larger or smaller gray-scale level than the representative gray-scale level or a difference between the second brightness for a larger gray-scale level than the representative gray-scale level and the second brightness for a smaller gray-scale level than the representative gray-scale level.

13. The apparatus according to claim 1, further comprising a third table that maintains correspondence among the representative gray-scale levels, a plurality of light source luminance, and brightness obtained when the output gray-scale level resulting from conversion of each of the representative gray-scale levels with the level conversion function is displayed at each of the light source luminance, and a fourth table that maintains correspondence among the representative gray-scale levels, a plurality of light source luminance, and brightness gradients when the output gray-scale level resulting from conversion of each of the representative gray-scale levels with the level conversion function is displayed at each of the light source luminance, wherein the first evaluation value calculator references the third table based on the object light source luminance to acquire the second brightness corresponding to each of the representative gray-scale levels, and the second evaluation value calculator references the fourth table based on the object light source luminance to acquire the second gradient corresponding to each of the representative gray-scale levels.

14. An image display method, comprising:

generating, from the image, a histogram representing frequencies of pixels contained in level ranges associated with representative gray-scale levels;

calculating a light source luminance that is to be set in a light source unit based on the histogram as an object light source luminance;

reading out a level conversion function for performing level conversion of gray-scale level from a function storage storing the level conversion function;

calculating first differences between a first brightness preset for each of the representative gray-scale levels and a second brightness obtained when an output gray-scale level resulting from conversion of each of the representative gray-scale levels with the level conversion function is displayed on the image displaying unit at the object light source luminance, calculating products of the first differences and the frequencies of the representative gray-scale levels, and calculating a total sum of such products as a first evaluation value;

calculating second differences between a first gradient which is a gradient of the first brightness preset for each of the representative gray-scale levels and a second gradient which is a gradient of the second brightness as when an output gray-scale level resulting from conversion of each of the representative gray-scale levels with the level conversion function is displayed on the image displaying unit at the object light source luminance, calculating products of the second differences and the frequencies of the representative gray-scales and calculating a total sum of such products as a second evaluation value;

calculating a third evaluation value by giving first and second weights to the first and the second evaluation values and then summing those first and second evaluation values;

acquiring a plurality of the third evaluation values by repeating performing of processing by calculations of the first to third evaluation value with modification to the level conversion function and acquiring an output level conversion function which is a level conversion function that has a smallest third evaluation value or the third evaluation value equal to or smaller than a threshold value; and supplying a signal representing a converted video resulting from conversion of the image with the output level conversion function to a light modulation device which displays an image by modulating a transmittance or a reflectance of light from the light source unit based on a signal representing the image and controlling the light source unit to illuminate at the object light source luminance.

* * * * *